US008434851B2

(12) United States Patent
Asauchi

(10) Patent No.: US 8,434,851 B2
(45) Date of Patent: May 7, 2013

(54) PRINTING APPARATUS

(75) Inventor: Noboru Asauchi, Yamagata (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 13/224,162

(22) Filed: Sep. 1, 2011

(65) Prior Publication Data

US 2012/0056920 A1 Mar. 8, 2012

(30) Foreign Application Priority Data

Sep. 3, 2010 (JP) ..... 2010-197319

(51) Int. Cl.
*B41J 29/393* (2006.01)

(52) U.S. Cl.
USPC ..... 347/19; 347/14

(58) Field of Classification Search ..... 347/14, 347/19, 20, 49, 50, 84–87
See application file for complete search history.

(56) References Cited

U.S. PATENT DOCUMENTS

| | | | | |
|---|---|---|---|---|
| 5,506,611 | A * | 4/1996 | Ujita et al. | 347/86 |
| 2002/0112878 | A1 | 8/2002 | Ishizawa et al. | |
| 2006/0238558 | A1 | 10/2006 | Hatasa et al. | |
| 2007/0126770 | A1 | 6/2007 | Asauchi | |
| 2007/0149044 | A1 | 6/2007 | Asauchi | |
| 2008/0259135 | A1 | 10/2008 | Asauchi et al. | |
| 2009/0262161 | A1 | 10/2009 | Nishihara | |

FOREIGN PATENT DOCUMENTS

| | | | |
|---|---|---|---|
| JP | 2002/198627 | A | 7/2002 |
| JP | 2005/326779 | A | 11/2005 |
| JP | 2006/297826 | A | 11/2006 |
| JP | 2007/196664 | A | 8/2007 |
| JP | 2009-274438 | A | 11/2009 |
| WO | WO 2006/025575 | A1 | 3/2006 |
| WO | WO 2006/025578 | A1 | 3/2006 |

* cited by examiner

*Primary Examiner* — Juanita D Jackson
(74) *Attorney, Agent, or Firm* — Kilpatrick Townsend & Stockton LLP

(57) ABSTRACT

A mounting detection circuit of a printing apparatus outputs a first mounting inspection signal to one of first terminals and outputs a second mounting inspection signal to one of second terminals thereby performing a mounting inspection for determining whether or not printing materials are mounted depending on whether or not second mounting response signal is received, and examines at least one of whether or not the second mounting response signal is influenced by the first mounting inspection signal and whether or not a first mounting response signal is influenced by the second mounting inspection signal thereby performing a leakage inspection for determining whether or not there is a leakage between the first and second terminals.

6 Claims, 47 Drawing Sheets

ERECTED

INCLINED TO RIGHT

INCLINED TO LEFT

DURING NORMAL OPERATION

LOOSE CONTACT OF TERMINALS 250 AND 290

LOOSE CONTACT OF TERMINALS 210 AND 240

LEAKAGE BETWEEN TERMINALS 240 AND 290

LEAKAGE BETWEEN TERMINALS 210 AND 250

NO LEAKAGE

LEAKAGE BETWEEN TERMINALS 240 AND 290

LEAKAGE BETWEEN TERMINALS 210 AND 250

MODIFIED EXAMPLE 1 OF MOUNTING DETECTION SIGNAL

MODIFIED EXAMPLE 2 OF MOUNTING DETECTION SIGNAL $$I_{DET}=\frac{VHV}{R_c} \qquad R_c=R\frac{1}{\sum_{j=1}^{N}\frac{1}{2^j}}$$

COMMON BOARD 200n

COMPARATIVE EXAMPLE

STAND-ALONE COLOR CARTRIDGE

COLORS-IN-ONE CARTRIDGE 100r + COMMON BOARD 200r

COMMON BOARD 200r

PRINTING APPARATUS

BACKGROUND

1. Technical Field

The present invention relates to a printing apparatus in which a printing material cartridge can be mounted.

2. Related Art

Recently, as a printing material cartridge, a cartridge in which a storage device that stores information regarding a printing material (for example, a remaining ink amount) is mounted has been used. In addition, a technique for detecting a mounted state of the printing material cartridge has been used. For example, in JP-A-2009-274438, a signal that is different from a signal for detecting a remaining ink amount is supplied to a remaining ink amount sensor provided in an ink cartridge, thereby performing mounting detection of the cartridge. In a technique according to the related art, it is common to detect a mounted state using one or two terminals from among a number of terminals provided in a cartridge.

However, even when that the cartridge is correctly mounted is detected, there may be cases where contacts between other terminals that are not used for the mounting detection and terminals of a printing apparatus are insufficient. In particular, when contacts of terminals for a storage device are insufficient, there is a problem in that errors occur during reading of data from the storage device or writing of data in the storage device.

However, as an aspect of detection of the mounted state or contacts of the printing material cartridge, short circuit detection which examines whether or not terminals of a cartridge are short-circuited may be performed. During the short circuit detection, for example, a terminal for short circuit detection is provided at a position adjacent to a terminal for a high voltage to which a voltage higher than a general power supply voltage (3.3V) is applied, and whether or not an excessive voltage is generated in the terminal for short circuit detection is examined. In addition, when an excessive voltage is detected in the terminal for short circuit detection, application of a high voltage to the terminal for a high voltage is stopped. However, even though the application of a high voltage is immediately stopped when the excessive voltage is generated in the terminal for short circuit detection, there is a problem in that due to the excessive voltage generated before the stoppage, there is a possibility that some defects may be generated in the cartridge or the printing apparatus.

Moreover, the problems described above are not limited to the ink cartridge and also occur in printing material cartridges in which different kinds of printing materials (for example, toner) are stored. Furthermore, the same problems also occur in liquid ejecting apparatuses that eject different kinds of liquid from the printing materials and liquid storage containers (liquid containers) therefor.

JP-A-2005-326779 and JP-A-2006-297826 are examples of related art.

SUMMARY

An advantage of some aspects of the invention is to provide a technique for appropriately checking a mounted state of a cartridge or a circuit board for the cartridge.

The invention can be realized as the following aspects or applications.

Application 1

A printing apparatus includes: a cartridge mounting unit in which one or more printing material cartridges are mounted; and a control circuit which includes a mounting detection circuit that detects a mounted state of the printing material cartridge in the cartridge mounting unit, wherein the printing material cartridge has an electric device and a plurality of terminals used for detecting the mounted state of the corresponding printing material cartridge in the cartridge mounting unit, the electric device is connected between two first terminals from among the plurality of terminals of the printing material cartridge, and two second terminals disposed adjacent to the two first terminals are connected via a wiring line to each other, and the mounting detection circuit outputs a first mounting inspection signal to one of the two first terminals, outputs a second mounting inspection signal having a different signal waveform from that of the first mounting inspection signal to one of the two second terminals, performs mounting inspection to determine whether or not the printing material cartridge is mounted depending on whether or not a second mounting response signal can be received as a response signal of the second mounting inspection signal via the other of the two second terminals, and performs leakage inspection of determining whether or not there is a leakage between the first and second terminals by examining at least one of whether or not the second mounting response signal is influenced by the first mounting inspection signal and whether or not a first mounting response signal is influenced by the second mounting inspection signal.

In this configuration, whether or not there is a leakage between the terminals is examined by leakage inspection, so that application of an abnormally high voltage to the printing material cartridge or the printing apparatus due to a short circuit can be prevented. In addition, both the mounting inspection and the leakage inspection are simultaneously performed, the inspections can be performed without the need of an excessively long time.

Application 2

In the printing apparatus according to Application 1, when the results of the mounting inspection and the leakage inspection are successful, the control circuit performs a high-voltage process for supplying a high-voltage signal having a higher voltage level than that of the first mounting inspection signal to the electric device via one of the two first terminals, and the mounting detection circuit monitors whether or not an overvoltage is generated in at least one of the two second terminals in the middle of the high-voltage process, and when the overvoltage is detected, stops supplying the high-voltage signal to the electric device from the control circuit.

In this configuration, a high-voltage process is performed only when no leakage is confirmed by the leakage inspection, so that application of an abnormally high voltage to the printing material cartridge or the printing apparatus due to a short circuit can be prevented.

Application 3

In the printing apparatus according to Applications 1 or 2, the mounting detection circuit changes an output terminal of the second mounting inspection signal from a low level to a high impedance state when the first mounting inspection signal is caused to rise from a low level to a high level.

In this configuration, the first mounting inspection signal rises from the low level to the high level when the second mounting inspection signal is in a high impedance state, so that whether or not the first mounting inspection signal influences the second mounting response signal due to leakage can be easily determined.

Application 4

In the printing apparatus according to any one of Applications 1 to 3, in the cartridge mounting unit, N (N is integer equal to or larger than 2) printing material cartridges can be mounted, in each of the N printing material cartridges, the two second terminals form wiring line paths sequentially connected in series in an arrangement order of the N printing material cartridges via a plurality of apparatus-side terminals provided in the cartridge mounting unit and the both ends of the wiring line paths are connected to the mounting detection circuit, and the mounting detection circuit determines whether or not the N printing material cartridges are all mounted to the cartridge mounting circuit, depending on whether or not the second mounting response signal can be received.

In this configuration, whether or not the N printing material cartridges are all mounted in the cartridge mounting unit can be easily determined using the second mounting response signal.

Application 5

In the printing apparatus according to any one of Applications 1 to 4, the electric device is a sensor used for detecting an amount of a printing material remaining in the printing material cartridge.

Application 6

In the printing apparatus according to any one of Applications 1 to 4, the electric device is a resistive element.

In addition, the invention can be realized in various forms, and for example, can be realized in the forms of a printing material cartridge, a printing material cartridge set including a plurality of kinds of printing material cartridges, a cartridge adapter, a cartridge adapter set including a plurality of kinds of cartridge adapters, a circuit board, a printing apparatus, a liquid ejecting apparatus, a printing material supply system including the printing apparatus and the cartridge, a liquid supply system including the liquid ejecting apparatus and the cartridge, a method of detecting a mounted state of the cartridge or the circuit board, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
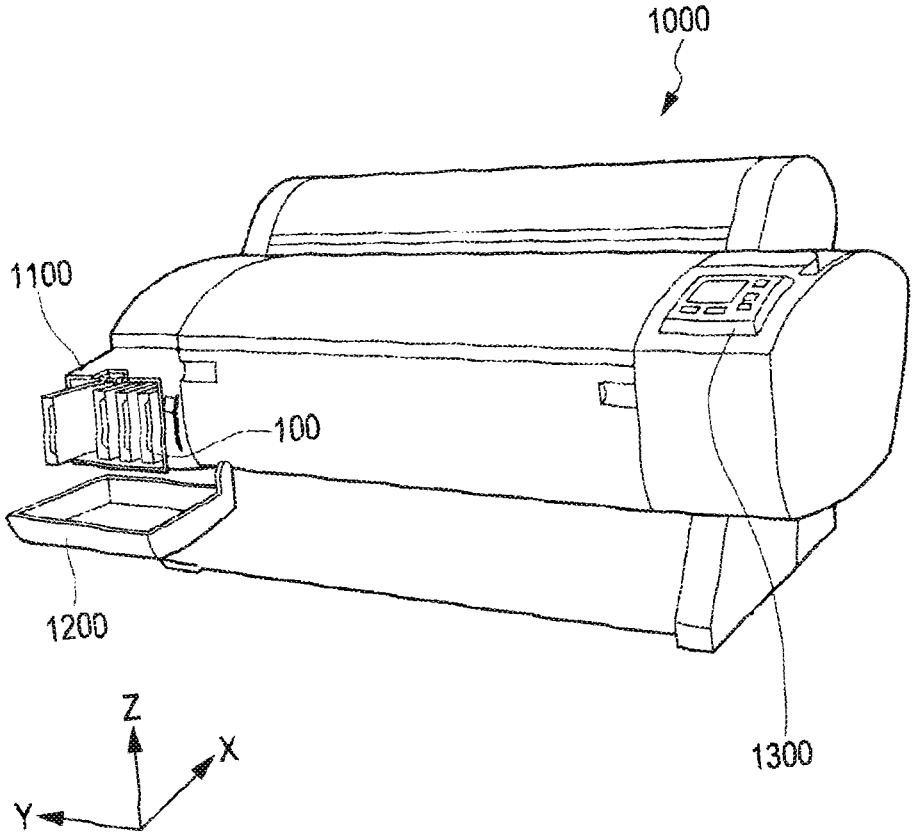
FIG. 1 is a perspective view showing the configuration of a printing apparatus according to an embodiment of the invention.

FIG. 1 is a perspective view showing the configuration of a printing apparatus according to an embodiment of the invention. The printing apparatus 1000 includes a cartridge mounting unit 1100 in which ink cartridges are mounted, a cover 1200 which is able to turn, and an operation unit 1300. The printing apparatus 1000 is a large-format ink jet printer which performs printing on a large-format sheet (A2 to A0 sizes) such as poster. The cartridge mounting unit 1100 is also called a "cartridge holder" or simply a "holder". In the example shown in FIG. 1, in the cartridge mounting unit 1100, four ink cartridges can be individually mounted, and for example, black, yellow, magenta, and cyan, total four kinds of ink cartridges are mounted. As the ink cartridges mounted in the cartridge mounting unit 1100, a plurality of arbitrary ink cartridges can be employed. In FIG. 1, for convenience of description, the X, Y, and Z axes which are orthogonal to each other are illustrated. The +X direction is a direction in which the ink cartridge 100 is inserted into the cartridge mounting unit 1100 (hereinafter, called an "insertion direction" or a "mounting direction"). The cover 1200 is mounted on the cartridge mounting unit 1100 so as to be opened and closed. The cover 1200 can be omitted. The operation unit 1300 is an input device for performing various instructions or settings by a user and includes a display unit for giving various notifications for the user. In addition, although the printing apparatus 1000 includes a printing head, a main scanning feed mechanism, a sub-scanning feed mechanism, a head driving mechanism that discharges ink by driving the printing head, and the like, illustration thereof will be omitted. Like the printing apparatus 1000, a type of printing apparatus in which a cartridge replaced by the user is mounted on a cartridge mounting unit provided in a place other than a carriage of a printing head is called an "off-carriage type".

Figure 2B:
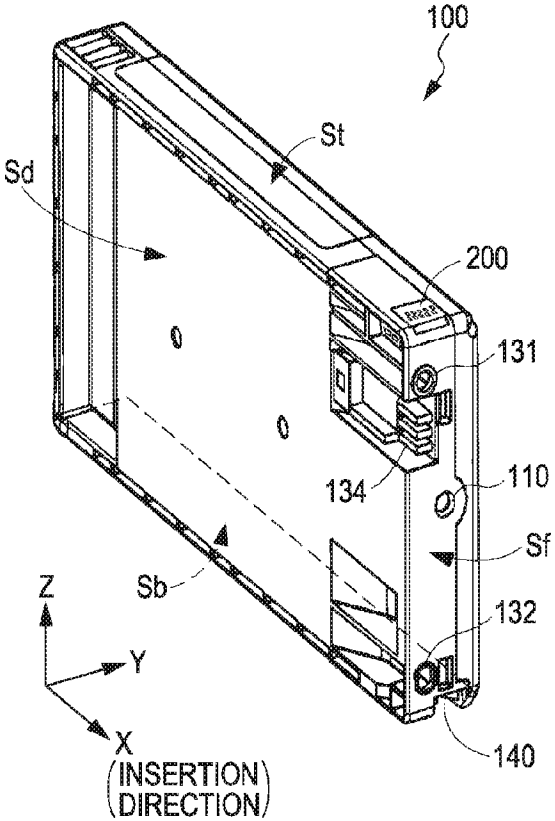
FIGS. 2A and 2B are perspective views showing the configuration of an ink cartridge.
Figure 2A:
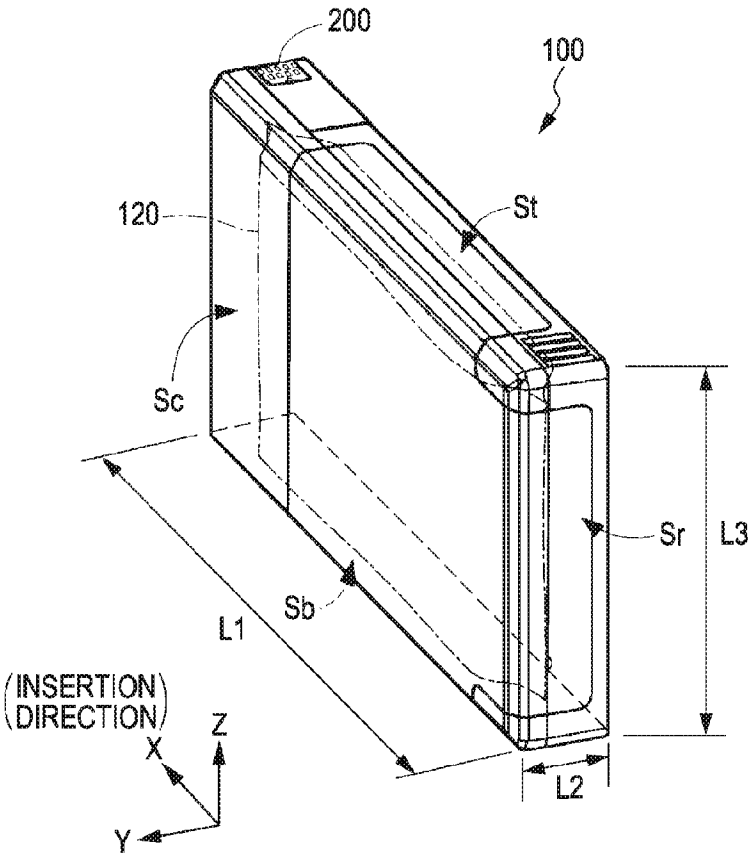

FIGS. 2A and 2B are perspective views showing the outer appearance of the ink cartridge 100. The X, Y, and Z axes of FIGS. 2A and 2B correspond to the X, Y, and Z axes of FIG. 1, respectively. In addition, the ink cartridge is also simply called a "cartridge". The cartridge 100 has an outer shape of a substantially flat rectangle, and from among the dimensions L1, L2, and L3 in three directions, the length L2 (the size in the insertion direction) is largest, the width L2 is smallest, and the height L3 is intermediate between the length L1 and the width L2. Here, depending on the type of printing apparatus, a cartridge in which the length L1 is smaller than the height L3 exists.

The cartridge 100 includes a front end surface (first surface) Sf, a rear end surface (second surface) Sr, a top surface (third surface) St, a bottom surface (fourth surface) Sb, and two side surfaces (fifth and sixth surfaces) Sc and Sd. The front end surface Sf is a surface positioned at the front of the insertion direction X. The front end surface Sf and the rear end surface Sr are smallest from among the 6 surfaces and oppose each other. Each of the front end surface Sf and the rear end surface Sr intersect the top surface St, the bottom surface Sb, and the two side surfaces Sc and Sd. In a state where the cartridge 100 is mounted in the cartridge mounting unit 1100, the top surface St is positioned at the upper end in the vertical direction, the bottom surface Sb is positioned at the lower end in the vertical direction. The two side surfaces Sc and Sd are largest surfaces from among the 6 surfaces and oppose each other. In the cartridge 100, an ink storage chamber 120 (also called an "ink storage baggage") formed of a flexible material is provided. Since the ink storage chamber 120 is formed of the flexible material, the ink storage chamber 120 gradually shrinks as the ink is consumed, and is reduced mainly in thickness (the width in the Y direction).

The front end surface Sf includes two positioning holes 131 and 132 and an ink supply opening 110. The two positioning holes 131 and 132 are used for determining the storage position of the cartridge in the cartridge mounting unit 1100. The ink supply opening 110 is connected to an ink supply tube of the cartridge mounting unit 1100 and supplies the ink in the cartridge 100 to the printing apparatus 1000. A circuit board 200 is provided in the top surface St. In the example of FIGS. 2A and 2B, the circuit board 200 is provided at the front end of the top face St (the end portion on the innermost side in the insertion direction X). Here, the circuit board 200 may be provided at a different position in the vicinity of the front end of the top surface St and moreover, may be provided at a position other than the top surface St. A non-volatile storage element for storing information regarding ink is mounted in the circuit board 200. In addition, the circuit board 200 is also simply called a "board". The bottom surface Sb includes a fixing groove 140 used for fixing the cartridge 100 to the storage position. The first and second side surfaces Sc and Sd oppose to each other and intersect the front end surface Sf, the top surface St, the rear end surface Sr, and the bottom surface Sb. At a position where the second side surface Sd and the front end surface Sf intersect each other, a concave-convex fitting portion 134 is disposed. The concave-convex fitting portion 134 is used for preventing an error in mounting the cartridge along with a concave-convex portion of the cartridge mounting unit 1100.

The cartridge 100 is a cartridge for a large-format ink jet printer, and the cartridge dimensions are greater than those of a cartridge for a small-format ink jet printer for individual uses and contain a large ink amount. For example, with regard to the length L1 of the cartridge, the length L1 of the cartridge in the large-format ink jet printer is equal to or greater than 100 mm, whereas the length L1 of the cartridge in the small-format ink jet printer is equal to or smaller than 70 mm. In addition, the ink amount not in use in the cartridge for the large-format ink jet printer is equal to or greater than 17 ml (typically, equal to or greater than 100 ml), whereas the ink amount not in use in the cartridge for the small-format ink jet printer is equal to or smaller than 15 ml. In many cases, the cartridge for the large-format ink jet printer is mechanically connected to the cartridge mounting unit at the front end surface (the surface at the front in the insertion direction), whereas the cartridge for the small-format ink jet printer is mechanically connected to the cartridge mounting unit at the bottom surface. In the cartridge for the large-format ink jet printer, due to characteristic points regarding the dimensions, weight, or a connection position of the cartridge mounting unit, there is a tendency of a loose contact to be easily generated in the terminals of the circuit board 200 compared to the cartridge for the small-format ink jet printer. This will further be described later.

However, according to the related art, it is common to perform detection of a mounted state using one or two terminals from among a number of terminals provided in the cartridge. However, even when it is detected that the cartridge is correctly mounted, there may be cases where contacts of other terminals that are not used for the mounting detection with terminals of the printing apparatus are insufficient. In particular, when the contacts of terminals for a storage device are insufficient, there is a problem in that errors occur during reading of data from the storage device or writing of data in the storage device.

The problems with the loose contacts of the terminals are particularly important in the ink cartridge for the large-format ink jet printer that performs printing on a large-format sheet (A2 to A0 sizes) such as poster. That is, in the large-format ink jet printer, the dimensions of the ink cartridge are greater than those of the small-format ink jet printer and the weight of ink stored in the cartridge is greater. The inventors found that due to such differences in dimensions and weight, in the large-format ink jet printer, there is a tendency of the ink cartridge to be easily inclined compared to the small-format ink jet printer. In addition, in the large-format ink jet printer, in many cases, a connection position between the ink cartridge and the cartridge holder (also called a "cartridge mounting unit") is provided on the side surface of the ink cartridge, whereas in the small-format ink jet printer, the connection position is provided on the bottom surface of the ink cartridge. Due to such a difference in the connection position, it became clear that the ink cartridge of the large-format ink jet printer has a tendency to be easily inclined compared to that of the small-format ink jet printer. As described above, due to various configurations, in the large-format ink jet printer, the ink cartridge is more likely to be inclined than that of the small-format ink jet printer, and as a result, there is a tendency to easily generate a loose contact in the terminals of the board. There, the inventors have desired to more reliably detect that the contact state of the terminals for the storage device is good particularly regarding the large-format ink jet printer.

Figure 3A:
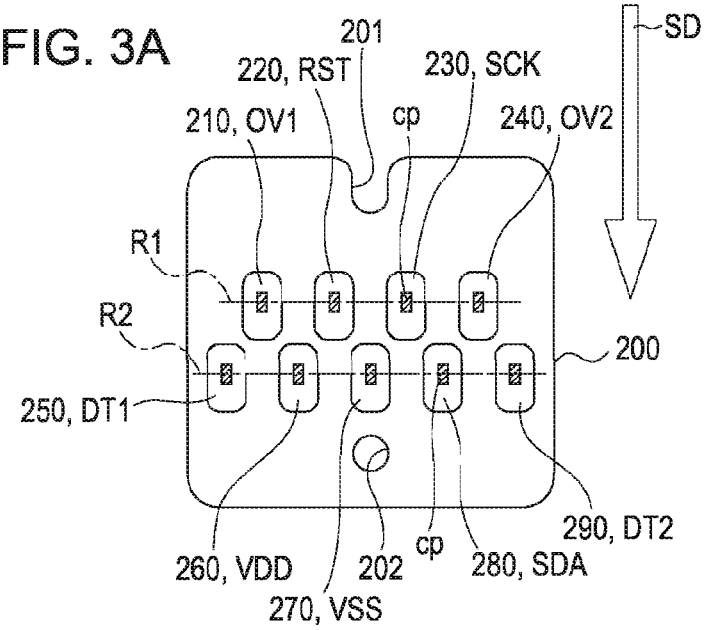
FIGS. 3A to 3C are diagrams showing the configuration of a board according to a first embodiment.
Figure 3B:
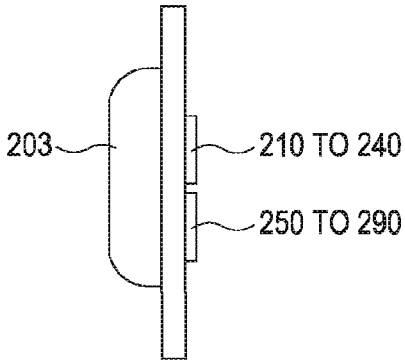

FIG. 3A shows the configuration of the surface of the board 200. The surface of the board 200 is a surface exposed to the outside when the board 200 is mounted on the cartridge 100. FIG. 3B shows a diagram viewed from the side of the board 200. The upper end portion of the board 200 is provided with a boss groove 201, and the lower end portion of the board 200 is provided with a boss hole 202.

In FIG. 3A, the arrow SD indicates the mounting direction of the cartridge 100 to the cartridge mounting unit 1100. The mounting direction SD is aligned with the mounting direction (X direction) of the cartridge shown in FIGS. 2A and 2B. The board 200 has a storage device 203 on the rear surface and is provided with a terminal group including 9 terminals 210 to 290 on the front surface. The storage device 203 stores information regarding the ink of the cartridge 100 (for example, a remaining ink amount). The terminals 210 to 290 are formed in substantially rectangular shapes, and are arranged to form two rows which are substantially perpendicular to the mounting direction SD. From among the two rows, the row on the front side of the mounting direction SD (the row positioned on the upper side in FIG. 3A) is called an upper side row R1 (first row), and the row on the inner side of the mounting direction SD (the row positioned on the lower side in FIG. 3A) is called a lower side row R2 (second row). In addition, it is possible to consider that the rows R1 and R2 are rows formed by contact portions cp of the plurality of terminals.

The terminals 210 to 240 forming the upper side row R1 and the terminals 250 to 290 forming the lower side row R2 respectively have the following functions (purposes).

<Upper Side Row R1>

(1) Mounting detection terminal 210

(2) Reset terminal 220

(3) Clock terminal 230

(4) Mounting detection terminal 240

<Lower Side Row R2>

(5) Mounting detection terminal 250

(6) Power supply terminal 260

(7) Ground terminal 270

(8) Data terminal 280

(9) Mounting detection terminal 290

The 4 mounting detection terminals 210, 240, 250, and 290 are used for detecting whether or not electrical contacts thereof with corresponding apparatus-side terminals are good and can also be called "contact detection terminals". In addition, a mounting detection process can be called a "contact detection process". The 5 other terminals 220, 230, 260, 270, and 280 are terminals for the storage device 203 and are also called "memory terminals".

Each of the plurality of terminals 210 to 290 includes the contact portion cp that comes in contact with the corresponding terminal from among the plurality of apparatus-side terminals, at the center portion. The contact portions cp of the terminals 210 to 240 forming the upper side row R1 and the contact portions cp of the terminals 250 to 290 forming the lower side row R2 are alternately disposed to form a so-called zigzag arrangement. In addition, the terminals 210 to 240 forming the upper side row R1 and the terminals 250 and 290 forming the lower side row R2 are alternately disposed and form the zigzag arrangement so that the terminal centers are not aligned with the mounting direction SD.

The contact portions of the two mounting detection terminals 210 and 240 of the upper side row R1 are disposed at both end portions of the upper side row R1, that is, at the outermost positions of upper side row R1. In addition, the contact portions of the two mounting detection terminals 250 and 290 of the lower side row R2 are disposed at both end portions of the lower side row R2, that is, at the outermost positions of the lower side row R2. The contact portions of the memory terminals 220, 230, 260, 270, and 280 are assembled at substantially the center in a region where the entirety of the plurality of terminals 210 to 290 is disposed. In addition, the contact portions of the four mounting detection terminals 210, 240, 250, and 290 are disposed at four corners of the assembly of the memory terminals 220, 230, 260, 270, and 280.

Figure 3C:
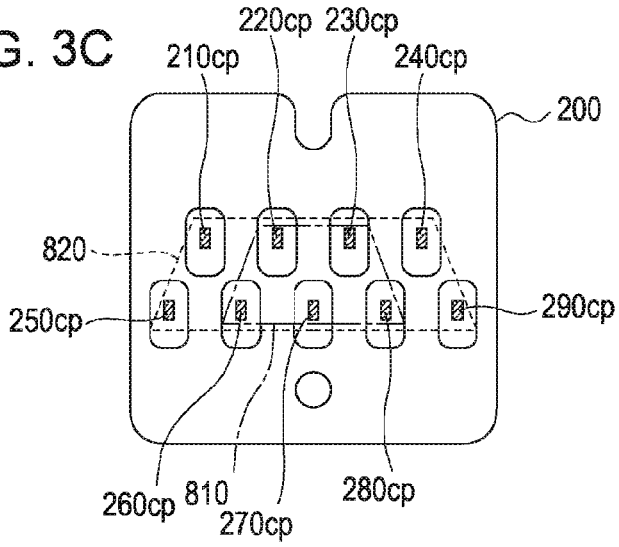

FIG. 3C shows contact portions 210cp to 290cp of the 9 terminals 210 to 290 shown in FIG. 3A. The 9 contact portions 210cp to 290cp are disposed substantially uniformly at substantially even intervals. The plurality of contact portions 220cp, 230cp, 260cp, 270cp, and 280cp for the storage device are disposed in a region (first region 810) at the center of the region where the entirety of the contact portions 210cp to 290cp are disposed. The contact portions 210cp, 240cp, 250cp, and 290cp of the 4 mounting detection terminals are disposed on the outer side than the first region 810. The contact portions 210cp, 240cp, 250cp, and 290cp of the 4 mounting detection terminals are disposed at 4 corners of a quadrangular second region 820 including the first region 810. It is preferable that the shape of the first region 810 be a quadrangle having the smallest area including the contact portions 210cp, 240cp, 250cp, and 290cp of the 4 mounting detection terminals. Otherwise, the shape of the first region 810 may be a quadrangle that circumscribes the contact portions 210cp, 240cp, 250cp, and 290cp of the 4 mounting detection terminals. It is preferable that the shape of the second region 820 be a quadrangle having the smallest area including all the contact portions 210cp to 290cp. In addition, it is preferable that, when viewed in the vertically downward direction (−Z direction) of FIG. 2B, the center of the first region 810 including the plurality of contact portions 220cp, 230cp, 260cp, 270cp, and 280cp for the storage device be disposed to be positioned on the center line of the ink supply opening 110 (FIG. 2B) of the cartridge 100.

Figure 4A:
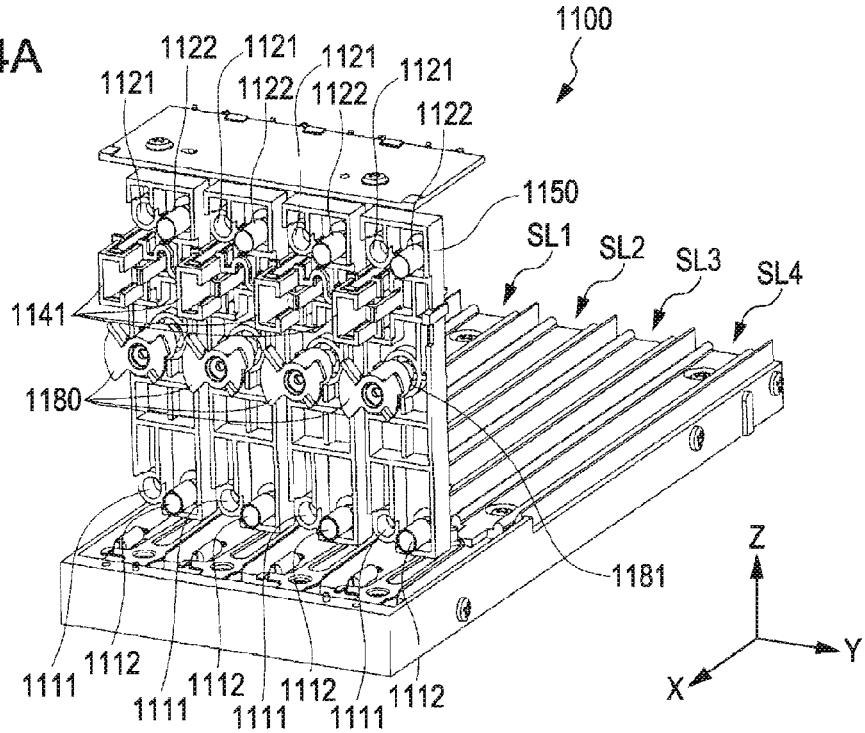
FIGS. 4A to 4C are diagrams showing the configuration of a cartridge mounting unit.
Figure 4B:
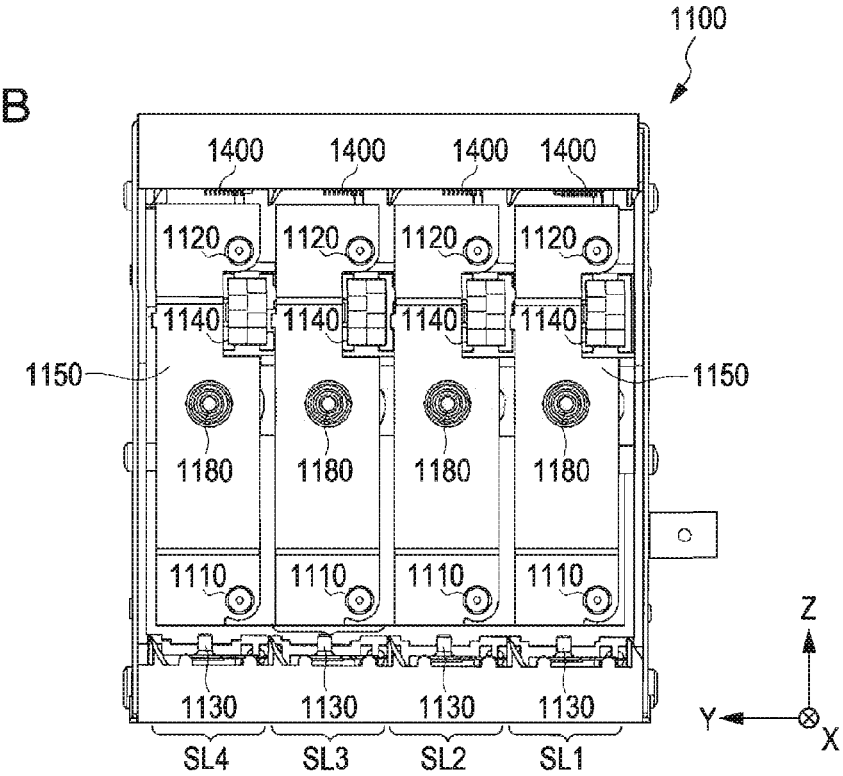
Figure 4C:
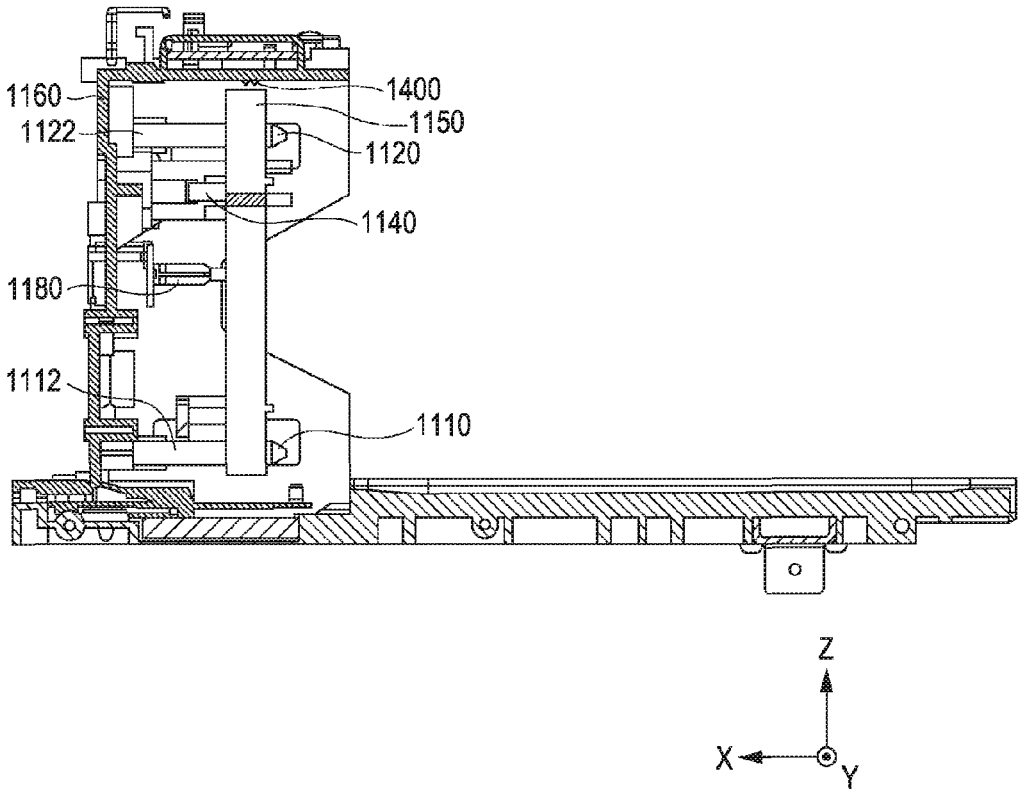

FIGS. 4A to 4C are diagrams showing the configuration of the cartridge mounting unit 1100. FIG. 4A is a perspective view of the cartridge mounting unit 1100 viewed from the obliquely rearward, and FIG. 4B is a diagram of the inside of the cartridge mounting unit 1100 viewed from the front surface (opening through which the cartridge is inserted). FIG. 4C is a diagram of the inside of the cartridge mounting unit 1100 viewed in the cross-section. In addition, for convenience of illustration, parts of wall members and the like are omitted in FIGS. 4A to 4C. The X, Y, and Z axes of FIGS. 4A to 4C correspond to the X, Y, and Z axes of FIGS. 1 to 2B. The cartridge mounting unit 1100 includes 4 storage slots SL1 to SL4 for storing cartridges. As shown in FIG. 4B, the inside of the cartridge mounting unit 1100 is provided with an ink supply tube 1180, a pair of positioning pins 1110 and 1120, a concave-convex fitting portion 1140, and a contact point mechanism 1400 for each slot. As shown in FIG. 4C, the ink supply tube 1180, the pair of positioning pins 1110 and 1120, and the concave-convex fitting portion 1140 are fixed to an inner wall member 1160 of the cartridge mounting unit. The ink supply tube 1180, the positioning pins 1110 and 1120, and the concave-convex fitting portion 1140 are inserted into through-holes 1181, 1111, 1121, ad 1141 provided in a slider member 1150, and are disposed to protrude in the reverse direction to the mounting direction of the cartridge. FIG. 4A is a diagram of the slider member 1150 viewed from the rear by detaching the inner wall member 1160. In FIG. 4A, the positioning pins are omitted in the illustration. As shown in FIG. 4A, the rear of the slider member 1150 is provided with a pair of urging springs 1112 and 1122 corresponding to the pair of positioning pins 1110 and 1120. As shown in FIG. 4C, the pair of urging springs 1112 and 1122 are fixed to the slider member 1150 and the inner wall member 1160.

The ink supply tube 1180 is inserted into the ink supply opening 110 (FIG. 2A) of the cartridge 100 and is used for supplying ink to the printing head inside the printing apparatus 1000. The positioning pins 1110 and 1120 are inserted into the positioning holes 131 and 132 provided in the cartridge 100 when the cartridge 100 is inserted into the cartridge mounting unit 1100, and are used for determining the storage position of the cartridge 100. The concave-convex fitting portion 1140 has a shape corresponding to the shape of the concave-convex fitting portion 134 of the cartridge 100 and has a different shape for each of the storage slots SL1 to SL4. Accordingly, in each of the storage slots SL1 to SL4, only the cartridge which stores one kind of ink determined in advance is stored and a cartridge for a different color cannot be stored.

The slider member 1150 disposed at the wall surface inside each of the storage slots is configured to be slidable in the mounting direction (X direction) of the cartridge and a discharge direction (−X direction). The pair of urging springs 1112 and 1122 (FIG. 4A) provided in each of the storage slots urges the slider member 1150 in the discharge direction. The cartridge 100 pushes the pair of urging springs 1112 and 1122 along with the slider member 1150 in the mounting direction when being inserted into the storage slot and is pushed inward against the urging force of the urging springs 1112 and 1122. Therefore, the cartridge 100 is urged in the discharge direction by the pair of urging springs 1112 and 1122 in a state where the cartridge 100 is stored in the cartridge mounting unit 1100. In addition, in the stored state, a fixing member 1130 (FIG. 4B) provided at the bottom portion of each of the storage slots SL1 to SL4 is engaged with a fixing groove 140 (FIG. 2A) provided at the bottom surface Sb of the cartridge 100. Due to the engagement between the fixing member 1130 and the fixing groove 140, the cartridge 100 is prevented from being discharged from the cartridge mounting unit 1100 by the urging force of the urging springs 1112 and 1122.

In the case where the cartridge 100 is discharged, when the cartridge 100 is first pushed inward in the mounting direction by a user, the engagement between the fixing member 1130 and the fixing groove 140 is correspondingly deviated. As a result, the cartridge 100 is pushed outward in the discharge direction (−X direction) by the urging force of the pair of urging springs 1112 and 1122. Therefore, the user can easily take out the cartridge 100 from the cartridge mounting unit 1100.

The contact point mechanism 1400 (FIG. 4B) has a plurality of apparatus-side terminals which come in contact with and are electrically connected with the terminals 210 to 290 (FIGS. 3A to 3C) of the circuit board 200 when the cartridge 100 is inserted into the cartridge mounting unit 1100. A control circuit of the printing apparatus 1000 transmits and receives signals to and from the circuit board 200 via the contact point mechanism 1400.

Figure 5A:
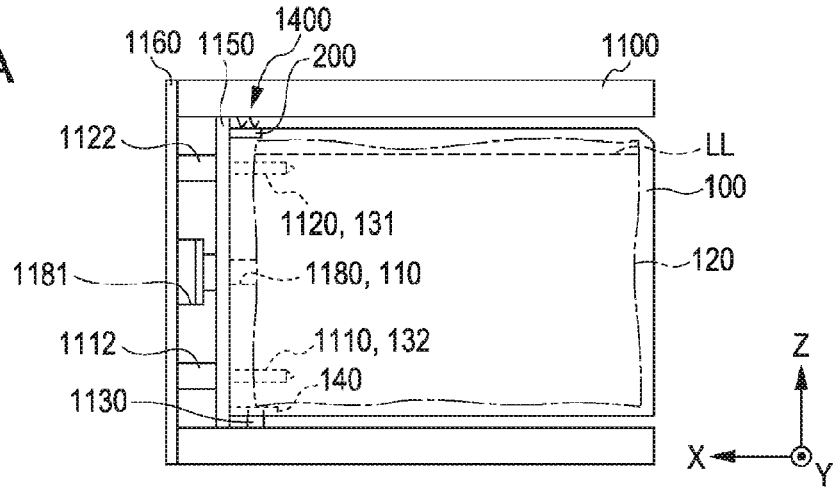
FIGS. 5A to 5C are conceptual diagrams showing a state where the ink cartridge is mounted in the cartridge mounting unit.

FIG. 5A shows a state where the cartridge 100 is appropriately mounted in the cartridge mounting unit 1100. In this state, the cartridge 100 is not inclined, and the upper surface and the bottom surface are in parallel to an upper end member or a lower end member of the cartridge mounting unit 1100. The ink supply tube 1180 of the cartridge mounting unit 1100 is connected to the ink supply opening 110 of the cartridge 100, and the positioning pins 1110 and 1120 of the cartridge mounting unit 1100 are inserted into the positioning holes 131 and 132 of the cartridge 100. In addition, the fixing member 1130 provided at the bottom portion of the cartridge mounting unit 1100 is engaged with the fixing groove 140 provided at the bottom surface of the cartridge 100. In addition, the front end surface Sf of the cartridge is urged in the discharge direction by the pair of the urging springs 1112 and 1122 of the cartridge mounting unit 1100. In the state where the cartridge 100 is appropriately mounted, the contact point mechanism 1400 of the cartridge mounting unit 1100 comes in contact with the terminals 210 to 290 (FIG. 3) of the board 200 of the cartridge 100 in a good contact state.

Figure 5B:
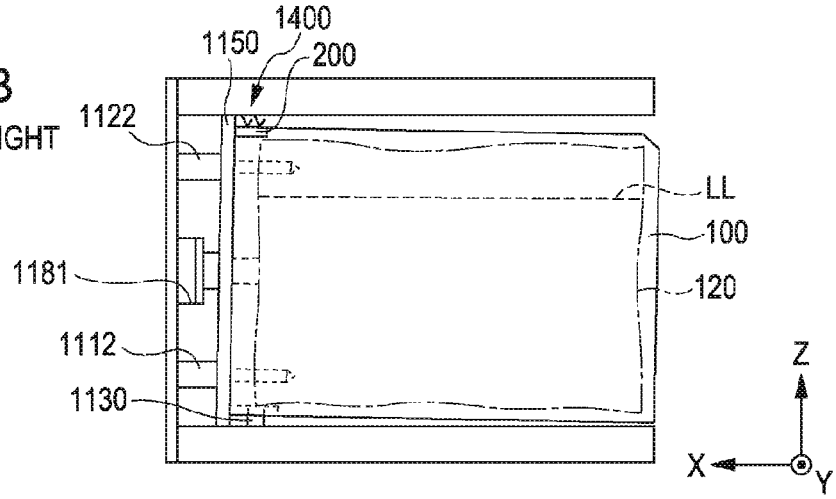
Figure 5C:
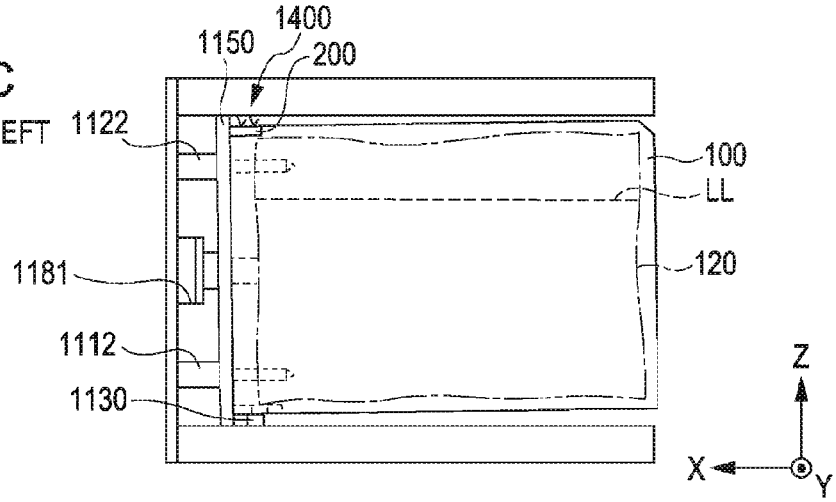

However, in order to facilitate mounting of the cartridge 100, there is a slight play inside the cartridge mounting unit 1100. Therefore, the storage of the cartridge 100 is not limited to an appropriate state where the cartridge 100 is not inclined but is erected as shown in FIG. 5A, and there may be cases where the cartridge 100 is inclined with respect to an axis in parallel to the width direction (Y direction) of the cartridge. Specifically, as shown in FIG. 5B, the cartridge is inclined while the rear end thereof is slightly lowered, or contrary to this, as shown in FIG. 5C, the cartridge is inclined while the rear end thereof is slightly raised. In particular, as the ink interface LL is lowered as the ink is consumed, there is a change in the centroid due to a change in the weight of the stored, or the balance between the urging force of the urging springs 1112 and 1122 and the weight of the cartridge including the ink weight is changed. In addition, due to the change in the weight balance, there is a tendency of the cartridge to be easily inclined. When the cartridge is inclined, there is a possibility that loose contacts occur in several terminals from among the plurality of terminals provided on the board 200 of the cartridge. In particular, in the states of FIGS. 5B and 5C, there is a possibility that loose contacts occur in one or more terminals of one of the terminal groups 210 to 240 of the upper side row R1 of the board 200 (FIG. 3) and the terminal groups 250 to 290 of the lower side row R2.

In addition, when the cartridge is inclined, there may be cases where inclination (inclination with respect to the axis parallel to the mounting direction X) in a direction perpendicular to the directions of FIGS. 5B and 5C occurs. In this case, the board 200 shown in FIGS. 3A to 3C is also inclined to the left or right with respect to the axis parallel to the mounting direction SD, and there is a possibility that loose contacts occur in one or more terminals of one of the terminal group 210, 220, 250, and 260 on the left side of the board 200 and the terminal group 230, 240, 280, and 290 on the right side.

When such loose contacts occur, there is a problem in that transmission and reception of signals between the storage device 203 of the cartridge and the printing apparatus 1000 cannot be normally performed. In addition, when foreign matter such as ink droplets or dust is attached to the vicinity of the terminals of the board 200, there may be cases where an unintended short circuit or leakage occurs between the terminals. A detection process of a mounted state in various embodiments described later is performed to detect loose contacts caused by such inclination of the cartridge or detect an unintended short circuit or leakage caused by foreign matter.

However, the cartridge for the large-format ink jet printer has the following characteristic points compared to the cartridge for the small-format ink jet printer for individual uses.

(1) The cartridge dimensions are large (the length L1 is equal to or greater than 100 mm).
(2) An amount of ink stored is great (equal to or greater than 17 ml, and typically, equal to or greater than 100 ml).
(3) The front end surface (the surface at the front of the mounting direction) is mechanically connected to the cartridge mounting unit.
(4) The space inside the ink storage chamber is not partitioned and forms a single ink storage chamber (ink storage bag).

Depending on the type of the large-format ink jet printer, a cartridge that does not have several points from among the characteristic points (1) to (4) is also used but normally has at least one characteristic point therefrom.

Since the cartridge for the large-format ink jet printer has the characteristic points such as dimensions, weight, the connection position to the cartridge mounting unit, or the ink chamber configuration, the cartridge is more likely to be inclined compared to the cartridge for the small-format ink jet printer, and as a result, there is a tendency to generate loose contacts in the terminals of the board 200. Therefore, it is thought that it is significantly important to perform a process for detecting loose contacts of terminals as described later, an unintended short circuit, leakage, and the like on the large-format ink jet printer and the cartridge thereof.

Figure 6:
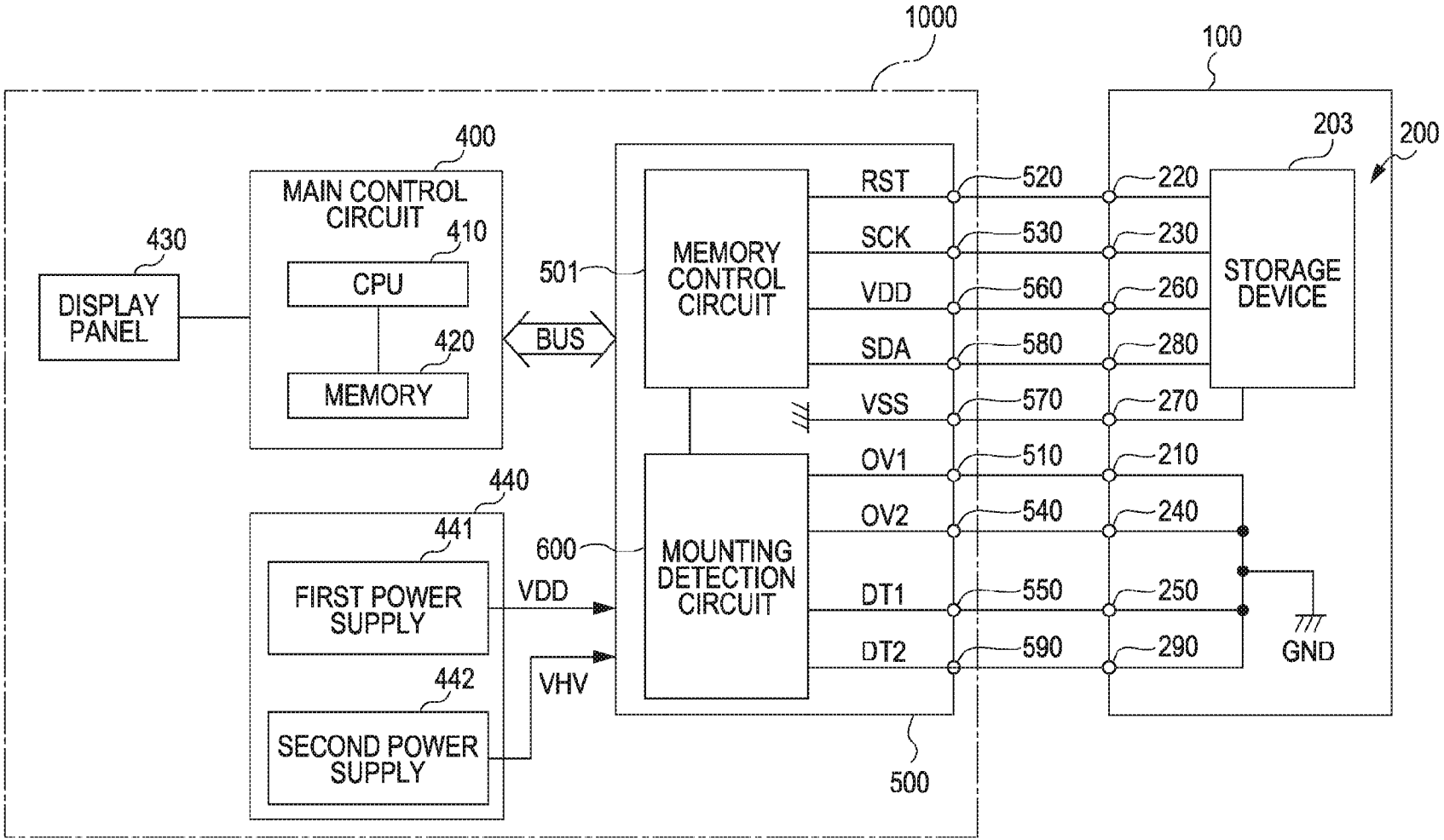
FIG. 6 is a block diagram showing the electrical configuration of the board of the ink cartridge and the printing apparatus according to the first embodiment.

FIG. 6 is a block diagram showing the electrical configuration of the board 200 of the ink cartridge and the printing apparatus 1000 according to the first embodiment. The printing apparatus 1000 includes a display panel 430, a power supply circuit 440, a main control circuit 400, and a sub-control circuit 500. The display panel 430 is a display unit for giving various notifications such as an operation state of the printing apparatus 1000 and a mounted state of the cartridge for the user. The display panel 430 is provided in, for example, the operation unit 1300 of FIG. 1. The power supply circuit 440 includes a first power supply 441 that generates a first power supply voltage VDD and a second power supply 442 that generates a second power supply voltage VHV. The first power supply voltage VDD is a general power supply voltage (rating 3.3V) used for a logic circuit. The second power supply voltage VHV is a high voltage (for example, rating 42V) used for discharging ink by driving the printing head. The voltages VDD and VHV are supplied to the sub-control circuit 500 and are also supplied to other circuits as needed. The main control circuit 400 includes a CPU 410 and a memory 420. The sub-control circuit 500 includes a memory control circuit 501 and a mounting detection circuit 600. In addition, the circuit including the main-control circuit 400 and the sub-control circuit 500 may also be called a "control circuit".

From among the 9 terminals provided in the board 200 (FIG. 3) of the cartridge, the reset terminal 220, the clock terminal 230, the power supply terminal 260, the ground terminal 270, and the data terminal 280 are electrically connected to the storage device 203. The storage device 203 is a non-volatile memory in which an address terminal is not provided but a memory cell to access is determined on the basis of the number of pulses of a clock signal SCK input from a clock terminal and command data input from a data terminal, and which receives data from the data terminal or transmits data to the data terminal in synchronization with the clock signal SCK. The clock terminal 230 is used for supplying the clock signal SCK to the storage device 203 from the sub-control circuit 500. To the power supply terminal 260 and the ground terminal 270, a power supply voltage (for example, rating 3.3V) for driving the storage device and a ground voltage (0V) are respectively supplied from the printing apparatus 1000. The power supply voltage for driving the storage device 203 is a voltage that is directly given from the first power supply voltage VDD or may be a voltage that is generated by the first power supply voltage VDD and is lower than the first power supply voltage VDD. The data terminal 280 is used to exchange a data signal SDA between the sub-control circuit 500 and the storage device 203. The reset terminal 220 is used for supplying a reset signal RST to the storage device 203 from the sub-control circuit 500. The 4 mounting detection terminals 210, 240, 250, and 290 are connected to each other with wiring liens in the board 200 (FIG. 3) of the cartridge 100 and are all grounded. For example, the mounting detection terminals 210, 240, 250, and 290 are grounded by being connected to the ground terminal 270. Here, they may be ground via a path other than the ground terminal 270. As understood by the above description, the mounting detection terminals 210, 240, 250, and 290 may be connected to a part of the memory terminals (or the storage device 203); however, it is preferable that they not be connected to the memory terminals or the storage device other than the ground terminal. In particular, if the mounting detection terminals are absolutely not connected to the memory terminals or the storage device, a signal other than a mounting inspection signal or a voltage is not applied to the mounting detection terminal, so that mounting detection can be more reliably performed, which is preferable. In addition, in the example of FIG. 6, the four mounting detection terminals 210, 240, 250, and 290 are connected by the wiring lines, but parts of the wiring liens connecting them may be substituted by resistors. In addition, a state where two terminals are connected by a wiring line is called a "short circuit connection" or a "conducting wire connection". The short circuit connection by the wiring line is a different state from an unintended short circuit.

In FIG. 6, wiring line paths that connect the apparatus-side terminals 510 to 590 to the terminals 210 to 290 of the board 200 are denoted by wiring line names SCK, VDD, SDA, RST, OV1, OV2, DT1, and DT2. From among the wiring line names, the wiring line paths for the storage device use the same names as the signal names. In addition, the apparatus-side terminals 510 to 590 are provided in the contact point mechanism 1400 shown in FIG. 4B and FIGS. 5A to 5C.

Figure 7:
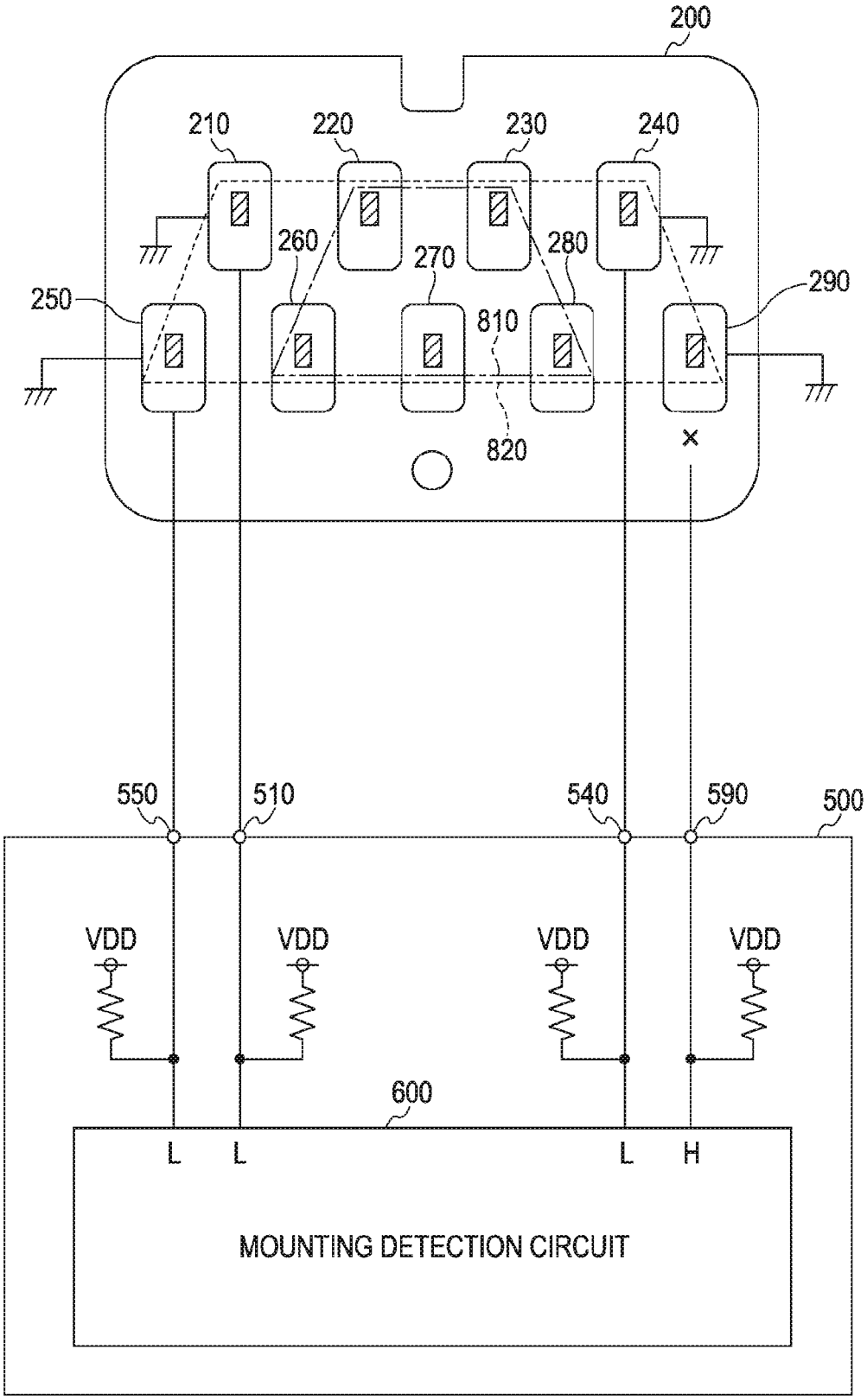
FIG. 7 is an explanatory view showing a connection state of the board and a mounting detection circuit according to the first embodiment.

FIG. 7 shows a connection state of the board 200 and the mounting detection circuit 600. The 4 mounting detection terminals 210, 240, 250, and 290 of the board 200 are connected to the mounting detection circuit 600 via the corresponding apparatus-side terminals 510, 540, 550, and 590. In addition, the 4 mounting detection terminals 210, 240, 250, and 290 of the board 200 are grounded. The wiring lines that connect the apparatus-side terminals 510, 540, 550, and 590 to the mounting detection circuit 600 are each connected to the power supply VDD (rating 3.3V) in the sub-control circuit 500 via pull-up resistors.

In the example of FIG. 7, the 3 terminals 210, 240, and 250 from among the 4 mounting detection terminals 210, 240, 250, and 290 of the board 200 are in a good connection state to the corresponding apparatus-side terminals 510, 540, and 550. On the other hand, the fourth mounting detection terminal 290 is in a loose contact state to the corresponding apparatus-side terminal 590. The voltages of the wiring liens of the 3 apparatus-side terminals 510, 540, and 550 having a good connection state become an L level (ground voltage level), whereas the voltage of the wiring line of the apparatus-side terminal 590 which has a bad connection state becomes an H level (power supply voltage VDD level). Therefore, the mounting detection circuit 600 can determine whether or not the contact state of each the 4 mounting detection terminals 210, 240, 250, and 290 is good by examining the voltage level of each wiring line.

The contact portions cp of the 4 mounting detection terminals 210, 240, 250, and 290 of the board 200 are disposed at four corners in the periphery of the assembly region 810 of the contact portions cp of the terminals 220, 230, 260, 270, and 280 for the storage device. When contact states of the 4 mounting detection terminals 210, 240, 250, and 290 are all good, there is no significant inclination in the cartridge, and the contact states of the terminals 220, 230, 260, 270, and 280 for the storage device are good. On the other hand, when the contact states of one or more terminals from among the 4 mounting detection terminals 210, 240, 250, and 290 are bad, there is significant inclination in the cartridge, and there is a possibility that the contact states of one or more terminals from among the terminals 220, 230, 260, 270, and 280 for the storage device are also bad. It is preferable that when the contact states of one or more terminals from among the 4 mounting detection terminals 210, 240, 250, and 290 are band, the mounting detection circuit 600 display information (text or images) showing the non-mounted state on the display panel 430 to notify the user.

In addition, the reason why the contact portions cp of the mounting detection terminals are provided at the entire four corners in the periphery of the assembly region 810 of the contact portions cp of the terminals for the storage device is that since there is a certain degree of freedom of inclining the cartridge 100 even in the state where the cartridge 100 is mounted in the cartridge mounting unit 1100, the board 200 of the cartridge 100 and the contact point mechanism 1400 (FIGS. 5A to 5C) of the cartridge mounting unit 1100 are inclined to each other. For example, when the rear end of the cartridge 100 is inclined as shown in FIG. 5B and the terminal group 210 to 240 (the contact portion group thereof) of the upper side row R1 of the board 200 becomes more distant from the contact point mechanism 1400 than the terminal group 250 to 290 (the contact portion group thereof) of the lower side row R2, there is a possibility that the contacts of the terminal group 210 to 240 of the upper side row R1 become loose. On the contrary, when the rear end of the cartridge 100 is inclined as shown in FIG. 5C and the terminal group 250 to 290 of the lower side row R2 of the board 200 becomes more distant from the contact point mechanism 1400 than the terminal group 210 to 240 of the upper side row R1, there is a possibility that the contacts of the 5 terminals 250 to 290 of the lower side row R2 of the board 200 become loose. In addition, unlike FIGS. 5B and 5C, when the cartridge 100 is inclined with respect to the axis parallel to the X direction and the left end of the board 200 in FIG. 7 becomes more distant from the contact point mechanism 1400 than the right end, there is a possibility that the contacts of the terminals 210, 220, 250, 260, and 270 on the left side of the board 200 become loose. On the contrary, when the right end of the board 200 becomes more distant from the contact point mechanism 1400 than the left end, there is a possibility that the contacts of the terminals 230, 240, 270, 280, and 290 on the right side of the board 200 become loose. When such loose contacts occur, there is a possibility that errors occur during reading of data from the storage device 203 or writing of data in the storage device 203. There, as described above, when whether or not the contact states of the contact portions cp of the 4 mounting detection terminals 210, 240, 250, and 290 disposed at the four corners in the periphery of the assembly region 810 of the contact portions cp of the memory terminals 220, 230, 260, 270, and 280 are good is confirmed, it is possible to prevent loose contacts caused by the inclination or access errors of the storage device.

As such, in the first embodiment, since the contact portions of the mounting detection terminals are provided at the four corners of the periphery of the assembly region of the contact portions of the plurality of terminals for the storage device of the board, by confirming that the apparatus-side terminals corresponding to the mounting detection terminals are in a good contact state, it is possible to ensure the good contact state even regarding the terminals for the storage device. In particular, in the cartridge for the large-format ink jet printer, as described with reference to FIGS. 5A to 5C, there is a tendency of the cartridge to be easily inclined in the cartridge mounting unit. Therefore, it is though that the necessity and importance of disposing the contact portions of the 4 mounting detection terminals at the four corners of the region (a region on the outer side of the region where the contact portions of the plurality of terminals for the storage device and including the region) in the periphery of the region where the contact portions of the plurality of terminals for the storage device, and confirming whether or not all the contact states of the 4 mounting detection terminals are good are particularly significant in the cartridge for the large-format ink jet printer. Here, the plurality of terminals for the storage device includes the 2 power supply terminals (the ground terminal and the power supply terminal) and the 2 signal terminals (the reset terminal, the clock terminal, and the data terminal) which are necessary for the control circuit of the printing apparatus to write data in the storage device provided in the cartridge or read data therefrom.

B. Second Embodiment

Figure 8:
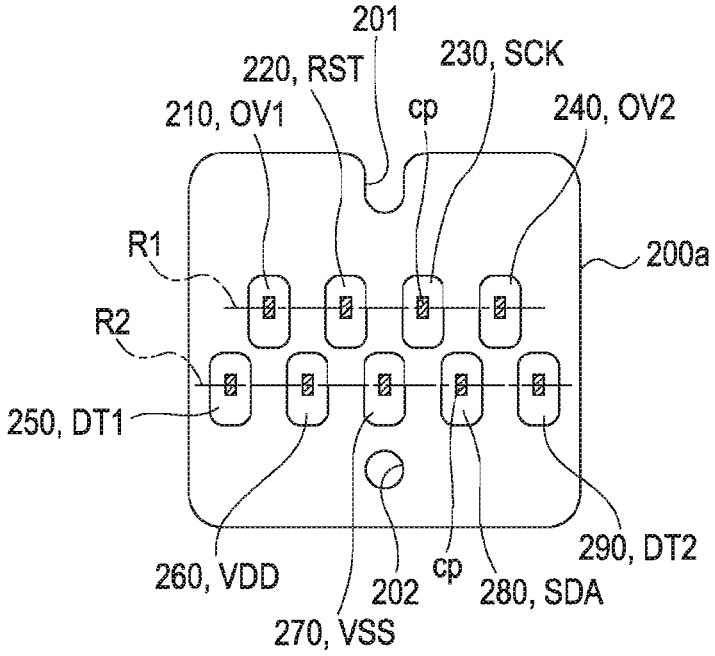
FIG. 8 is a diagram showing the configuration of a board according to a second embodiment.

FIG. 8 is a diagram showing the configuration of a board according to a second embodiment. The arrangement of terminals 210 to 290 is the same as that shown in FIG. 3A. Here, the functions (purposes) of the terminals are as follows and are slightly different from those of the first embodiment.

<Upper Side Row R1>

(1) Overvoltage detection terminal 210 (also for leakage detection and mounting detection)
(2) Reset terminal 220
(3) Clock terminal 230
(4) Overvoltage detection terminal 240 (also for leakage detection and mounting detection) <Lower Side Row R2>
(5) Sensor terminal 250 (also for mounting detection)
(6) Power supply terminal 260
(7) Ground terminal 270
(8) Data terminal 280
(9) Sensor terminal 290 (also for mounting detection)

The terminals 210 and 240 at both ends of the upper side row R1 and contact portions thereof are used for detection of an overvoltage (described later), detection of leakage between terminals (described later), and mounting detection (contact detection). In addition, the terminals 250 and 290 of the low side row R2 and contact portions thereof are used for both detection of a remaining ink amount and mounting detection (contact detection) using a sensor provided in the cartridge 100. In addition, using the four contact portions of the terminals 210, 240, 250, and 290 at four corners of a quadrangular region including the contact portions of the terminal group 210 to 290 for the mounting detection (contact detection) is the same as the first embodiment. In addition, in the second embodiment, to the contact portions of the 2 terminals 210 and 240 disposed at both ends of the upper side row R1, the same voltage as the first power supply voltage VDD for driving the storage device or a voltage generated from the first power supply voltage VDD is applied, and to the contact portions of the 2 terminals 250 and 290 disposed at both ends of the low side row R2, the same voltage as the second power supply voltage VHV used for driving the printing head or a voltage generated from the second power supply voltage VHV is applied. Here, it is preferable that as the "voltage generated from the second power supply voltage VHV", a voltage which is higher than the first power supply voltage VDD and is lower than the second power supply voltage VHV be used.

However, as an embodiment of detection of the mounted state or contact detection of the printing material cartridge, short circuit detection which examines whether or not an unintended short circuit occurs between terminals of a cartridge may be performed. During the short circuit detection, for example, a terminal for short circuit detection is provided at a position adjacent to a terminal for a high voltage to which a voltage higher than a general power supply voltage (3.3V) is applied, and whether or not an excessive voltage is generated in the terminal for short circuit detection is examined. In addition, when an excessive voltage is detected in the terminal for short circuit detection, application of a high voltage to the terminal for a high voltage is stopped. However, even though the application of a high voltage is immediately stopped when the excessive voltage is generated in the terminal for short circuit detection, there is a problem in that due to the excessive voltage generated before the stoppage, there is a possibility that some defects may be generated in the cartridge or the printing apparatus. The second embodiment or a third embodiment described as follows contain the study for solving such existing problems.

Figure 9:
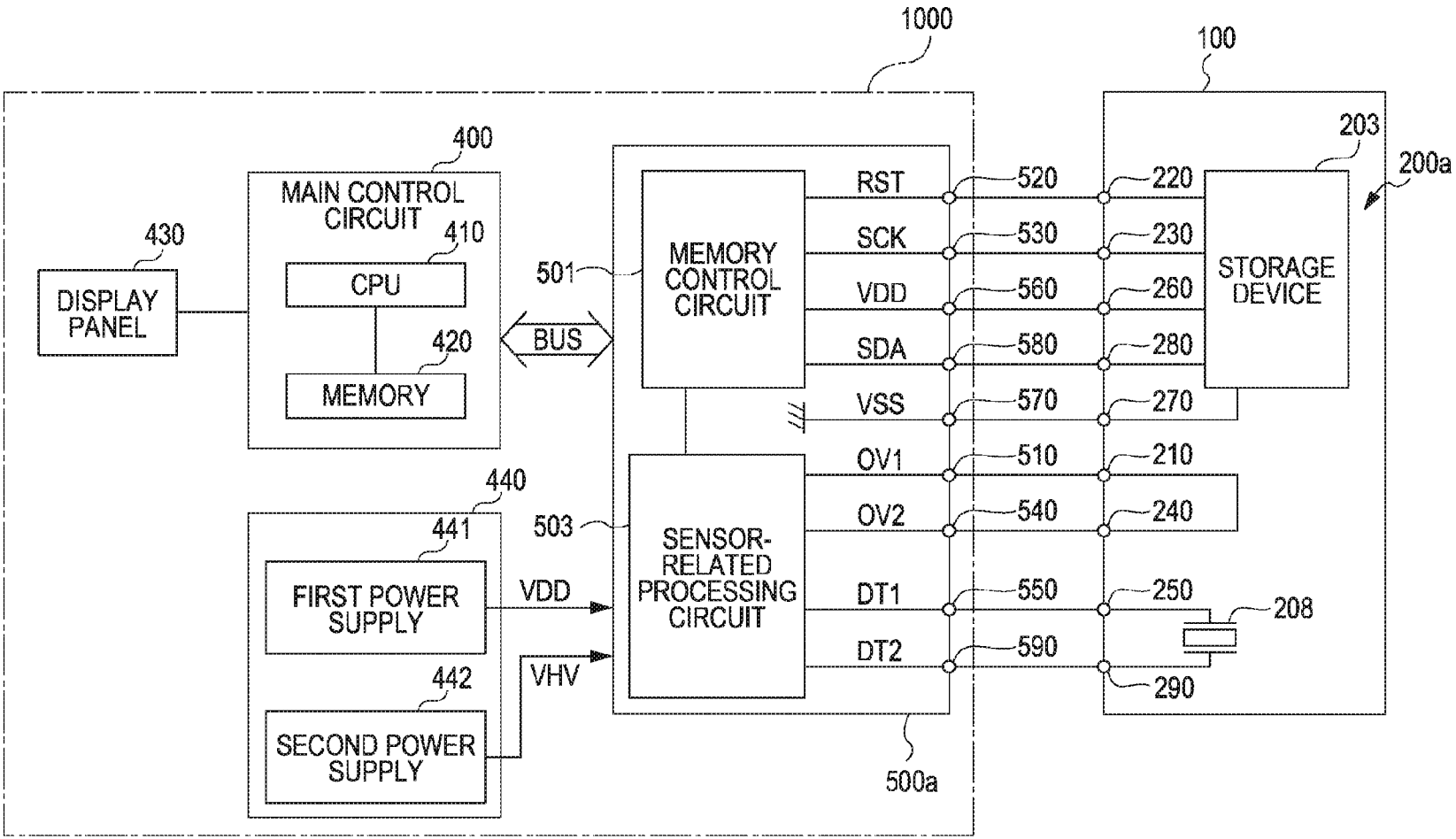
FIG. 9 is a block diagram showing the electrical configuration of the board of an ink cartridge and a printing apparatus according to the second embodiment.

FIG. 9 is a block diagram showing the electrical configuration of the board 200*a* of an ink cartridge and a printing apparatus 1000 according to the second embodiment. The board 200*a* includes, as well as the storage device 203 and the 9 terminals 210 to 290, a sensor 208 used for detecting a remaining ink amount. As the sensor 208, for example, a well-known remaining ink amount sensor using a piezoelectric element may be used. In addition, the piezoelectric element functions as an electrically capacitive element.

A main control circuit 400 includes, like the first embodiment, a CPU 410 and a memory 420. A sub-control circuit 500*a* includes a memory control circuit 501 and a sensor-related processing circuit 503. The sensor-related processing circuit 503 is a circuit for performing detection of a mounted state of the cartridge in the cartridge mounting unit 1100 and detection of a remaining ink amount using the sensor 208. Since the sensor-related processing circuit 503 is used for performing detection of the mounted state of the cartridge, the sensor-related processing circuit 503 may also be called a "mounting detection circuit". The sensor-related processing circuit 503 is a high-voltage circuit that applies or supplies, to the sensor 208 of the cartridge, a voltage higher than the power supply voltage VDD applied or supplied to the storage device 203. In addition, as the high voltage applied to the sensor 208, the power supply voltage VHV (rating 42V) itself used for driving the printing head or a slightly low voltage (for example, 36V) which is generated from the power supply voltage VHV used for driving the printing head and may be used.

Figure 10:
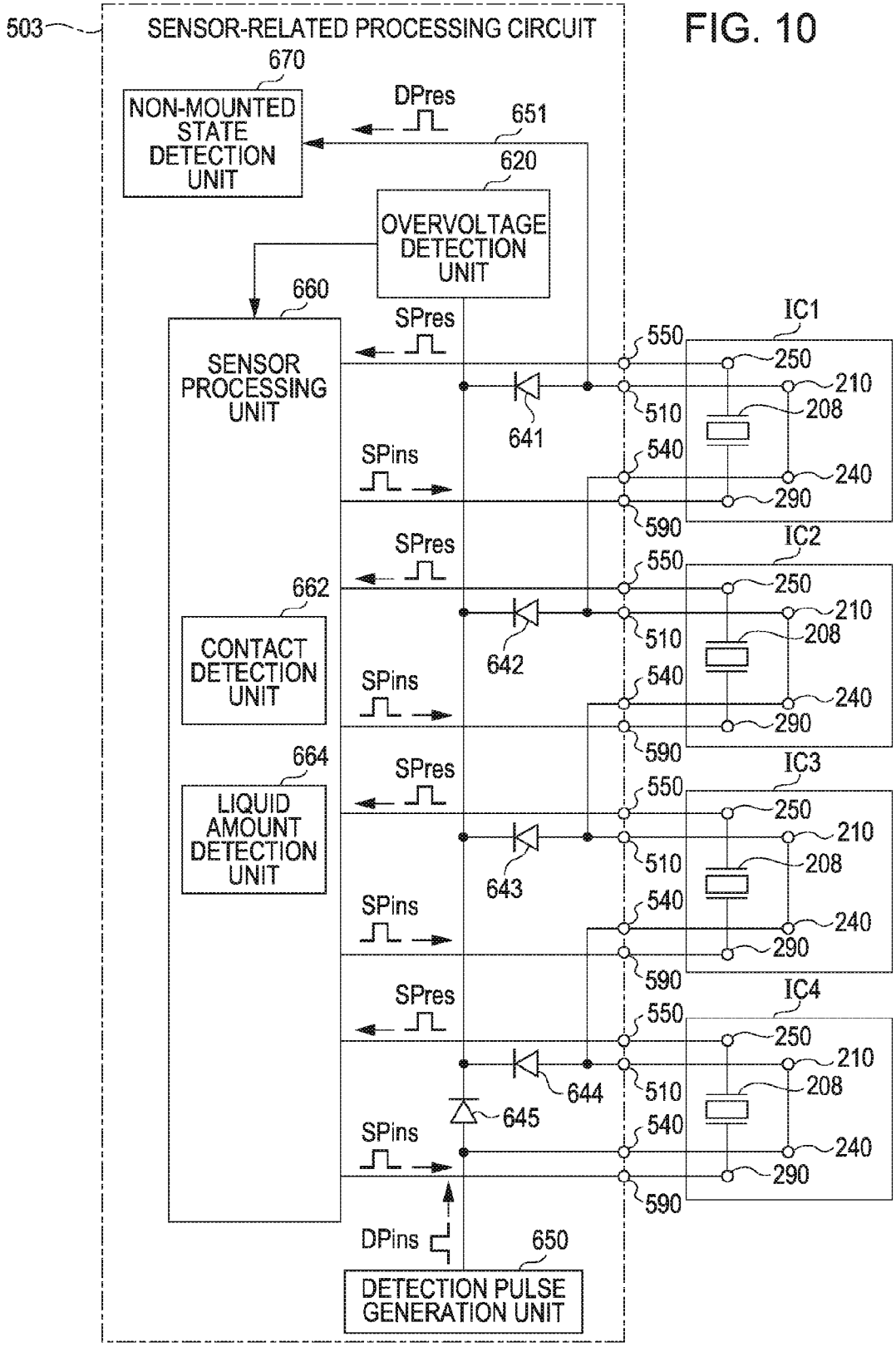
FIG. 10 is a diagram showing the internal configuration of a sensor-related processing circuit according to the second embodiment.

FIG. 10 is a diagram showing the internal configuration of the sensor-related processing circuit 503 according to the second embodiment. Here, a state where 4 cartridges are mounted in the cartridge mounting unit is shown, and reference numerals IC1 to IC4 are used for distinguishing the cartridges. The sensor-related processing circuit 503 includes a non-mounted state detection unit 670, an overvoltage detection unit 620, a detection pulse generation unit 650, and a sensor processing unit 660. The sensor processing unit 660 includes a contact detection unit 662 and a liquid amount detection unit 664. The contact detection unit 662 performs detection of mounted states of the sensor terminals 250 and 290 using the sensor 208 of the cartridge. The liquid amount detection unit 664 performs detection of a remaining ink amount using the sensor 208 of the cartridge. The detection pulse generation unit 650 and the non-mounted state detection unit 670 perform detection of whether or not all the cartridges are mounted (a detection process of a non-mounted state) and detection of a leakage state between the terminals 210 and 250 and between the terminals 240 and 290. The overvoltage detection unit 620 performs detection of whether or not an excessive voltage is applied to the overvoltage detection terminals 210 and 240.

In each of the cartridges, the first and second overvoltage detection terminals 210 and 240 are connected to each other via a wiring line. In the example of FIG. 10, the overvoltage detection terminals 210 and 240 are short-circuited by the wiring lien; however, a part of the connection wiring line may be configured as a resistor. The first overvoltage detection terminal 210 of the first cartridge IC1 is connected to a wiring line 651 in the sensor-related processing circuit 503 via the corresponding apparatus-side terminal 510, and the wiring line 651 is connected to the non-mounted state detection unit 670. The second overvoltage detection terminal 240 of an n-th (n=1 to 3) cartridge and the first overvoltage detection terminal 210 of an (n+1)-th cartridge are connected to each other via the corresponding apparatus-side terminals 540 and 510. In addition, the second overvoltage detection terminal 240 of the fourth cartridge IC4 is connected to the detection pulse generation unit 650 via the corresponding apparatus-side terminal 540. When all the cartridges IC1 to IC4 are correctly mounted in the cartridge mounting unit, the detection pulse generation unit 650 and the non-mounted state detection unit 670 are connected to each other sequentially via the overvoltage detection terminals 240 and 210 of the cartridges. On the other hand, when there is even a single non-mounted cartridge or a mounting error, non-contact or loose contacts occur in any of the apparatus-side terminals 510 and 540 or the terminals 210 and 240 of the cartridges IC1 to IC4, and the detection pulse generation unit 650 and the non-mounted state detection unit 670 enter a non-connection state. Therefore, the non-mounted state detection unit 670 can determine which of the overvoltage detection terminals 210 and 240 of the cartridges IC1 to IC4 are subjected to non-contact or loose contacts depending on whether or not a response signal DPres corresponding to an inspection signal DPins sent from the detection pulse generation unit 650 can be received. As such, in the second embodiment, when all the cartridges IC1 to IC4 are mounted in the cartridge mounting unit, the overvoltage detection terminals 240 and 210 of the cartridges are sequentially connected in series, so that by examining the connection states, whether or not non-contact or loose contacts exist in any of the overvoltage detection terminals 210 and 240 of the cartridges IC1 to IC4 can be determined. A typical case where such non-contact or loose contacts occur is a case where one or more cartridges are not mounted. Therefore, the non-mounted state detection unit 670 can immediately determine whether or not one or more cartridges are not mounted depending on whether or not the response signal DPres corresponding to the inspection signal DPins can be received. The inspection signal DPins may be generated on the basis of the voltage supplied from the first power supply voltage VDD.

The first overvoltage detection terminals 210 of the four cartridges IC1 to IC4 are connected to the anode terminals of diodes 641 to 644 via the corresponding apparatus-side terminals 510. In addition, the second overvoltage detection terminals 240 of the four cartridges IC1 to IC4 are connected to the anode terminals of diodes 642 to 645 via the corresponding apparatus-side terminals 540. The anode terminal of the second diode 642 is commonly connected to the second overvoltage detection terminal 240 of the first cartridge IC1 and the first overvoltage terminal 210 of the second cartridge IC2. Similarly, each of the diodes 643 and 644 is commonly connected to the second overvoltage detection terminal 240 of one cartridge and the first overvoltage detection terminal 210 of the adjacent cartridge. The cathode terminals of the diodes 641 to 645 are connected to the overvoltage detection unit 620 in parallel. The diodes 641 to 645 are used for monitoring whether or not an abnormally high voltage is applied to the overvoltage detection terminals 210 and 240. Such an abnormal voltage value (called an "overvoltage") is generated in a case where an unintended short circuit occurs between any one of the overvoltage detection terminals 210 and 240 and any one of the sensor terminals 250 and 290 in each of the cartridges. For example, when foreign matter such as ink droplets or dirt is attached to the surface of the board 200 (FIG. 3A), there is a possibility of an unintended short circuit occurring between the first overvoltage detection terminal 210 and the first sensor terminal 250 or between the second overvoltage detection terminal 240 and the second sensor terminal 290. When such an unintended short circuit occurs, current flows to the overvoltage detection unit 620 via any one of the diodes 641 to 645, so that the overvoltage detection unit 620 can determine existence of generation of an overvoltage or existence of generation of an unintended short circuit. In addition, generally, foreign matter which becomes a cause of the unintended short circuit is more likely to enter the lower portion of the board 200 from the upper side or enter the inside thereof from the outside. Therefore, when the contact portions of the overvoltage detection terminals 210 and 240 are disposed to be contact portions of both ends (FIGS. 3A to 3C) of the contact portions disposed on the upper side row R1 of the board 200, the overvoltage detection terminals 210 and 240 are disposed near the sensor terminals 250 and 290, so that a possibility that a high voltage applied to the sensor terminals 250 and 290 is applied to the memory terminals 220, 230, 260, 270, and 280 can be reduced.

Figure 11:
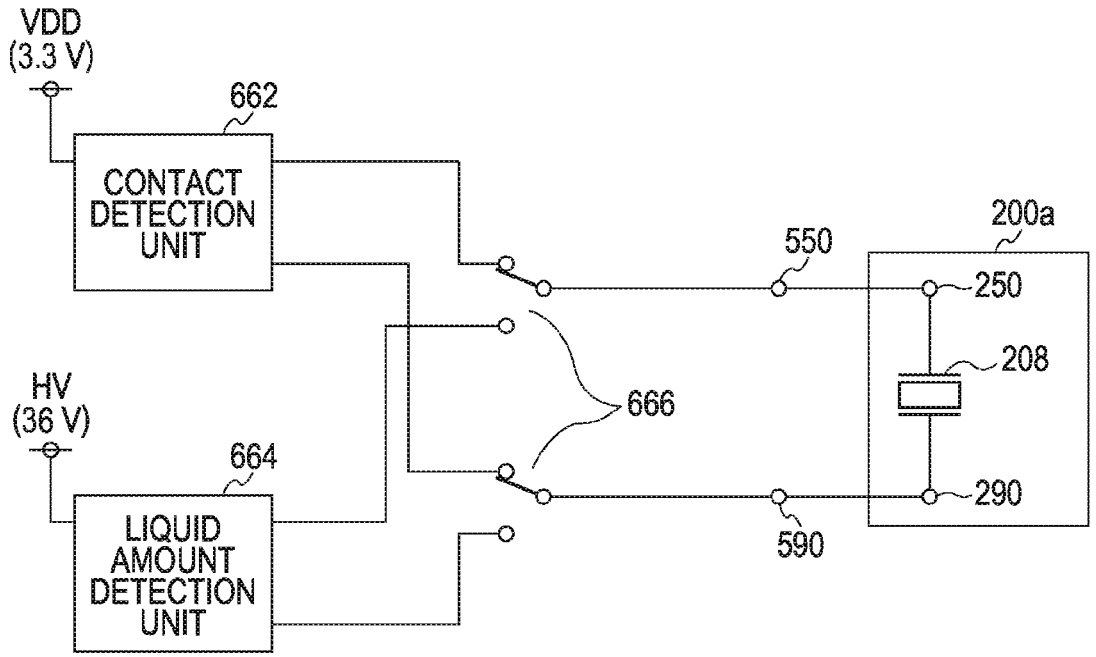
FIG. 11 is a block diagram showing a connection state between a contact detection unit and a liquid amount detection unit, and a sensor of the cartridge according to the second embodiment.

FIG. 11 is a block diagram showing a connection state between the contact detection unit 662 and the liquid amount detection unit 664, and the sensor 208 of the cartridge. The sensor 208 is selectively connected to one of the contact detection unit 662 and the liquid amount detection unit 664 via a changeover switch 666. In a state where the sensor 208 is connected to the contact detection unit 662, the contact detection unit 662 detects whether or not the sensor terminals 250 and 290 and the apparatus-side terminals 550 and 590 corresponding thereto are in a good contact state. On the other hand, in a state where the sensor 208 is connected to the liquid amount detection unit 664, the liquid amount detection unit 664 detects whether or not the amount of ink remaining in the cartridge is equal to or greater than a predetermined amount. The contact detection unit 662 operates using a relatively low power supply voltage VDD (for example, 3.3V). On the other hand, the liquid amount detection unit 664 operates using a relatively high power supply voltage HV (for example, 36V).

The contact detection unit 662 and the liquid amount detection unit 664 may be individually provided in each of the cartridges, or a single contact detection unit 662 and a single liquid amount detection unit 664 may be provided to be common to the plurality of cartridges. In the case of the latter, a changeover switch for changing over the connection state between the sensor terminals 250 and 290 of each of the cartridges, and the contact detection unit 662 and the liquid amount detection unit 664 is further provided.

Figure 12:
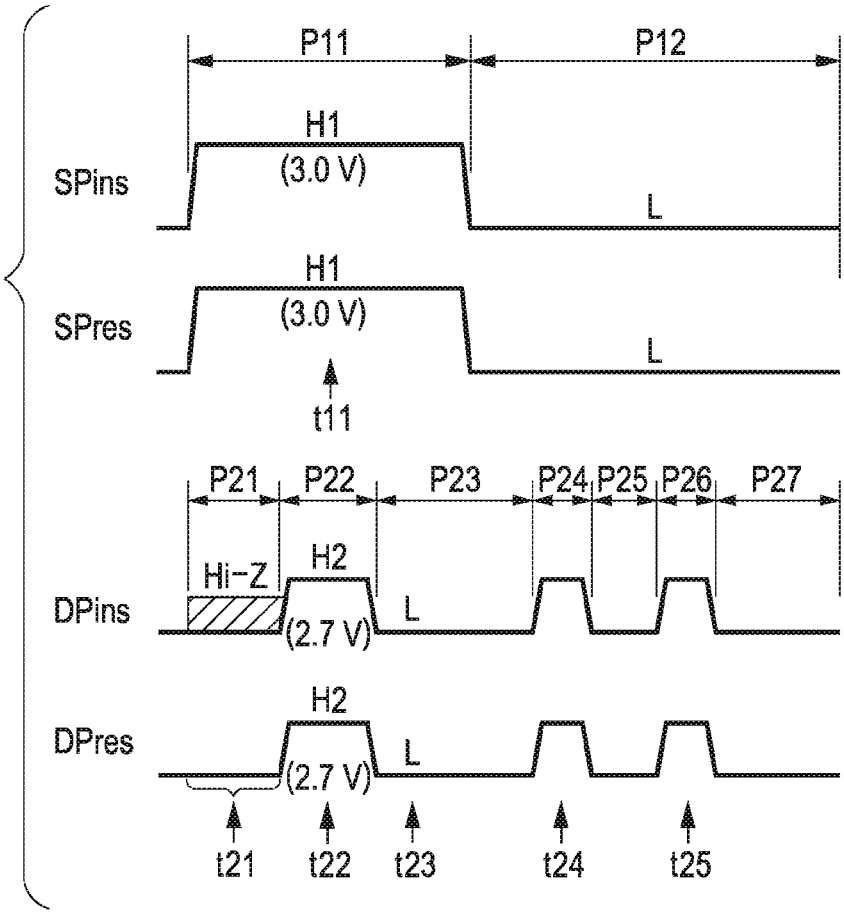
FIG. 12 is a timing chart showing various signals used for a mounting detection process.

FIG. 12 is a timing chart showing various signals used for a mounting detection process (also called a "contact detection process") of the cartridges in the second embodiment. In the mounting detection process of the cartridges, first mounting detection signals SPins and SPres and second mounting detection signals DPins and DPres are used. The signals SPins and DPins having "ins" added to the signal names as suffixes are signals output to the board 200 of the cartridge from the sensor-related processing circuit 503 and are called "mounting inspection signals". In addition, the signals SPres and DPres having "res" added to the signal names as suffixes are signals input to the sensor-related processing signal 503 from the board 200 of the cartridge and are called "mounting response signals".

As described as follows, in the second embodiment, the following three kinds of mounting state detection processes are performed.

(1) First mounting detection process: detection of contact states of the sensor terminals 250 and 290 of each of the cartridges using the first mounting detection signals SPins and SPres (2) Second mounting detection process: detection of non-mounted states of one or more cartridges using the second mounting detection signals DPins and DPres (detection of contact states of the overvoltage detection terminals 210 and 240 of all the cartridges)

(3) Leakage detection process: detection of a leakage state between the terminals 210 and 250 and between the terminals 240 and 290 using the second mounting detection signals DPins and DPres In the first and second mounting detection processes, the contact states of the terminals are detected, so that the processes can also be called "contact detection processes". In addition, the first and second mounting detection signals can also be called "first contact detection signals SPins and SPres" and "second contact detection signals DPins and DPres".

The first mounting detection signals SPins and SPres are used for the contact detection unit 662 to detect the contact states of the sensor terminals 250 and 290 of the individual cartridges. As shown in FIG. 10, the first mounting inspection signal SPins is a signal supplied to one sensor terminal 290 from the contact detection unit 662, and the first mounting response signal SPres is a signal that returns to the contact detection unit 662 from the other sensor terminal 250. The first contact inspection signal SPins is a signal which becomes a high level H1 in first period P11 of FIG. 12 and thereafter becomes a low level in a second period P12. In addition, the voltage of the high level H1 of the first mounting inspection signal SPins is set to, for example, 3.0V. When both the terminals 250 and 290 are in a normal contact state, the first mounting response signal SPres shows the same level change as the first mounting inspection signal SPins.

As shown in FIG. 10, the second mounting inspection signal DPins is a signal supplied to the overvoltage detection terminal 240 of the fourth cartridge IC4 from the detection pulse generation unit 650, and the second mounting response signal DPres is a signal input to the non-mounted state detection unit 670 from the overvoltage detection terminal 210 of the first cartridge IC1. As shown in FIG. 12, the second mounting inspection signal DPins is divided into 7 periods P21 to P27. That is, the second mounting inspection signal DPins becomes a high impedance state in the period P21, becomes a high level H2 in the periods P22, P24, and P26, and becomes a low level in the other periods P23, P25, and P27. The voltage of the high-level H2 of the second mounting inspection signal DPins is set to 2.7V, and thus is set to a different voltage level from the high level H1 (3.0V) of the first mounting inspection signal SPins. In addition, the first and second periods P21 and P22 of the second mounting inspection signal DPins correspond to a part of the first period P11 of the first mounting inspection signal SPins. In addition, the fourth to seventh periods P24 to P27 of the second mounting inspection signal DPins correspond to a part of the second period P12 of the first mounting inspection signal SPins. When terminals 210 and 240 of all the cartridges are in a normal contact state, the second mounting response signal DPres becomes a signal that becomes a low level in the first period P21, and after the second period P22, shows the same level as the second mounting inspection signal DPins. In addition, the reason why the second mounting response signal DPres becomes the low level in the first period P21 is that in a state immediately before the first period P21, the second mounting response signal DPres (that is, the wiring line 651 input to the non-mounted state detection unit 670) becomes the low level.

Figure 13A:
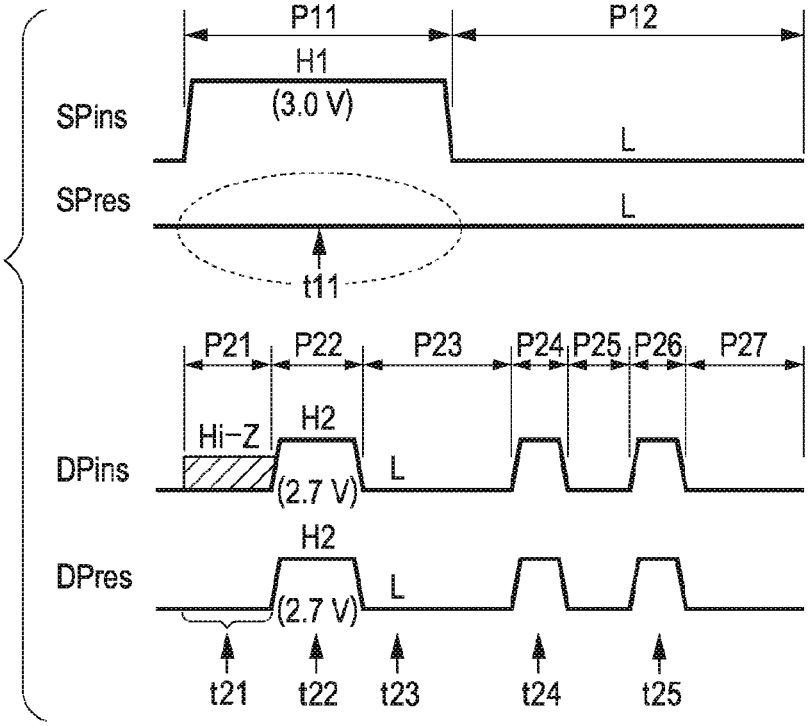
FIGS. 13A and 13B are timing charts showing typical signal waveforms when there is a loose contact.

FIG. 13A shows a signal waveform in a state where a contact of at least one of the terminals 250 and 290 is loose. In this case, the first mounting response signal SPres becomes a low level through the periods P11 and P12. The contact detection unit 662 can determine whether or not contacts of the terminals 250 and 290 are good by examining the level of the mounting response signal SPres at a predetermined timing t11 in the period P11. When a cartridge in which the terminals 250 and 290 are in a loose contact is detected, it is preferable that the main control circuit 400 display information (text or images) indicating the content that the mounted state of the cartridge is bad on the display panel 430 to notify the user.

Figure 13B:
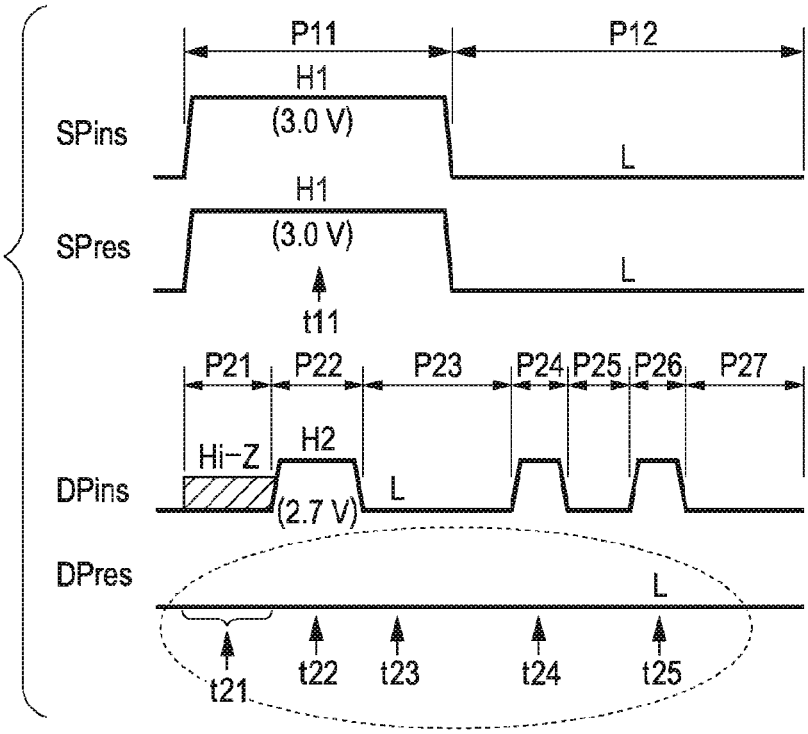

FIG. 13B shows a signal waveform in a case where a contact of at least one of the terminals 210 and 240 of all the cartridges is loose. In this case, the second mounting response signal DPres becomes a low level through the periods P21 and P27. Therefore, the non-mounted state detection unit 670 can detect the state where one or more cartridges are not normally mounted by examining the level of the second mounting response signal DPres at predetermined timings t22, t24, and t25 of the periods P22, P24, and P26 in which the second mounting inspection signal DPins becomes a high level. In addition, it is sufficient to perform the determination at least one of the three timings t22, t24, and t25. When it is determined that one or more cartridges are not normally mounted, it is preferable that the main control circuit 400 display information (text or images) indicating the content that the mounted state is bad on the display panel 430 to notify the user.

Only for the purpose of the detection process of the non-mounted state (second mounting detection process) described above, the second mounting inspection signal DPins may be a simple purse signal which is similar to the first mounting inspection signal SPins. The reason that the second mounting inspection signal DPins has a complex waveform as shown in FIG. 12 is for detecting a leakage state described (third mounting state detection process) as follows.

Figure 14A:
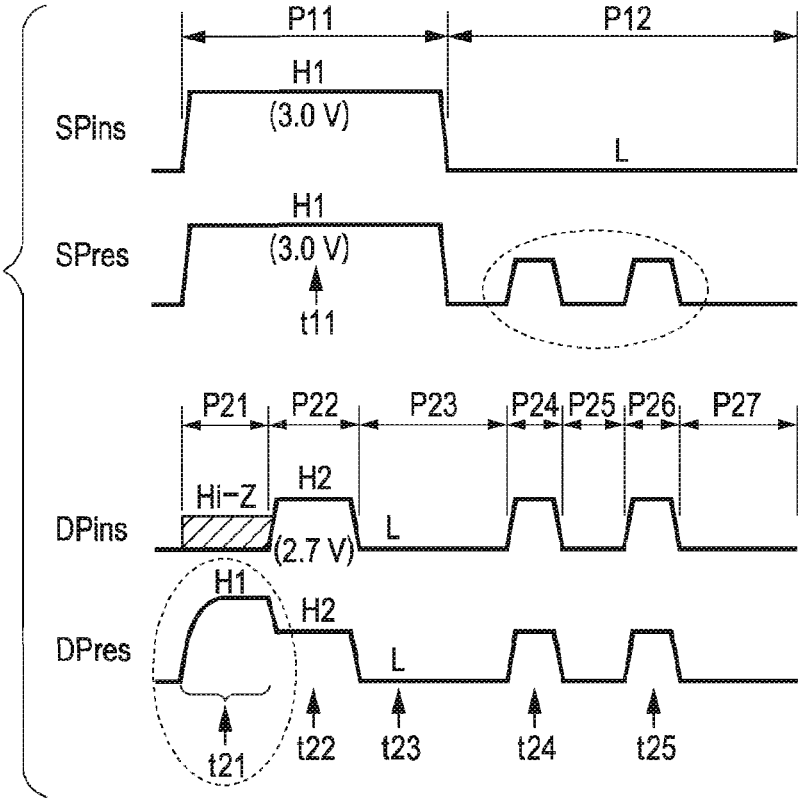
FIGS. 14A and 14B are timing charts showing typical signal waveforms when an overvoltage detection terminal and a sensor terminal are in a leakage state.

FIG. 14A shows a waveform in a case where there is a leakage state between the overvoltage detection terminal 240 and the sensor terminal 290. Here, the "leakage state" is not a very low resistance state to be called an unintended short circuit but means a state of a connection at a resistance value of equal to or lower than a certain degree (for example, a resistance value of equal to or lower than 10 kΩ). In this case, the second mounting response signal DPres shows a distinctive signal waveform. That is, the second mounting response signal DPres rises from the low level to the high level H1 in the first period P21 and falls to the second high level H2 in the second period P22. The first high level H1 has substantially the same voltage as the first high level H1 of the first mounting inspection signal SPins. This waveform can be understood from an equivalent circuit described as follows.

Figure 15A:
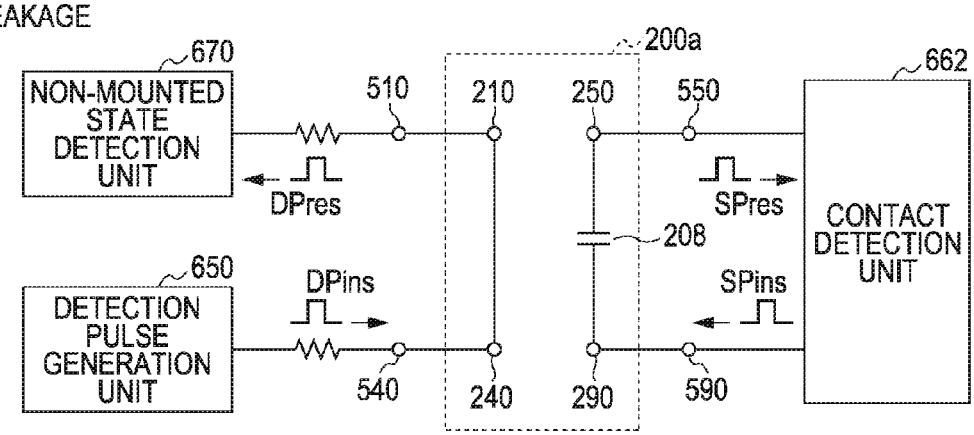
FIGS. 15A to 15C are diagrams showing equivalent circuits of connection states of the board, the contact detection unit, a detection pulse generation unit, and a non-contact state detection unit.
Figure 15B:
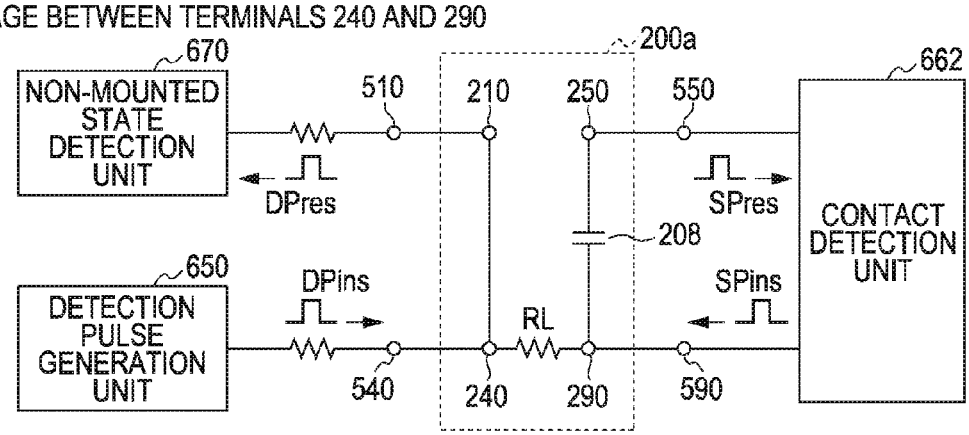

FIG. 15A shows a connection state between the board 200*a*, the contact detection unit 662, the detection pulse generation unit 650, and the non-contact state detection unit 670. This state is a state where there is no leakage between adjacent terminals. FIG. 15B shows an equivalent circuit of a case where there is a leakage between the terminals 240 and 290. Here, the leakage state between the terminals 240 and 290 is simulated as a resistor RL. The sensor 208 has a function of a capacitive element. The circuit including the capacitance of the sensor 208 and the resistor RL between the terminals 240 and 290 in FIG. 15B functions as a low-pass filter circuit (integration circuit) for the first contact inspection signal SPins. Therefore, the second mounting response signal DPres input to the non-mounted state detection unit 670 becomes a signal that gradually rises to the high level H1 (about 3V) of the first mounting inspection signal SPins as shown in FIG. 14A. The non-mounted state detection unit 670 can identify that there is a leakage between the terminals 240 and 290 by examining the voltage level of the second mounting response signal DPres at one or more (preferably, a plurality of) timings t21 in the period P21. Otherwise, it is possible to determine that there is a leakage between the terminals 240 and 290 from a voltage difference between the high levels H1 and H2 of the second mounting response signal DPres in the first and second periods P21 and P22 of the second mounting response signal DPres.

In addition, a change in the second mounting response signal DPres in the first period P21 of FIG. 14A is also obtained when the level of the second mounting inspection signal DPins in the period P21 is set to a level lower than the first high level H1. Therefore, for example, even when the second mounting inspection signal DPins is maintained at the low level in the period P21, the leakage state between the terminals 240 and 290 can be detected. In addition, the second mounting inspection signal DPins may be maintained at the low level through the periods P21 to P23.

When there is a leakage between the terminals 240 and 290, the first mounting response signal SPres further shows a distinctive change. That is, the first mounting response signal SPres rises as the second mounting inspection signal DPins rises to the high level in the periods P24 and P26. Therefore, whether or not a leakage occurs can be determined also by examining the first mounting response signal SPres at predetermined timings t24 and t25 of the periods P24 and P26.

Figure 14B:
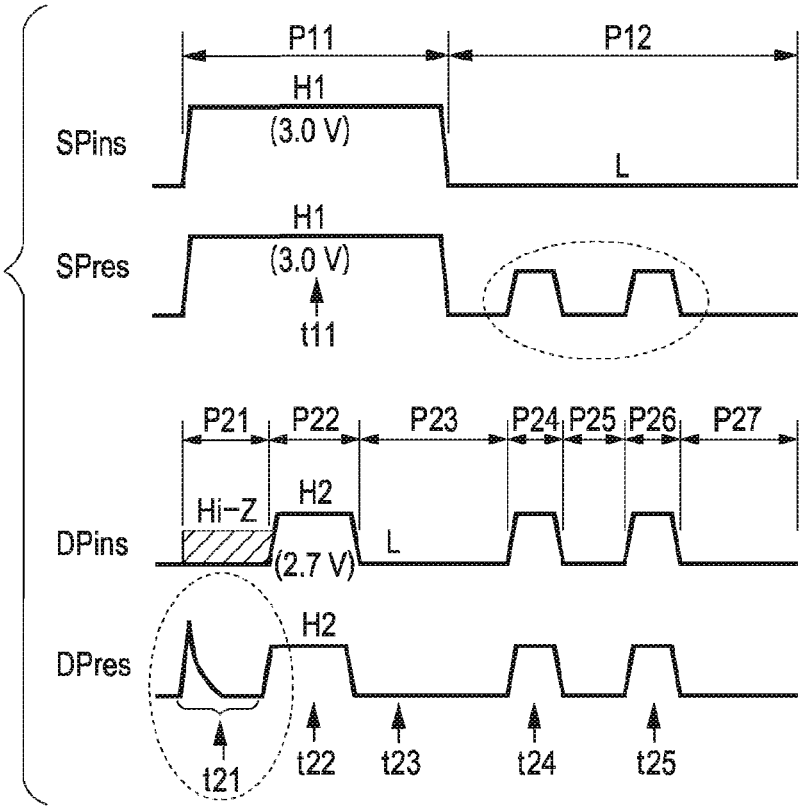

FIG. 14B shows a signal waveform in a case where there is a leakage state between the other overvoltage detection terminal 210 and the sensor terminal 250. Even in this case, the second mounting response signal DPres shows a distinctive signal waveform. That is, the second mounting response signal DPres sharply rises from the low level in the first period P21 and then slightly gently falls. A voltage level at the peak at this time is higher than the high level H2 of the second mounting inspection signal DPins and reaches to a level close to the high level H1 of the first mounting inspection signal SPins.

Figure 15C:
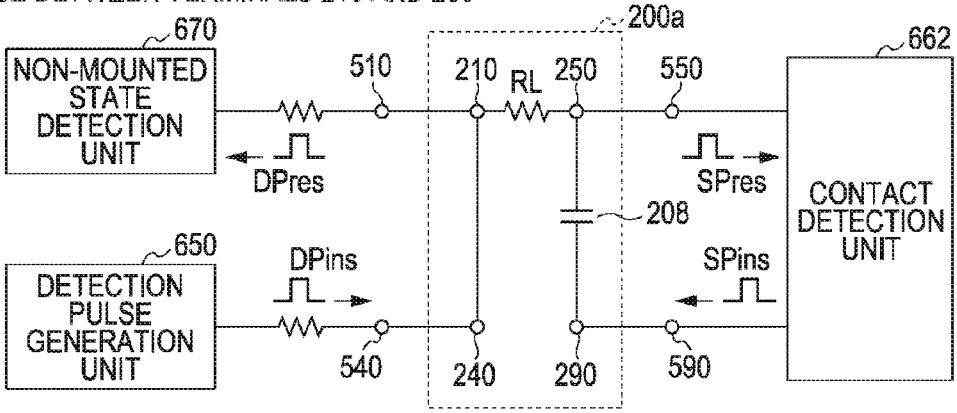

FIG. 15C shows an equivalent circuit of a case where there is a leakage between the terminals 210 and 250. Here, the leakage state between the terminals 210 and 250 is simulated as a resistor RL. The circuit including the capacitance of the sensor 208 and the resistor RL between the terminals 210 and 250 functions as a high-pass filter circuit (differentiation circuit) for the first mounting inspection signal SPins. Therefore, the second mounting response signal DPres becomes a signal showing a peak shape in the first period P21 as shown in FIG. 14B. Here, after the second period P22, the second mounting response signal DPres shows the same change as the second mounting inspection signal DPins. The non-mounted state detection unit 670 can identify that there is a leakage between the terminals 210 and 250 by examining the voltage level of the second mounting response signal DPres at an arbitrary or a plurality of timings t21 in the period P21. In addition, in the case where there is a leakage between the terminals 240 and 290 (FIG. 14A) and in the case where there is a leakage between the terminals 210 and 250 (FIG. 14B), a relationship between the voltage level of the signal DPres at a timing from the center to the end of the first period P21 and the voltage level of the signal DPres in the second period P22 is reversed. Therefore, by comparing the voltage levels of the signal DPres at the two timings, which place between the terminals 240 and 290 and between the terminals 210 and 250 has a leakage can be accurately identified.

In addition, the change in the second mounting response signal DPres as in FIG. 14B is obtained when the output terminal (that is, the output terminal of the detection pulse generation unit 650) of the second mounting inspection signal DPins in the period P21 is set to a high impedance state. Therefore, for example, when the second mounting inspection signal DPins is set to the high impedance state in the period P21, the leakage state between the terminals 210 and 250 can be detected even though the signal is set to the low level in the periods P22 and P23.

Even when there is a leakage between the terminals 210 and 250, the first mounting response signal SPres shows a distinctive change. That is, the first mounting response signal SPres rises as the second mounting inspection signal DPins rises to the high level in the periods P24 and P26. Therefore, whether or not a leakage occurs can be determined also by examining the first mounting response signal SPres at the predetermined timings t24 and t25 of the periods P24 and P26. Here, the change in the first mounting response signal SPres has no significant difference between the case where there is a leakage between the terminals 240 and 290 (FIG. 14A) and the case where there is a leakage between the terminals 210 and 250 (FIG. 14B). Therefore, the inspection of the first mounting response signal SPres at the timings t24 and t25 cannot identify which place between the two groups of terminals has a leakage. Here, when there is no need to perform the identification, the inspection of the first mounting response signal SPres is sufficient.

As understood from the above description with reference to FIGS. 12 to 14B, whether or not there is a leakage state between adjacent terminals can be detected by examining at least one of the two mounting inspection signals SPins and DPins.

Figure 16A:
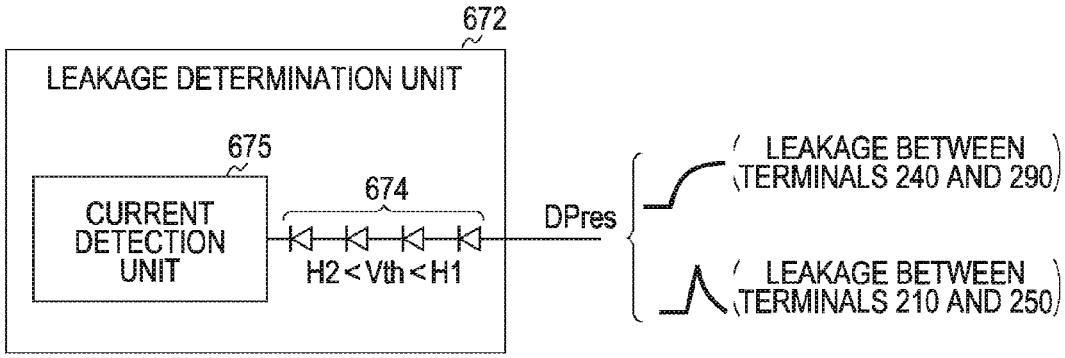
FIGS. 16A and 16B are block diagrams showing examples of the configuration of a leakage determination unit provided in the non-contact state detection unit.
Figure 16B:
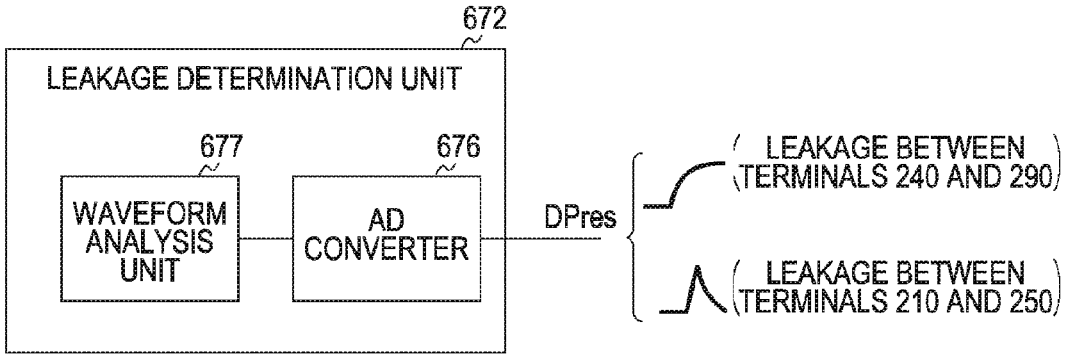

FIGS. 16A and 16B are block diagrams showing examples of the configuration of a leakage determination unit that can be used for determining the leakage state shown in FIGS. 15A to 15C. The leakage determination unit may be provided in the non-mounted state detection unit 670. The leakage determination unit 672 of FIG. 16A includes a voltage barrier unit 674 configured by a series connection of a plurality of diodes, and a current detection unit 675. A threshold voltage Vth of the voltage barrier unit 674 is set to a value higher than the high level H1 of the first mounting inspection signal SPins and lower than the high level H2 of the second mounting inspection DPins. Therefore, when the voltage level of the second mounting response signal DPres becomes equal to or higher than the second high level H2, current flows to the current detection unit 675 from the voltage barrier unit 674. Therefore, the current detection unit 675 can detect whether or not a leakage occurs in at least one place between the terminals 240 and 290 and between the terminals 210 and 250 depending on whether or not current is input to the voltage barrier unit 674 in the period P21 of FIGS. 14A and 14B. Here, this circuit cannot identify which place between the terminals 240 and 290 and between the terminals 210 and 250 has a leakage.

The leakage determination unit 672 of FIG. 16B has an AD conversion unit 676 and a waveform analysis unit 677. In this circuit, a change in the second mounting response signal DPres is digitalized by the AD conversion unit 676 and is supplied to the waveform analysis unit 677. The waveform analysis unit 677 can determine the leakage state by analyzing the shape of the waveform. For example, in the case where the second mounting response signal DPres is a signal passing through the low-pass filter in the period P21 of FIG. 14A (a signal which gradually rises and is also convex), it can be determined that there is a leakage between the terminals 240 and 290. On the other hand, in the case where the second mounting response signal DPres is a signal passing through the high-pass filter (a signal showing a sharp peak), it can be determined that there is a leakage between the terminals 210 and 250. In addition, the operation clock frequency of the AD conversion unit 676 is set to a frequency high enough to perform waveform analysis. The waveform analysis unit 677 obtains a time constant of the change in the second mounting response signal DPres and can calculate the resistance value and the capacitance value of the equivalent circuit in the leakage state. For example, in the equivalent circuits of FIGS. 15B and 15C, only the resistor RL between the leaking terminals is unknown, and resistance values of other resistors or the capacitance value of the capacitive element 208 are known. Therefore, it is possible to calculate the resistor RL between the leaking terminals from the time constant of the change in the second mounting response signal DPres. In addition, as the configuration of the leakage determination unit, various circuit configurations other than the above configuration can be employed.

As understood from the above description with reference to FIGS. 12 to 16B, by examining at least one of (i) whether or not the second mounting response signal DPres is influenced by the first mounting inspection signal SPins (DPres in FIGS. 14A and 14B) and (ii) whether or not the first mounting response signal SPres is influenced by the second mounting inspection signal DPins (SPres in FIGS. 14A and 14B), whether or not there is a leakage between the terminals 250 and 290 or between the terminals 210 and 240 can be determined. It is preferable that as the two mounting inspection signals SPins and DPins, signals having different signal waveforms of which voltage levels are changed be used other than signals having constant voltage levels (for example, signals always maintained at a low level or a high level). In addition, it should be noted that the signal waveforms of FIGS. 12 to 14B are simplified for illustration.

When a leakage is detected by at least one of the two overvoltage detection terminals 210 and 240, points where the leakage occurs may be recorded in the non-volatile memory (not shown) in the printing apparatus. Then, it is possible to take measures to suppress a leakage during maintenance of the printing apparatus by examining a terminal position where a leakage is more likely to occur and adjusting contact points of the terminals of the contact point mechanism 1400 (FIG. 4B) in the printing apparatus or the springs.

Figure 17:
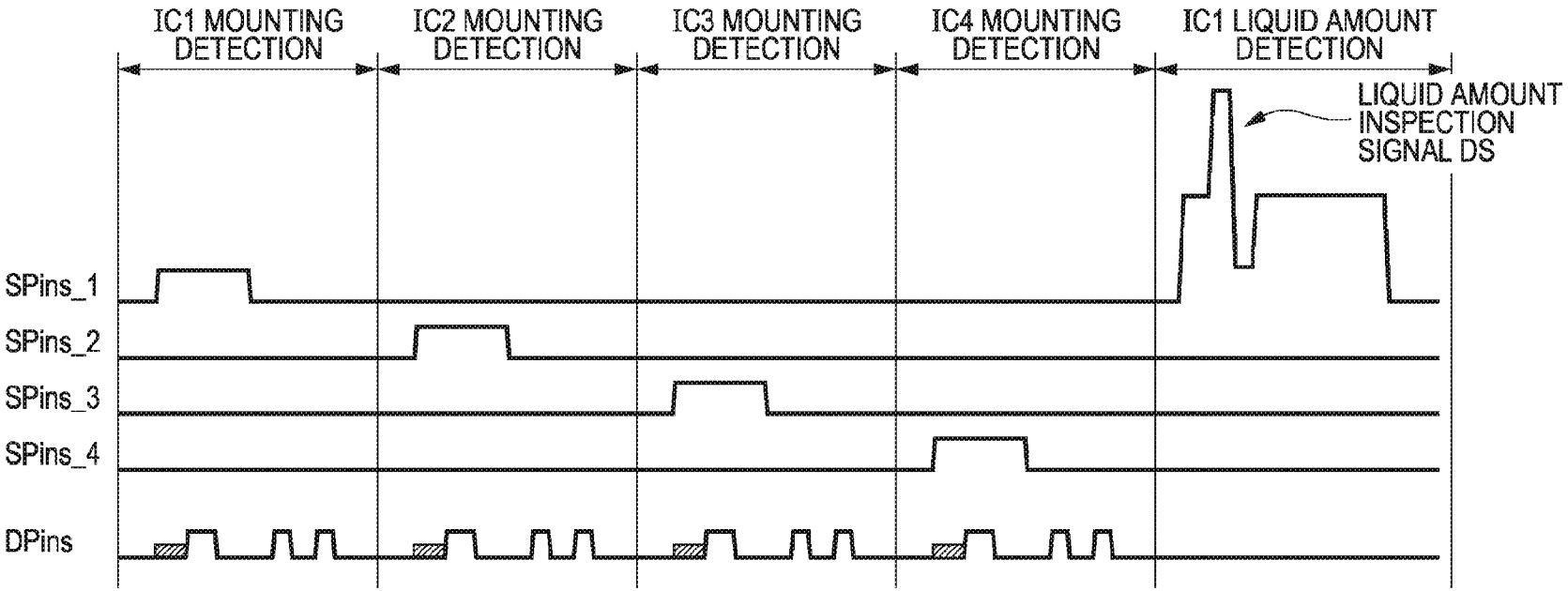
FIG. 17 is a timing chart showing the mounting detection process for four cartridges.

FIG. 17 is a timing chart of the mounting detection process for the four cartridges IC1 to IC4. Here, the first mounting inspection signals SPins_1 to SPins_4 respectively supplied to the corresponding cartridges and the second mounting inspection signal DPins supplied to the series connection of the terminals 240 and 210 of all the cartridges are shown. As such, the mounting inspections regarding the four cartridges are sequentially performed to each of the cartridges, and to each of the cartridges, the first and second mounting inspection signals SPins and DPins are supplied in the same period, thereby performing the above-described three kinds of mounting detection processes. During the inspection, when a mounting error (loose contact) or leakage is detected, it is preferable to display the intent on the display panel 430 in order to recommend the user to re-mount the cartridge. On the other hand, as a result of the mounting inspection, when no mounting error or leakage is detected, thereafter, detection of the amount of ink remaining in each of the cartridge, reading of data from the storage device 203, and the like are performed.

Figure 18:
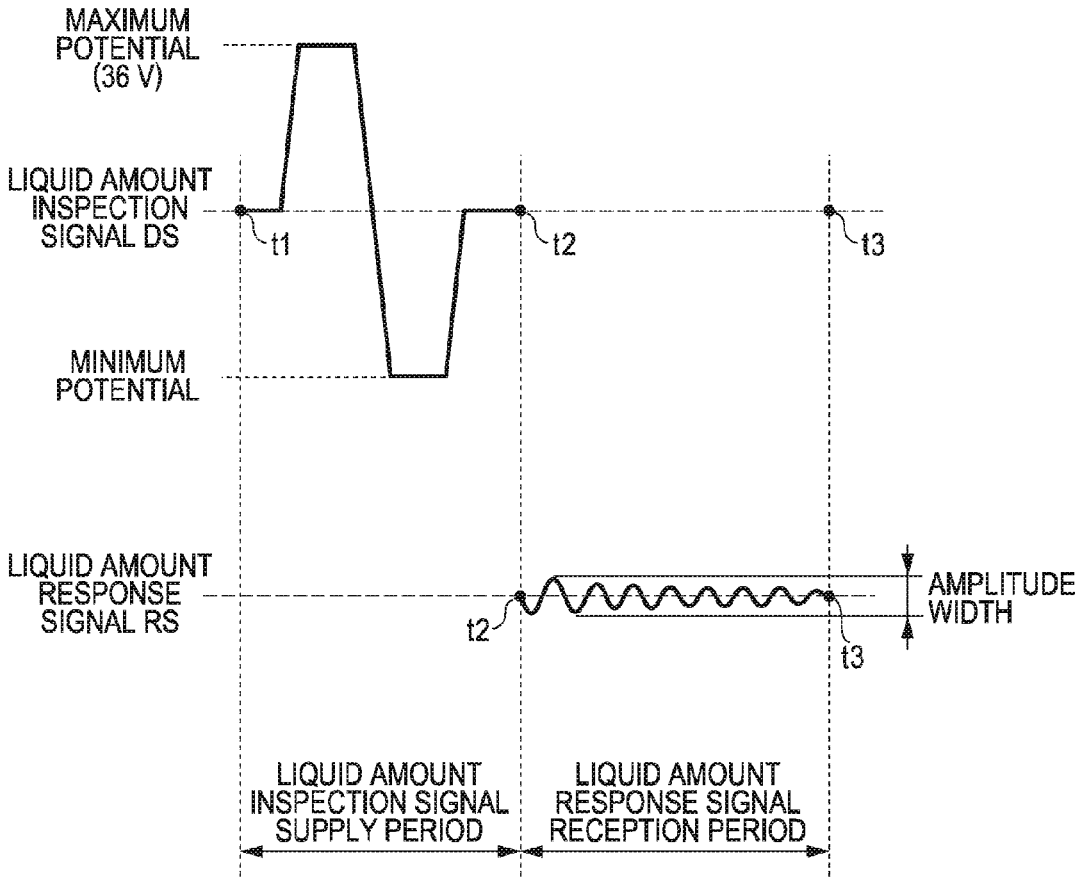
FIG. 18 is a timing chart of a liquid amount detection process.

FIG. 18 is a timing chart of a liquid amount detection process. In the liquid amount detection process, a liquid amount inspection signal DS is supplied to the one sensor terminal 290. The liquid amount inspection signal DS is supplied to one electrode of the piezoelectric element included in the sensor 208. The liquid amount inspection signal DS is an analog signal generated by the liquid amount detection unit 664 (FIG. 10). The maximum voltage of the liquid amount inspection signal DS is, for example, about 36V and the minimum voltage is about 4V. The piezoelectric element of the sensor 208 vibrates in response to the amount of ink remaining in the cartridge 100, and a counter-electromotive voltage generated due to the vibration is sent to the liquid amount detection unit 664 from the piezoelectric element via the other sensor terminal 250 as a liquid amount response signal RS. The liquid amount response signal RS includes a vibration component having a frequency corresponding to the number of vibrations of the piezoelectric element. The liquid amount detection unit 664 can detect whether or not the remaining ink amount is equal to or greater than a predetermined amount by measuring the frequency of the liquid amount response signal RS. The detection process of the remaining ink amount is a high-voltage process for applying a high-voltage signal DS having a higher voltage level than the first mounting inspection signal DPins used for the above-described leakage inspection (leakage detection process) to the sensor 208 via the terminals 250 and 290.

As such, during detection of the remaining ink amount, the high-voltage liquid amount inspection signal DS is applied to the sensor terminals 250 and 290. If insulation between the sensor terminals 250 and 290 and the overvoltage detection terminals 210 and 240 is insufficient, an abnormally high voltage (overvoltage) is generated in the terminals 210 and 240. In this case, current flows to the overvoltage detection unit 620 via the diodes 641 to 645 (FIG. 10), so that the overvoltage detection unit 620 can determine existence of generation of the overvoltage. When the overvoltage is detected, a signal indicating the generation of the overvoltage is supplied to the liquid amount detection unit 664 from the overvoltage detection unit 620, so that in response to this, the liquid amount detection unit 664 immediately stops outputting the liquid amount inspection signal DS. This is for preventing damage in the cartridge or the printing apparatus that may occur due to the overvoltage. That is, when the insulation between the sensor terminal 250 (or 290) and the overvoltage detection terminal 210 (or 240) is insufficient, there is a concern that insulation between the sensor terminal and the terminal for the storage device also becomes insufficient. Here, when an overvoltage is generated in the overvoltage detection terminals 210 and 240, the overvoltage is also applied to the terminal for the storage device, so that there is a possibility of the storage device connected to the terminal for the storage device or the circuit of the printing apparatus of being damaged. Therefore, when outputting of the liquid amount inspection signal DS is immediately stopped when the overvoltage is detected, damage in the cartridge or the printing apparatus that may occur due to the overvoltage can be prevented.

In addition, as described with reference to FIGS. 12 to 17, before the detection of the remaining ink amount, the plurality of kinds of mounted state detection processes are performed. In the leakage state detection process thereof, as described above with reference to FIGS. 14A to 16B, whether or not a leakage state which is at a low voltage occurs between the terminals 240 and 290 or the terminals between 210 and 250 is detected. That is, in the leakage state detection process, using the mounting inspection signals SPins and DPins at a relatively low voltage level (about 3V), whether or not the place between the terminals 240 and 290, or the place between the terminals 210 and 250 is in a low resistance state of equal to or lower than a certain resistance value (for example, 10 kΩ). In addition, when it is determined that there is no leakage between the terminals, it is guaranteed that the resistance value between the terminals 240 and 290 and between the terminals 210 and 250 is equal to or higher than the resistance value (about 10 kΩ). Therefore, after the leakage state detection process, even though the detection process of the remaining ink amount using a signal having a higher voltage level (about 36V) is performed, an overvoltage applied to the overvoltage detection terminals 210 and 240 does not become an extremely high value. As such, in the second embodiment, a leakage state between the terminals 240 and 290 or between the terminals 210 and 250 is inspected using a signal having a relatively low voltage level, and as a result, when there is no leakage, the signal having the relatively high voltage level is applied to the terminals 250 and 290. Therefore, compared to the case where inspection of a leakage state is not performed, it is possible to further reduce the level of an overvoltage that may occur in the printing apparatus or the cartridge.

Figure 19A:
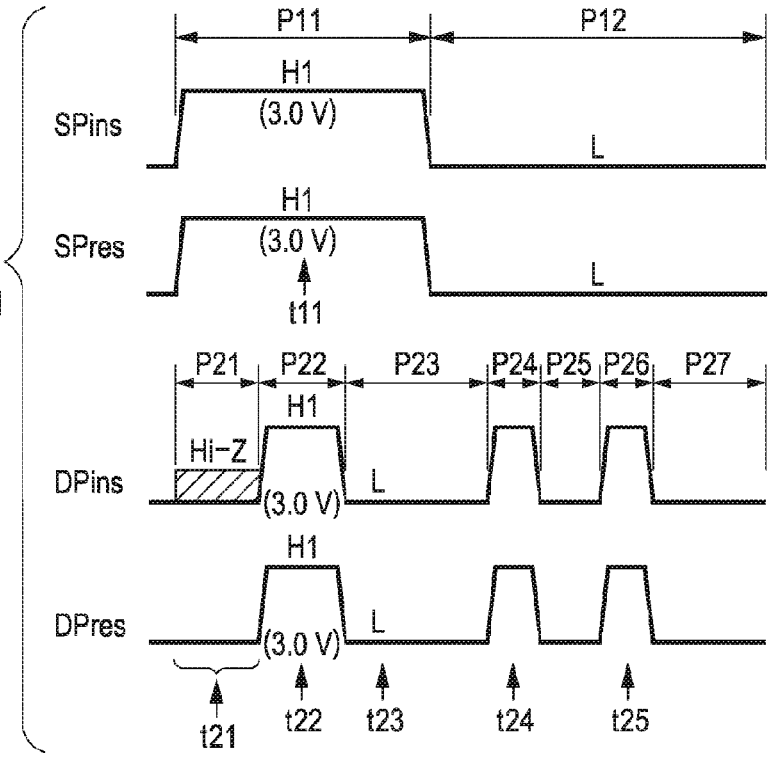
FIGS. 19A and 19B are timing charts showing different examples of signals used for the mounting detection process.

FIG. 19A is a timing chart showing a first modified example of the signal used for the mounting detection process of the second embodiment. The difference from FIG. 12 is that the values of the high levels of the second mounting detection signals DPins and DPres are set to be the same as those of the first mounting detection signals SPins and SPres, and other features are the same as those of the signal of FIG. 12. Even when the signal is used, it is possible to perform substantially the same mounted state detection processes as those described with reference to FIGS. 13A to 16B. In this case, since the level of the second mounting response signal DPres in the second period P22 of FIG. 14A is equal to the level H1 in the first period P21, a leakage between the terminals 240 and 290 cannot be determined from the difference between the levels of the second mounting response signal DPres in the first and second periods P21 and P22. Here, as shown in FIGS. 14A and 14B, from the change in the level of the second mounting response signal DPres in the first period P21, which place between the terminals 240 and 290 and between the terminals 210 and 250 has a leakage can still be distinguished.

Figure 19B:
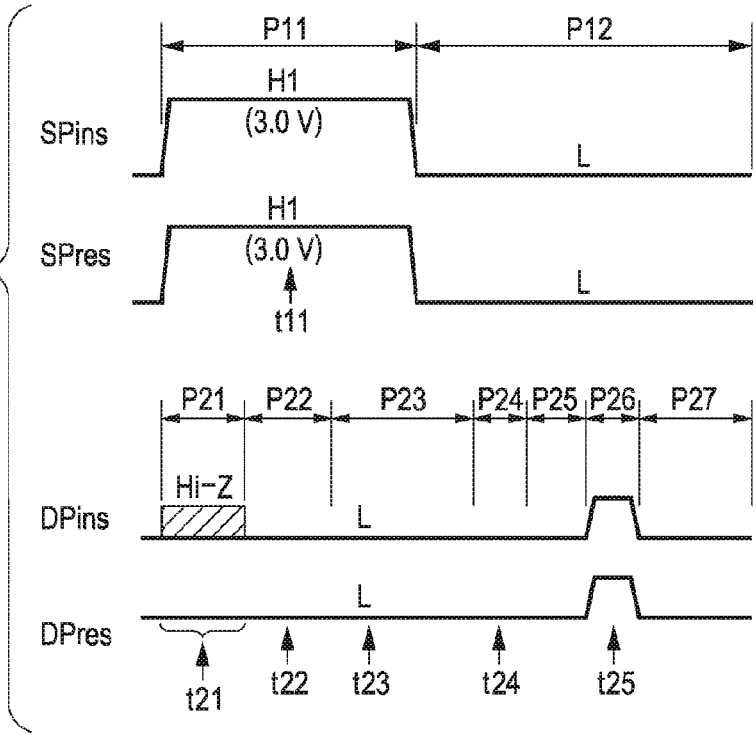

FIG. 19B is a timing chart showing a second modified example of the signal used for the mounting detection process of the second embodiment. The difference from FIG. 12 is that the second mounting inspection signal DPins is set to the low level in the second period P22 and the fourth period P24 and accordingly the second mounting response signal DPres is maintained at the low level through the periods P21 to P25, and other features are the same as those of the signal of FIG. 12. Even when the signal is used, it is possible to perform substantially the same mounting detection as that described with reference to FIGS. 13A to 16B. In this case, determination at the timings t22 and t24 of FIG. 13B cannot be performed; however, determination at other timings described with reference to FIGS. 13A to 14B can still be performed.

As understood from the various examples of the signal of FIGS. 12, 19A, and 19B, various modifications of the voltage level or the waveform of the mounting detection signal (contact detection signal) can be made. Here, in the case where detection of a leakage state between the terminals 240 and 290 and between the terminals 210 and 250 is performed, it is preferable that when the first mounting detection signal SPins becomes a high level, the second mounting detection signal DPins (or the signal line) be changed from a low level to a high impedance state or be maintained at the low level.

As described above, even in the second embodiment, like the first embodiment, the contact portions of the mounting detection terminals are provided at four corners in the periphery of the contact portions of the plurality of terminals for the storage device of the board, and more specifically, the four corners of the quadrangular region which is on the outside of the region where the plurality of terminals for the storage device of the board are disposed and includes the region, by confirming that the apparatus-side terminals corresponding to the mounting detection terminals are in a good contact state, it is possible to guarantee a good contact state even regarding the terminals for storage device. In addition, in the second embodiment, by examining at least one of the first mounting response signal SPres regarding the pair of terminals 250 and 290 of the board and the second mounting response signal DPres regarding the other pair of terminals 210 and 240, the mounting detection process for detecting whether or not all the cartridges are mounted and the leakage state detection process for detecting whether or not there is a leakage between the terminals can be simultaneously performed. Moreover, in the second embodiment, before the high-voltage process of applying a relatively high voltage (about 36V) to the terminals 250 and 290, the leakage state detection process is performed using a relatively low voltage (about 3V), so that it is possible to prevent an extremely high overvoltage from leaking from the terminals 250 and 290 and damaging the cartridge or the printing apparatus.

C. Third Embodiment

Figure 20:
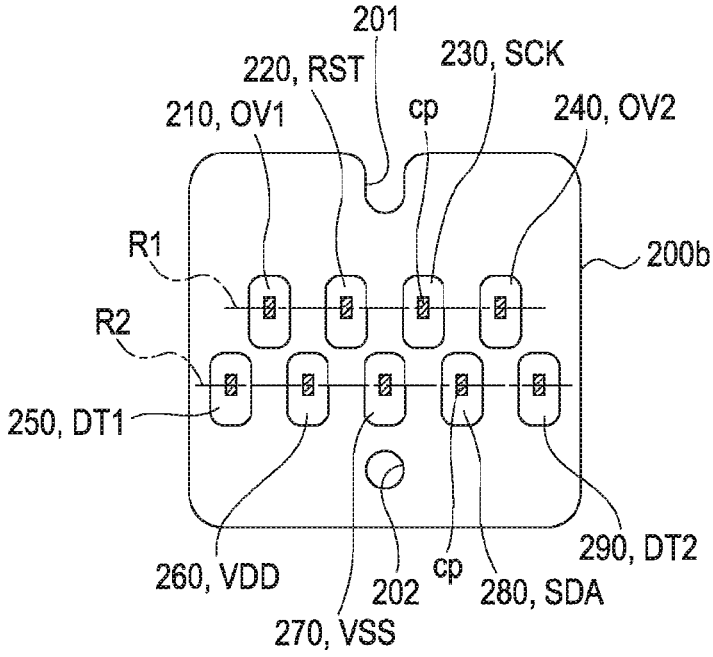
FIG. 20 is a diagram showing the configuration of a board according to a third embodiment.

FIG. 20 is a diagram showing the configuration of a board according to a third embodiment. The arrangement of the terminals 210 to 290 is the same as that shown in FIG. 3A. Here, the functions (purposes) of the terminals are as follows and are slightly different from those of the first and second embodiments.

<Upper Side Row R1>

(1) Overvoltage detection terminal 210 (also for mounting detection)
(2) Reset terminal 220
(3) Clock terminal 230
(4) Overvoltage detection terminal 240 (also for mounting detection)<

<Lower Side Row R2>

(5) Mounting detection terminal 250
(6) Power supply terminal 260
(7) Ground terminal 270
(8) Data terminal 280
(9) Mounting detection terminal 290

The functions and purposes of the terminals 210 to 240 of the upper side row R1 are substantially the same as those of the second embodiment. The terminals 250 and 290 of the lower side row R2 are different from those of the second embodiment in that they are used for the mounting detection using a resistive element provided in the cartridge 100. In addition, using the contact portions of the terminals 210, 240, 250, and 290 at four corners of the contact portions of the terminal group 210 to 290 for mounting detection (contact detection) is the same as in the first and second embodiments. Moreover, even in the third embodiment, to the contact portions of the two terminals 210 and 240 disposed at both ends of the upper side row R1, the same voltage as the first power supply voltage VDD for driving the storage device or a voltage generated from the first power supply voltage VDD is applied, and to the contact portions of the two terminals 250 and 290 disposed at both ends of the lower side row R2, the same voltage as the second power supply voltage VHV used for driving the printing head or a voltage generated from the second power supply voltage VHV is applied. Here, it is preferable that as the "voltage generated from the second power supply voltage VHV", a voltage which is higher than the first power supply voltage VDD and is lower than the second power supply voltage VHV be used.

Figure 21:
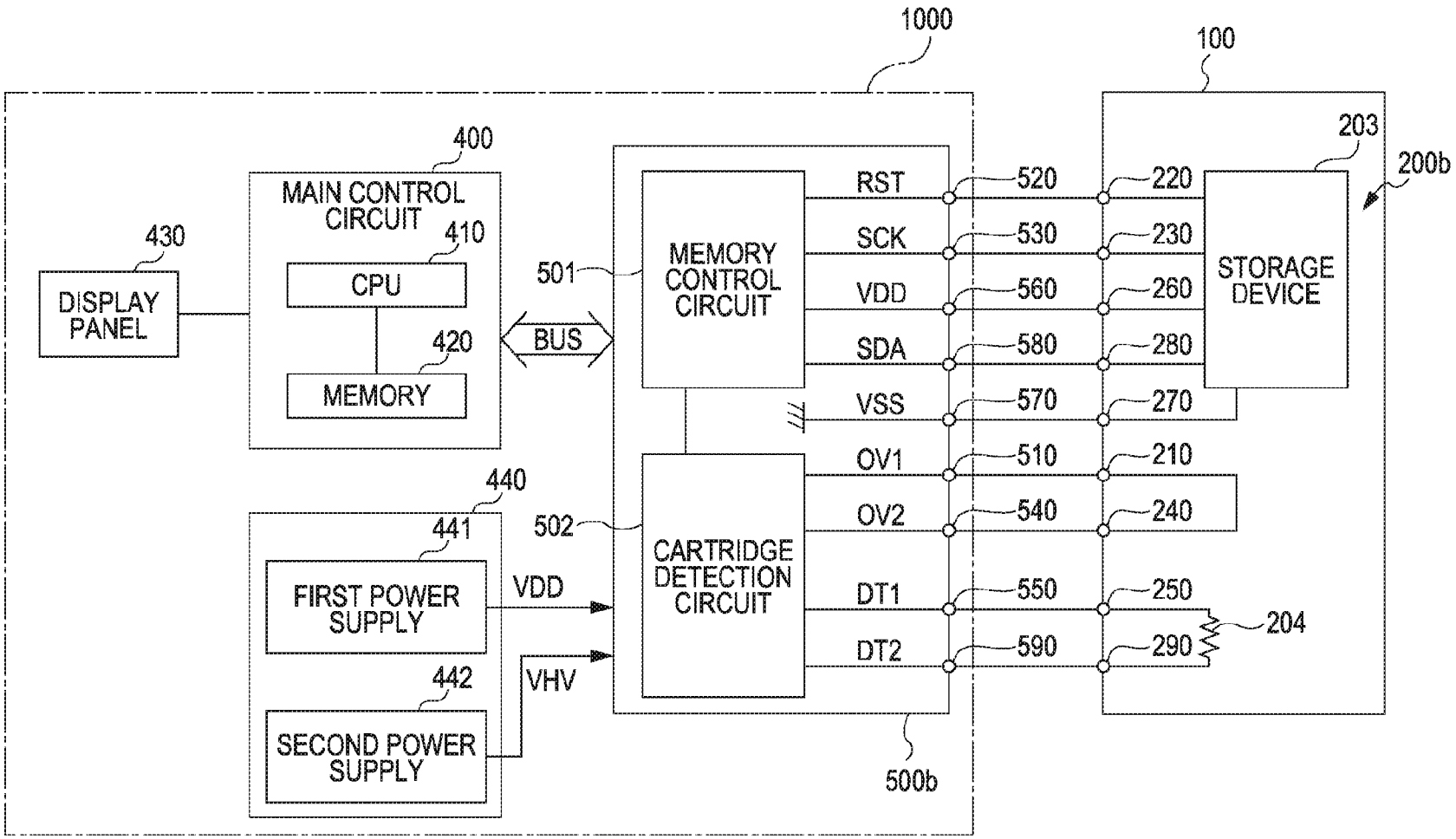
FIG. 21 is a block diagram showing the electrical configuration of an ink cartridge and a printing apparatus according to the third embodiment.

FIG. 21 is a block diagram showing the electrical configuration of an board 200*b* of a cartridge and a printing apparatus 1000 according to the third embodiment. The board 200*b* includes, as well as the storage device 203 and the nine terminals 210 to 290, a resistive element 204 used for mounting detection of each of the cartridges.

A main control circuit 400 includes, like the first and second embodiments, a CPU 410 and a memory 420. A sub-control circuit 500*b* includes a memory control circuit 501 and a cartridge detection circuit 502.

The cartridge detection circuit 502 is a circuit for performing mounting detection of the cartridge in a cartridge mounting unit 1100. Therefore, the cartridge detection circuit 502 can also be called a "mounting detection circuit". The cartridge detection circuit 502 and the resistive element 204 of the cartridge are high-voltage circuits operating at a higher voltage (in this embodiment, rating 42V) than that of the storage device 203. The resistive element 204 is a device to which a high voltage is applied from the cartridge detection circuit 502.

Figure 22:
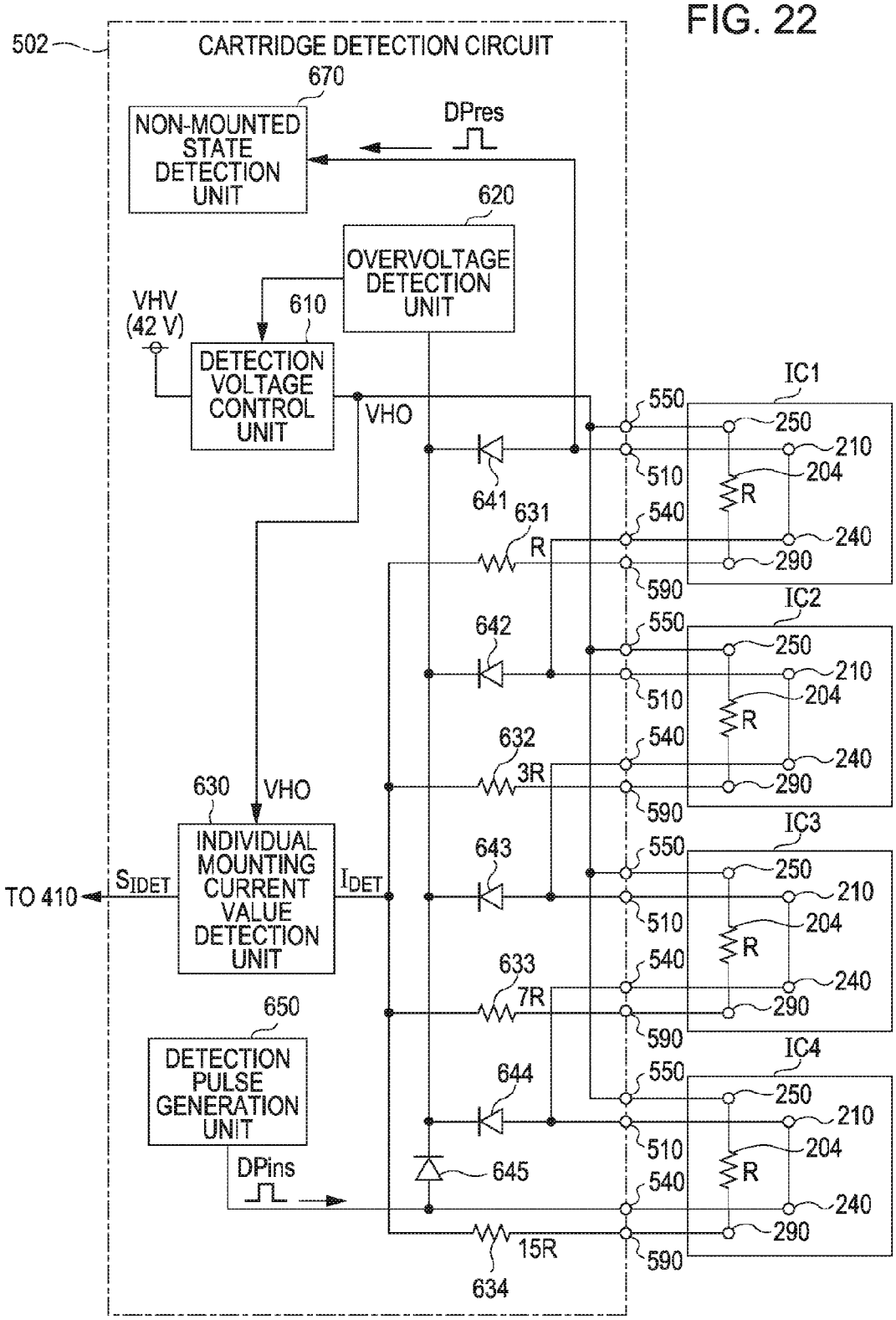
FIG. 22 is a diagram showing the internal configuration of a cartridge detection circuit according to the third embodiment.

FIG. 22 is a diagram showing the internal configuration of the cartridge detection circuit 502 according to the third embodiment. Here, a state where the four cartridges 100 are mounted in the cartridge mounting unit is shown, and reference numerals IC1 to IC4 are used for distinguishing the cartridges. The cartridge detection circuit 502 includes a detection voltage control unit 610, an overvoltage detection unit 620, an individual mounting current value detection unit 630, a detection pulse generation unit 650, and a non-mounted state detection unit 670. In the circuit, the overvoltage detection unit 620, the detection pulse generation unit 650, and the non-mounted state detection unit 670 have substantially the same configurations and functions as those of the circuit shown in FIG. 10. The detection voltage control unit 610 has a function of controlling a voltage supplied to the terminal 250 of the cartridge.

To the cartridge mounting circuit 502, a high power supply voltage VHV for mounting detection is supplied. The high power supply voltage VHV is a voltage for driving the printing head and is supplied from a second power supply 442 (FIG. 21) to the detection voltage control unit 610. An output terminal of the detection voltage control unit 610 is connected to four apparatus-side terminals 550 provided at mounting positions of the cartridges IC1 to IC4 in parallel. In addition, the high power supply voltage VHV is called a "high voltage VHV". The voltage value VHO of the output terminal of the detection voltage control unit 610 is also supplied to the individual mounting current value detection unit 630. Each of the apparatus-side terminals 550 is connected to the first mounting detection terminal 250 of the corresponding cartridge. In each of the cartridges, the resistive element 204 is provided between the first and second mounting detection terminals 250 and 290. The resistance values of the resistive elements 204 of the four cartridges IC1 to IC4 are set to the same value R. In the cartridge detection circuit 502, resistive elements 631 to 634 connected to the resistive elements 204 of the corresponding cartridges in series are provided.

In each of the cartridges, the first and second overvoltage detection terminals 210 and 240 are short-circuited by a wiring line. In addition, the overvoltage detection terminals 210 and 240 are connected to the overvoltage detection unit 620 via the apparatus-side terminals 510 and 540 and diodes 641 to 645 provided in the cartridge detection circuit 502. The connection relations between the terminals 210, 240, 510, and 540, the diodes 641 to 645, and the overvoltage detection unit 620 and the functions thereof are the same as those described in the second embodiment (FIG. 10).

Figure 23A:
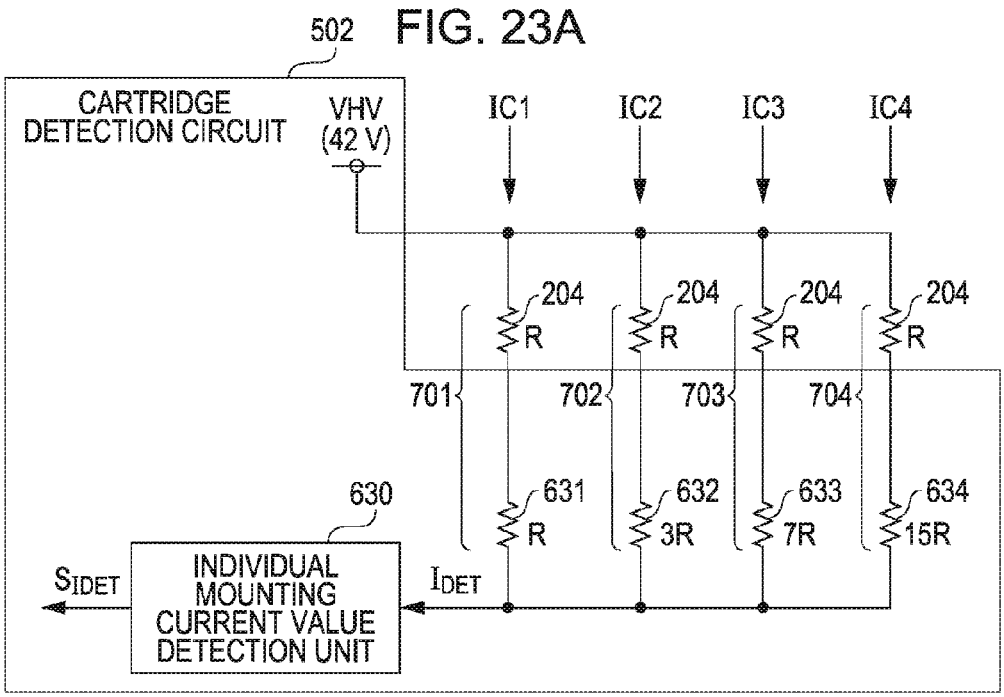
FIGS. 23A and 23B are explanatory views showing contents of a mounting detection process of the cartridges according to the third embodiment.
Figure 23B:
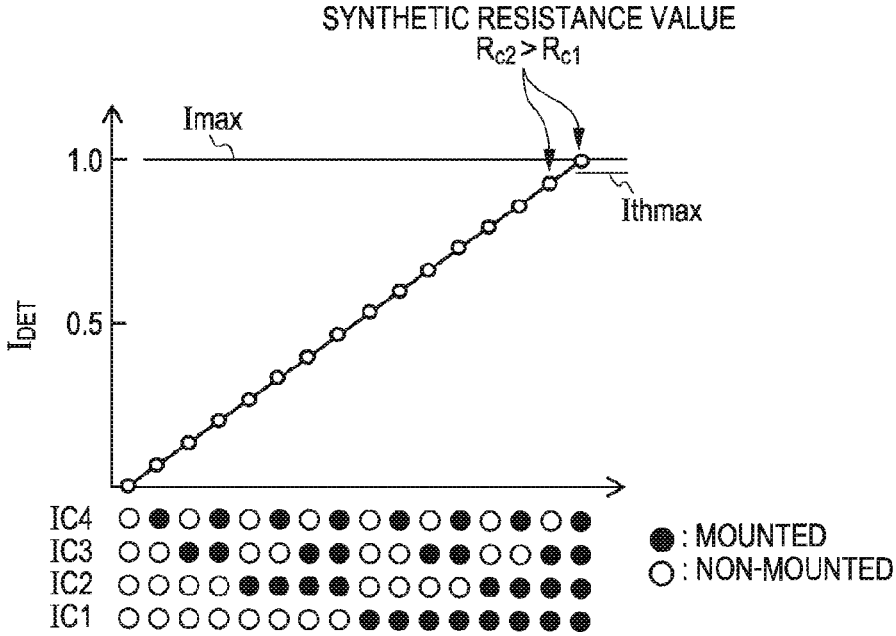

FIGS. 23A and 23B are explanatory views showing contents of the mounting detection process of the cartridges according to the third embodiment. FIG. 23A shows a state where the cartridges IC1 to IC4 which can be mounted in the cartridge mounting unit 1100 of the printing apparatus are all mounted. The resistance values of the resistive elements 204 of the four cartridges IC1 to IC4 are set to the same value R. In the cartridge detection circuit 502, the resistive elements 631 to 634 connected to the resistive elements 204 of the corresponding cartridges in series are provided. The resistance values of the resistive elements 631 to 634 are set to different values from each other. Specifically, from among the resistive elements 631 to 634, the resistance value of the resistive element 63*n* corresponding to the n-th (n=1 to 4) cartridge ICn is set to $(2^n-1)R$ (R is a constant value). As a result, by the series connection of the resistive element 204 in the n-th cartridge and the resistive element 63*n* of the cartridge detection circuit 502, a resistor having a resistance value of $2^nR$ is formed. The $2^nR$ resistors of the n-th (n=1 to N) cartridges are connected in parallel to the individual mounting current value detection unit 630. In addition, hereinafter, the series connection resistors 701 to 704 are called "resistors for mounting detection" or simply "resistors". A detection current $I_{DET}$ detected by the individual mounting current value detection unit 630 is a value of VHV/Rc obtained by dividing the voltage VHV by a synthetic resistance value Rc of the four resistors 701 to 704. Here, when the number of cartridges is assumed to be N, in the case where the N cartridges are all mounted, the detection current $I_{DET}$ is given by the following expression.

$$I_{DET} = \frac{VHV}{R_c} \tag{1}$$

$$R_c = R\frac{1}{\sum_{j=1}^{N}\frac{1}{2^j}} \tag{2}$$

When one or more cartridges are not mounted, corresponding to this, the synthetic resistance value Rc is increased, and the detection current $I_{DET}$ is reduced.

FIG. 23B shows a relationship between the mounted states of the cartridges IC1 to IC4 and the detection current $I_{DET}$. The horizontal axis in the figure represents 16 kinds of mounted states, and the vertical axis represents the values of the detection current $I_{DET}$ in these mounted states. The 16 kinds of mounted states correspond to 16 combinations obtained by arbitrarily selecting one to four from among the four cartridges IC1 to IC4. In addition, each individual combination is also called a "subset". The detection current $I_{DET}$ becomes voltage values that can uniquely identify the 16 kinds of mounted states. In other words, the resistance values of the four resistors 701 to 704 of the respective four cartridges IC1 to IC4 are set so that the 16 kinds of mounted states acquired by the four cartridges give different synthetic resistance values Rc.

When the four cartridges IC1 to IC4 are all in the mounted states, the detection current $I_{DET}$ becomes its maximum value Imax. On the other hand, when only the cartridge IC4 corresponding to the resistor 704 with the largest resistance value is in a non-mounted state, the detection current $I_{DET}$ becomes 0.93 times the maximum value Imax. Therefore, by examining whether or not the detection current $I_{DET}$ is equal to or higher than a threshold current Ithmax set in advance to be between the two current values, whether or not the four cartridges IC1 to IC4 are all mounted can be detected. In addition, the reason that the voltage VHV higher than the power supply voltage (about 3.3V) of a typical logic circuit is used for individual mounting detection is to widen the dynamic range of the detection current $I_{DET}$ and increase detection precision.

The individual mounting current value detection unit 630 converts the detection current $I_{DET}$ into a digital detection signal $S_{IDET}$ and transmits the digital detection voltage signal $S_{IDET}$ to the CPU 410 (FIG. 21). The CPU 410 can determine one from among the 16 kinds of the mounted states using the value of the digital detection signal $S_{IDET}$. When it is determined that one or more cartridges are not mounted, the CPU 410 displays information (text or images) indicating the non-mounted state on the display panel 430 to notify the user.

The mounting detection process of the cartridges described above, the fact that the synthetic resistance values Rc are uniquely determined depending on $2^N$ kinds of mounted states related to the N cartridges and accordingly the detection currents $I_{DET}$ are uniquely determined is used. Here, it is assumed that an allowable error of the resistance values of the resistors 701 to 704 is $\epsilon$. In addition, when it is assumed that the first synthetic resistance value of the state where all the cartridges IC1 to IC4 are mounted is $R_{c1}$ and the second synthetic resistance value of the state where only the fourth cartridge IC4 is not mounted is $R_{c2}$, $R_{c1}<R_{c2}$ is formed (FIG. 23B). It is preferable that the relationship $R_{c1}<R_{c2}$ be formed even in the case where the resistance values of the resistors 701 to 704 vary in the ranges of the allowable errors $\pm\epsilon$. Here, the worst condition is a case where, when the allowable error $\pm\epsilon$ is considered, the first synthetic resistance value $R_{c1}$ has its maximum value $R_{c1max}$ and the second synthetic resistance value $R_{c2}$ has its minimum value $R_{c2min}$. In order to identify the synthetic resistance values $R_{c1max}$ and $R_{c2min}$ from each other, a condition of $R_{c1max}<R_{c2min}$ may be satisfied. From the condition $R_{c1max}<R_{c2min}$, the following expression is derived.

$$\varepsilon < \frac{1}{4(2^{N-1}-1)} \tag{3}$$

That is, when the allowable error $\pm\epsilon$ satisfies Expression (3), the synthetic resistance values Rc are always uniquely determined depending on the mounted states of the N cartridges, and accordingly, it can be guaranteed that the detection currents $I_{DET}$ are uniquely determined. Here, it is preferable that the allowable error of the resistance value in actual design be set to a value smaller than the value of the right side of Expression (3). In addition, without the above-described examination, the allowable error of the resistance values of the resistors 701 to 704 may be set to a sufficiently small value (for example, a value equal to or lower than 1%).

Figure 24:
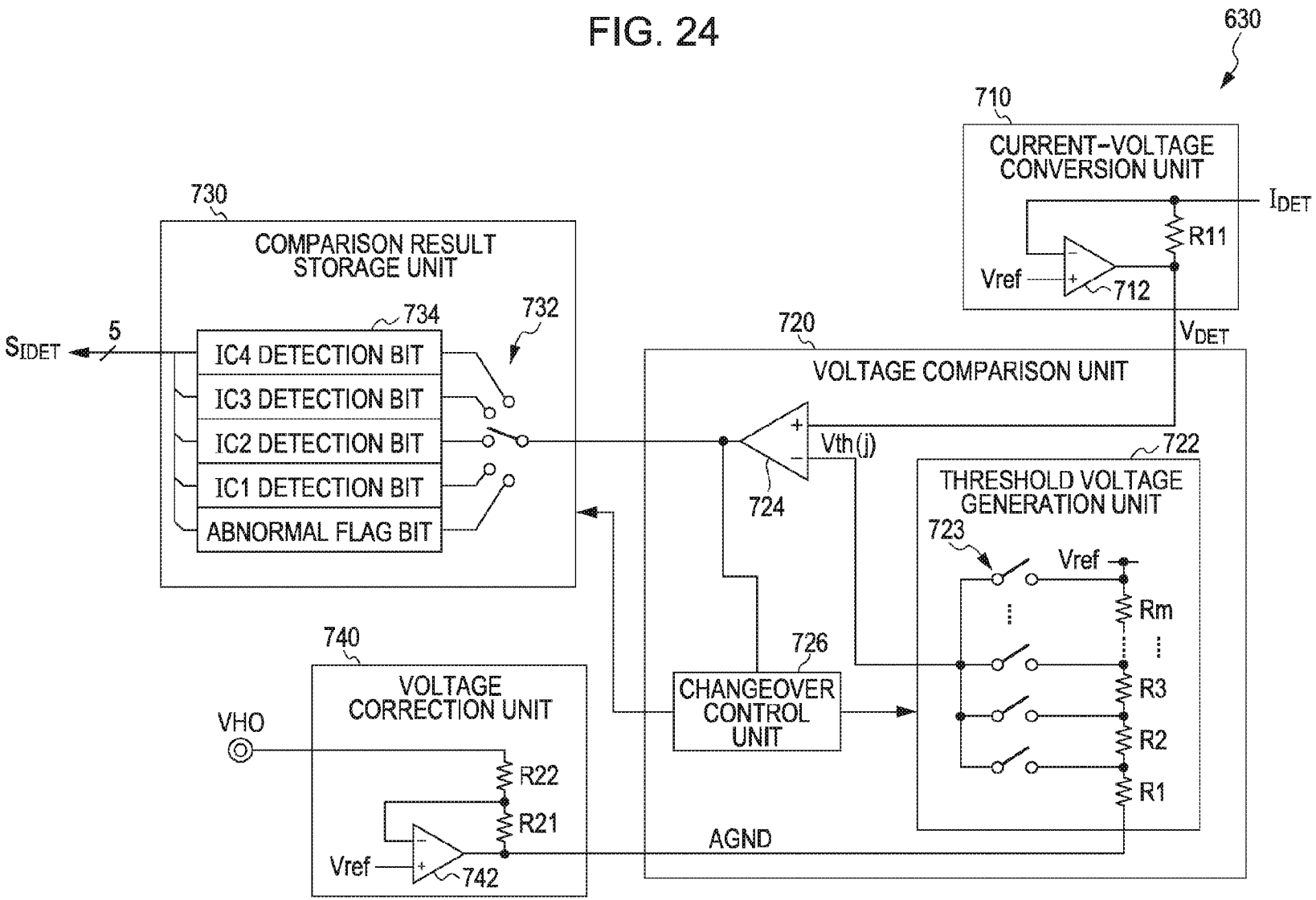
FIG. 24 is a diagram showing the internal configuration of an individual mounting current value detection unit according to the third embodiment.

FIG. 24 is a diagram showing the internal configuration of the individual mounting current value detection unit 630. The individual mounting current value detection unit 630 includes a current-voltage conversion unit 710, a voltage comparison unit 720, a comparison result storage unit 730, and a voltage correction unit 740.

The current-voltage conversion unit 710 is an inverting amplifier circuit configured of an operational amplifier 712 and a feedback resistor R11. An output voltage $V_{DET}$ of the operational amplifier 712 is given by the following expression.

$$V_{DET} = Vref - I_{DET} \cdot R11 \tag{4}$$

$$= Vref - (VHO - Vref)\frac{R11}{Rc}$$

where VHO is the output voltage of the detection voltage control unit 610 (FIG. 22) and Rc is the synthetic resistance of the four resistors 701 to 704 (FIG. 23A). The output voltage $V_{DET}$ has a voltage value representing the detection current $I_{DET}$.

In addition, the voltage $V_{DET}$ given by Expression (4) represents a value obtained by inverting a voltage ($I_{DET}$•R11) due to the detection current $I_{DET}$. There, an inverting amplifier may be added to the current-voltage conversion unit 710 to output the voltage obtained by inverting the voltage $V_{DET}$ using the added inverting amplifier as the output voltage of the current-voltage conversion unit 710. It is preferable that the absolute value of the amplification factor of the added inverting amplifier be 1.

The voltage comparison unit 720 includes a threshold voltage generation unit 722, a comparator 724 (operational amplifier), and a changeover control unit 726. The threshold voltage generation unit 722 selects and outputs one from among a plurality of threshold voltages Vth(j) obtained by dividing a reference voltage Vref by a plurality of resistances R1 to Rm using a changeover switch 723. The plurality of threshold voltages Vth(j) corresponds to thresholds that identify the values of the detection currents $I_{DET}$ in the 16 kinds of mounted states shown in FIG. 23B. The comparator 724 compares the output voltage $V_{DET}$ of the current-voltage conversion unit 710 to the threshold voltage Vth(j) output from the threshold voltage generation unit 722 and outputs a binary comparison result. The binary comparison result represents whether or not the individual cartridges IC1 to IC4 are mounted. That is, the voltage comparison unit 720 examines whether or not the individual cartridges IC1 to IC4 are mounted and sequentially outputs the comparison results. In a typical example, the voltage comparison unit 720 first examines whether or not the first cartridge IC1 corresponding to the largest resistor 701 (FIG. 23A) is mounted, and outputs a bit value representing the comparison result. Thereafter, whether or not the second to fourth cartridges IC2 to IC4 are mounted is sequentially examined, and bit values representing the comparison results are output. The changeover control unit 726 performs control for changing over the voltage value Vth(j) to be output from the threshold voltage generation unit 722 for mounting detection of the next cartridge on the basis of the comparison result for each of the cartridges.

The comparison result storage unit 730 stores the binary comparison results output from the voltage comparison unit 720 in appropriate bit positions in bit registers 734 by changing over the results using the changeover switch 732. A changeover timing of the changeover switch 732 is designated from the changeover control unit 726. The bit registers 734 have N (here, N=4) cartridge detection bits representing existence of mounting of the individual cartridges that can be mounted in the printing apparatus, and abnormal flag bits representing that abnormal current values are detected. The abnormal flat bit becomes an H level when a current that is considerably higher than the current value Imax (FIG. 23B) flows in the state where all the cartridges are mounted. Here, the abnormal flat bits may also be omitted. The plurality of bit values stored in the bit registers 734 are sent to the CPU 410 (FIG. 21) of the main control circuit 400 as the digital detection signal $S_{IDET}$ (detection current signal). The CPU 410 determines whether or not the individual cartridges are mounted from the bit value of the digital detection signal $S_{IDET}$. As described above, in the third embodiment, the four bit values of the digital detection signal $S_{IDET}$ represents whether or not the individual cartridges are mounted. Therefore, the CPU 410 can immediately determine whether or not the individual cartridges are mounted from the individual bit values of the digital detection signal $S_{IDET}$.

The voltage comparison unit 720 and the comparison result storage unit 730 constitute a so-called A-D conversion unit. As the A-D conversion unit, instead of the voltage comparison unit 720 and the comparison result storage unit 730 shown in FIG. 24, other well-known configurations may be employed.

The voltage correction unit 740 is a circuit for correcting the plurality of threshold voltages Vth(j) generated by the threshold voltage generation unit 722 to follow the variation of the high voltage VHV (FIG. 22) for mounting detection. The voltage correction unit 740 is configured as an inverting amplifier circuit configured of an operational amplifier 742 and two resistors R21 and R22. To the inverting input terminal of the operational amplifier 742, the output terminal voltage VHO of the detection voltage control unit 610 of FIG. 22 is input via the input resistor R22, and to the non-inverting input terminal thereof, a reference voltage Vref is input. Here, the output voltage AGND of the operational amplifier 742 is given by the following expression.

$$AGND = Vref - (VHO - Vref)\frac{R21}{R22} \tag{5}$$

The voltage AGND is used as the reference voltage AGND on the low voltage side of the threshold voltage generation unit 722. For example, assuming that Vref=2.4 V, VHO=42 V, R21=20 kΩ, and R22=400 kΩ, AGND=0.42 V is obtained. As understood by comparing Expressions (4) and (5) described above to each other, the reference voltage AGND of the low voltage side of the threshold voltage generation unit 722 varies in response to the value of the output voltage VHO of the detection voltage control unit 610 (that is, the high-voltage power supply VHV for mounting detection), like the detection voltage value $V_{DET}$. The difference between the two voltages AGND and $V_{DET}$ is caused from the difference between the resistance ratios R21/R22 and R11/Rc. When the voltage correction unit 740 is used, even though the power supply voltage VHV for mounting detection varies for some reasons, the plurality of threshold voltages Vth(j) generated by the threshold voltage generation unit 722 varies in response to the variation of the power supply voltage VHV. As a result, both the detection voltage value $V_{DET}$ and the plurality of threshold voltages Vth(j) are changed in response to the variation of the power supply voltage VHV, so that comparison results showing accurate mounted states can be obtained by the voltage comparison unit 720. In particular, when the resistance ratio R21/R22 and the resistance ratio R11/$R_{c1}$ ($R_{c1}$ is a synthetic resistance value when all the cartridges are mounted) are set to have the same value, it is possible to cause the detection voltage value $V_{DET}$ and the plurality of threshold voltages Vth(j) to accurately follow the variation of the power supply voltage VHV to be varied with substantially the same variation width. Here, the voltage correction unit 740 may be omitted.

Figure 25:
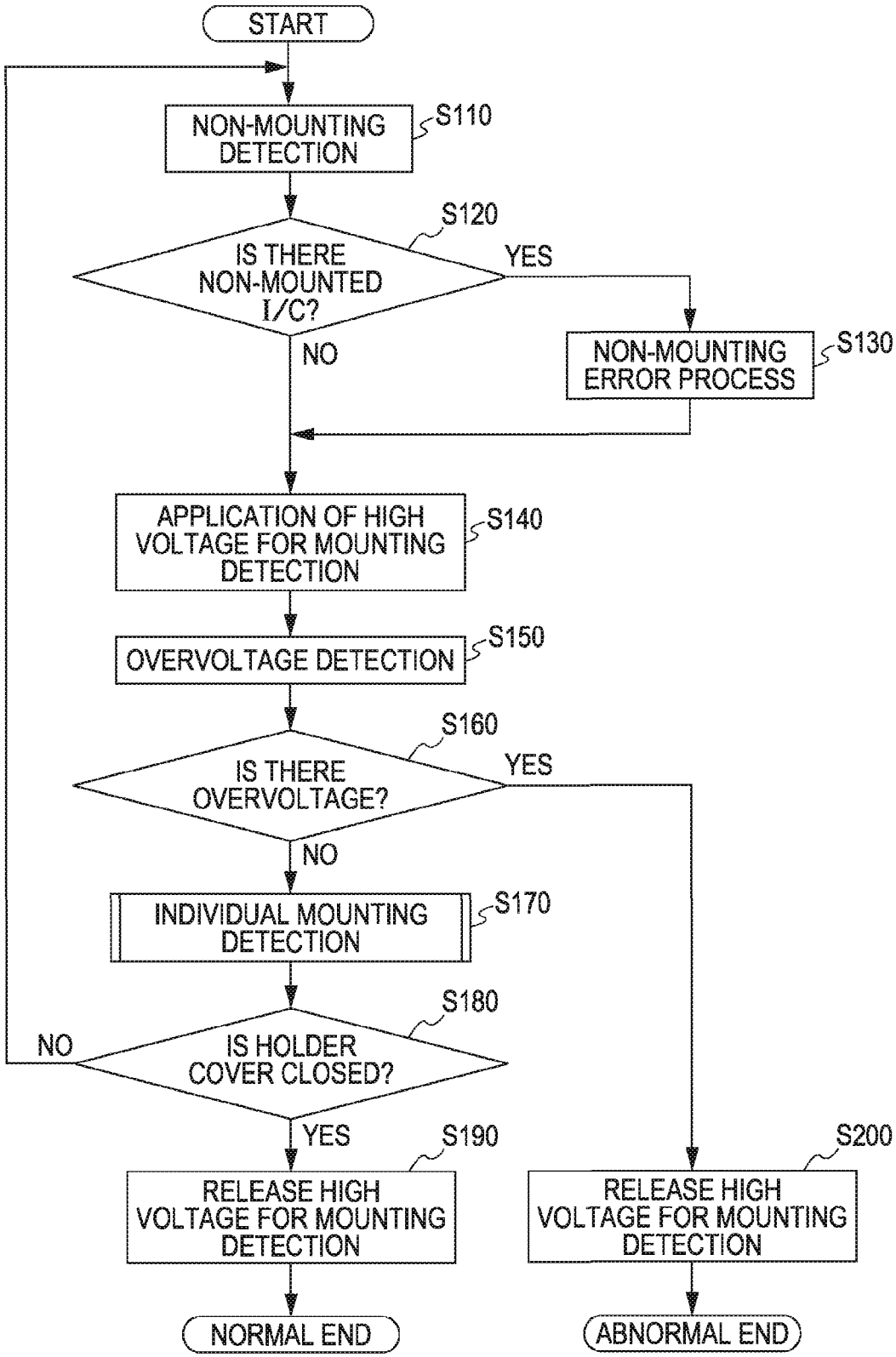
FIG. 25 is a flowchart showing the entire order of the mounting detection process according to the third embodiment.

FIG. 25 is a flowchart showing the entire order of the mounting detection process performed by the cartridge detection circuit 502. The mounting detection process is started when the cover 1200 (FIG. 1) of the cartridge mounting unit 1100 is opened. In this process, the storage device 203 of each cartridge is maintained not in an electrically connected state (a state where the power supply voltage VDD is not supplied).

In Steps S110 and S120, the non-mounted state detection process described with reference to FIG. 25 is performed. As a result, when all the cartridges are mounted, the process proceeds to S140 described later from Step S120. On the other hand, when one or more cartridges are not mounted, in Step S130, the main control circuit 400 performs a non-mounting error process. The non-mounting error process is, for example, a process for displaying a notification such as "cartridge is not correctly mounted" (a notification having the intent that there is a non-mounted cartridge) on the display panel 430. In Step S140, the detection voltage control unit 610 (FIG. 22) of the cartridge detection circuit 502 applies the high voltage VHV (42 V) for mounting detection to a device (in this embodiment, the resistive element 204) for mounting detection of the cartridge. In Steps S150 and S160, the overvoltage detection unit 620 detects whether or not an overvoltage is generated. When an overvoltage is generated, in Step S200, the overvoltage detection unit 620 notifies the detection voltage control unit 610 of the generation of the overvoltage and stops supplying the high voltage VHV. In this case, the intent that the overvoltage is generated, an instruction to perform an operation of detaching the cartridge once and re-inserting, or the like may be displayed on the display panel 430. On the other hand, when an overvoltage is not generated, the process proceeds to Step S170 from Step S160, and the individual mounting detection process of the cartridge described with reference to FIGS. 23A to 24 is performed. The individual mounting detection process is a high-voltage process for supplying a high-voltage signal (42 V) having a higher voltage level than the power supply voltage (3.3 V) for the storage device to the resistive element 204 via the terminals 250 and 290. Similarly, in the individual mounting detection process in Step S170, when one or more cartridges are not mounted, the determination results (the kind of non-mounted cartridge) may be displayed on the display panel 430. For example, as the determination result, a non-mounted position from among mounting positions of the plurality of cartridges, the kind of cartridge to be mounted at the non-mounted position (for example, a yellow cartridge) may be displayed.

When the individual mounting detection process is ended, the process returns to Step S180 of FIG. 8 to determine whether or not the cover 1200 of the cartridge mounting unit 1100 is closed. When the cover 1200 is not closed, the process returns to Step S110 from Step S180, and the process after Step S110 described above is performed again. On the other hand, when the cover 1200 is closed, in Step S190, the detection voltage control unit 610 stops supplying the high voltage VHV and the process is completed.

As described above, even in the third embodiment, like the first and second embodiments, the contact portions of the mounting detection terminals are provided at four corners in the periphery of the contact portions of the plurality of terminals for the storage device of the board, and more specifically, the four corners of the quadrangular region which is on the outside of the region where the plurality of terminals for the storage device of the board are disposed and includes the region, by confirming that the apparatus-side terminals corresponding to the mounting detection terminals are in a good contact state, it is possible to guarantee a good contact state even regarding the terminals for storage device.

As such, in the third embodiment, since the non-mounted state of the individual cartridges is displayed on the display panel 430 in the middle of the replacement of the cartridge, so that the user can perform the cartridge replacement while seeing the display. In particular, when the cartridge is replaced, the intent that the cartridge is changed from the non-mounted state to the mounted state is displayed on the display panel 430, so that a user who is unaccustomed to the cartridge replacement operation can proceed to the next operation without anxiety. In addition, in the third embodiment, the mounting detection of the cartridge can be performed while the storage device 203 of the cartridge is not in the electrically connected state, so that it is possible to prevent generation of a bit error that occurs due to so-called hot swapping of the storage device (regardless of whether or not the storage device of the cartridge is connected to the apparatus-side terminal of the printing apparatus, the memory control circuit of the printing apparatus access the storage device of the storage, and during the access, the cartridge is mounted or detached).

D. Fourth Embodiment

Figure 26:
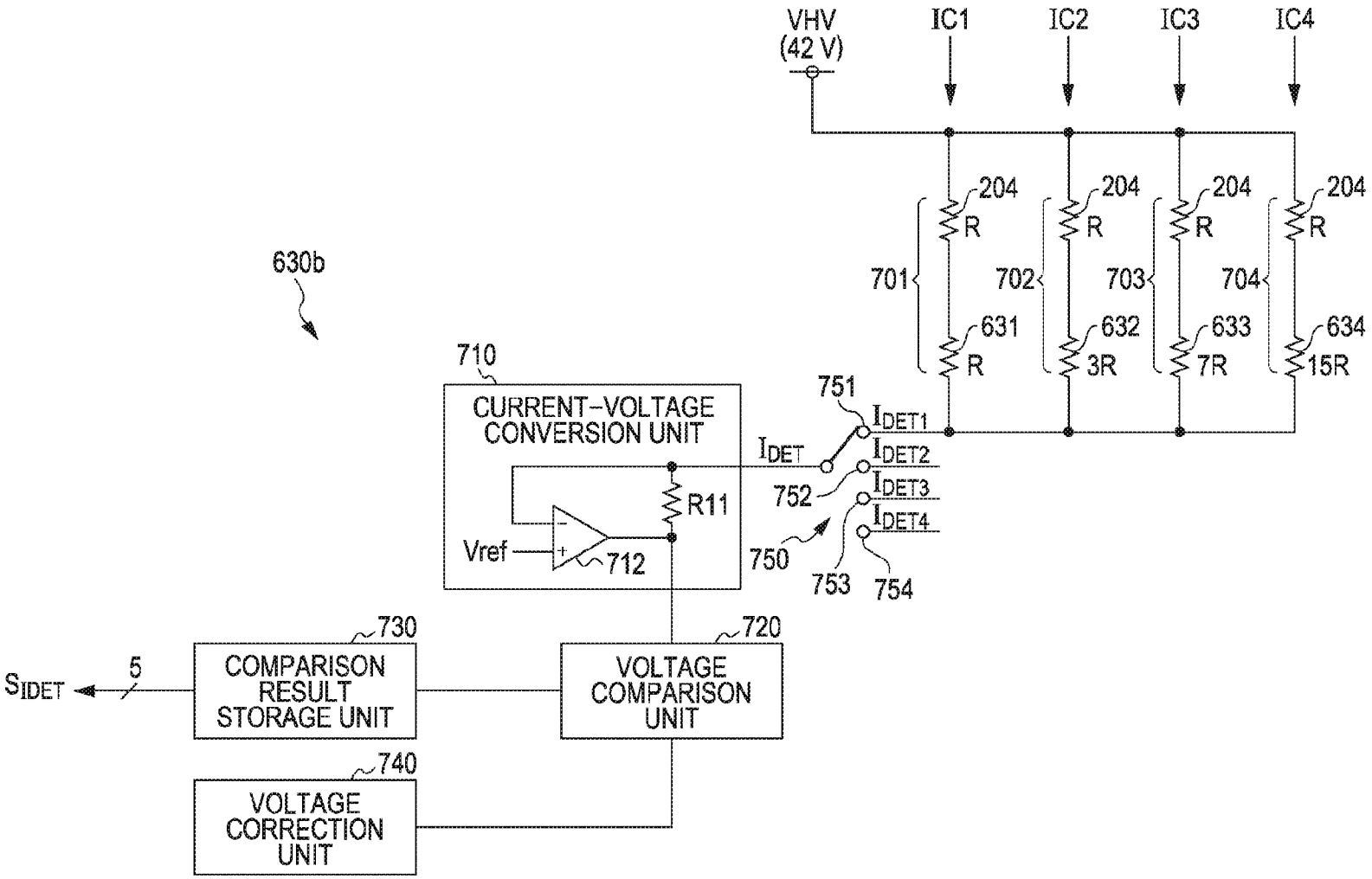
FIG. 26 is a diagram showing the configuration of an individual mounting current value detection unit according to a fourth embodiment.

FIG. 26 is a diagram showing the configuration of an individual mounting detection unit 630*b* according to a fourth embodiment. The individual mounting detection unit 630*b* is configured by adding an input changeover switch 750 to the individual mounting detection unit 630 of the third embodiment shown in FIG. 24. The input changeover switch 750 is for selecting any of detection currents $I_{DET1}$ to $I_{DET4}$ input from a plurality of input terminals 751 to 754 and inputting the selected current to the current-voltage conversion unit 710. To the first input terminal 751, the detection current $I_{DET1}$ flowing a parallel connection of the resistors 701 to 704 as shown in FIG. 23A is input. Similarly, to the other input terminals 752 to 754, the detection current $I_{DET2}$ to $I_{DET4}$ flowing the parallel connection corresponding to each of four or less cartridges are input. In addition, since the other circuit elements 710 to 740 are the same as those of FIG. 24, illustration of the internal configuration thereof is omitted in FIG. 26.

When the input changeover switch 750 is provided, even in the printing apparatus in which a number of cartridges are mounted, as described above, mounting detection of the individual cartridges can be performed.

E. Another Embodiment

Figure 27:
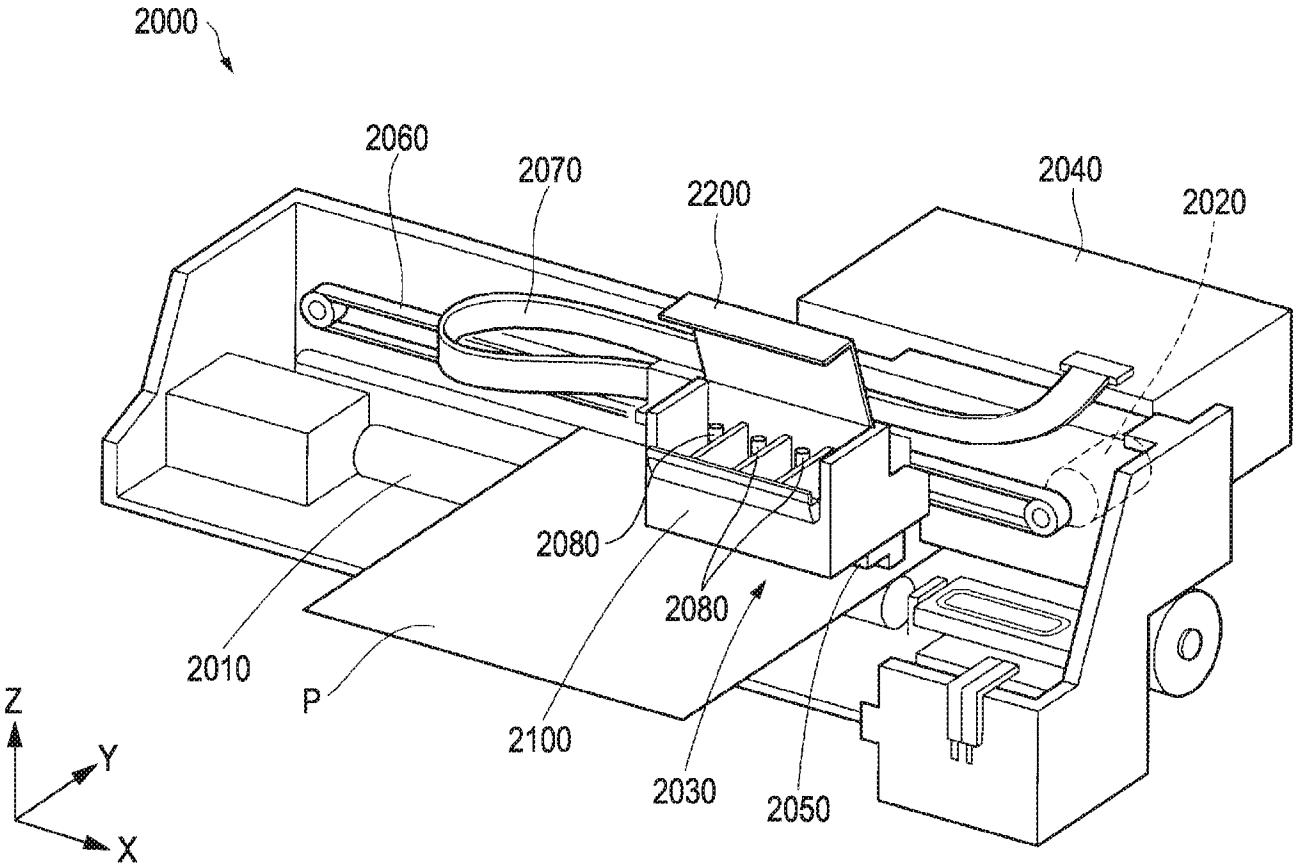
FIG. 27 is a perspective view showing the configuration of a printing apparatus according to another embodiment.

FIG. 27 is a perspective showing the configuration of a printing apparatus according to another embodiment of the invention. In FIG. 27, for convenience of description, the X, Y, and Z axes which are orthogonal to each other are illustrated. The printing apparatus 2000 is a small-format ink jet printer for individual uses and includes a sub-scanning feed mechanism, a main scanning feed mechanism, and a head driving mechanism. The sub-scanning feed mechanism transports a printing sheet P in a sub-scanning direction using a paper feed roller 2010 using a paper feed motor (not shown) as a drive power. The main scanning feed mechanism reciprocates a carriage 2030 connected to a drive belt 2060 in a main scanning direction using a drive power of a carriage motor 2020. The head driving mechanism drives a printing head 2050 provided in the carriage 2030 to perform ink discharge and dot formation. The printing apparatus 2000 further includes a main control circuit 2040 that controls the above-mentioned mechanisms. The main control circuit 2040 is connected to the carriage 2030 via a flexible cable 2070. The control circuit 2040 is a circuit including the main control circuit 400 and the sub-control circuit 500 in the first to third embodiments.

The carriage 2030 includes a cartridge mounting unit 2100 and the printing head 2050. The cartridge mounting unit 2100 is configured so that a plurality ink cartridges can be mounted therein and is disposed on the upper side of the printing head 2050. The cartridge mounting unit 2100 is also called a "holder". In the example shown in FIG. 27, four ink cartridges can be independently mounted in the cartridge mounting unit 2100, and for example, black, yellow, magenta, and cyan, that is, four kinds of ink cartridges are mounted, one for each color. A cartridge mounting direction is a −Z direction (vertically downward direction). In addition, as the cartridge mounting unit 2100, one that includes a plurality of other arbitrary kinds of cartridges mounted therein can be used. A cover 2200 is mounted on the cartridge mounting unit 2100 so as to be opened or closed. The cover 2200 can be omitted. An ink supply tube 2080 for supplying ink to the printing head 2050 from the cartridge is disposed at the upper portion of the printing head 2050. Like the printing apparatus 2000, a type of printing apparatus in which a cartridge replaced by the user is mounted on a cartridge mounting unit provided on a carriage of a printing head is called an "on-carriage type".

Figure 28:
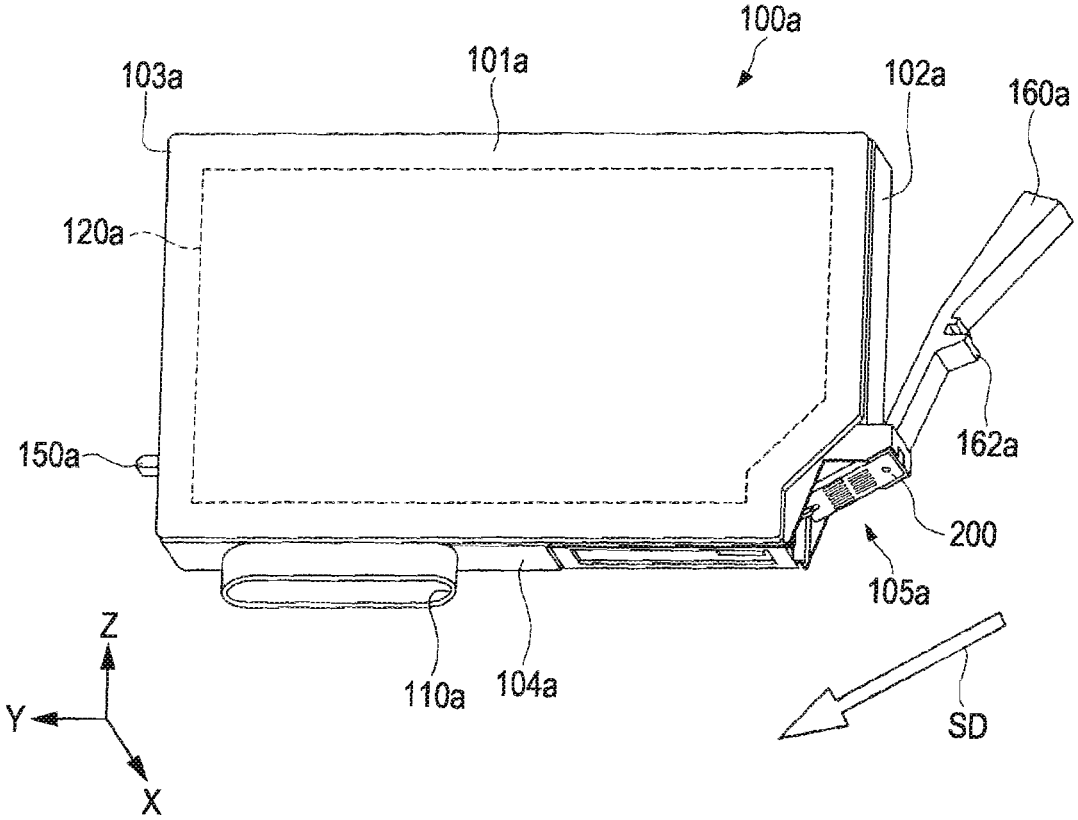
FIG. 28 is a perspective view showing the configuration of an ink cartridge according to another embodiment.

FIG. 28 is a perspective view showing the configuration of a cartridge 100*a* according to this embodiment. The X, Y, and Z axes of FIG. 28 correspond to the X, Y, and Z axes of FIG. 27, respectively. The cartridge 100*a* includes a housing 101*a* that stores ink and a board 200 (also called a "circuit board"). As the board, the same board as illustrated in FIGS. 3A to 3C, 8, and 20 described above can be used. An ink chamber 120*a* that stores the ink is formed inside the housing 101*a*. The housing 101*a* has an overall shape of a substantially rectangular parallelepiped. A first side surface 102*a* of the housing 101*a* is provided with a lever 160*a*. The lever 160*a* is used for attaching or detaching the cartridge 100*a* to or from the cartridge mounting unit 2100. That is, as the user pushes the lever 160*a*, the cartridge 100*a* and the cartridge mounting unit 2100 can be mechanically engaged to each other, or the engagement can be released. The lever 160*a* is provided with an engagement protrusion 162*a*. In a bottom surface 104*a* of the housing 101*a*, an ink supply opening 110*a* is formed which is connected to the ink supply tube 2080 of the printing apparatus when the cartridge 100*a* is mounted in the cartridge mounting unit 2100. In a state before use, the opening of the ink supply opening 110*a* may be sealed by a film. At a position where the first side surface 102*a* and the bottom surface 104*a* intersect (that is, a corner portion of the lower end of the housing 101*a*), a board installation portion 105*a* having a shape of an inclined surface is formed, and the board 200 is installed on the board installation portion 105*a*. In addition, it can be thought that the board installation portion 105*a* is provided in the vicinity of the lower end of the first side surface 102*a*. A second side surface 103*a* which opposes the first side surface 102*a* is provided with an engagement protrusion 150*a*. In addition, it is preferable that in the cartridge 100*a* and the carriage mounting unit 2100, a sensor mechanism for electrically or optically detecting the amount of ink remaining in the cartridge 100*a* be provided, but illustration thereof is omitted here. The first surface 102*a* is a surface facing the front side (−Y direction) when the cartridge 100*a* is mounted in the printing apparatus 2000 (FIG. 27). Therefore, the first side surface 102*a* is also called a "front end surface" or a "front surface". In addition, the second side surface 103*a* is also called a "rear end surface" or a "rear end".

When the cartridge 100*a* is mounted in the cartridge mounting unit 2100, a direction perpendicular to the opening surface (a surface in parallel to the Y axis) of the ink supply opening 101*a* is the Z-axis direction (vertical direction). Here, with regard to the circuit board 200 provided in the inclined surface, a direction toward the ink supply opening 101*a* in parallel to the surface of the circuit board 200 is referred to as an inclined surface direction SD. With regard to the circuit board 200, when it is assumed that the inclined surface direction SD is the same direction as the mounting direction SD of the board shown in FIGS. 3A to 3C, 8 and 20, it can be understood that distinguishment between the upper side row terminal group, the upper side row terminal contact portion group, the lower side row terminal group, and the lower side row contact portion group with respect to the mounting direction SD in FIGS. 3A to 3C, 8, and 20 can be applied to the board 200 of the ink cartridge 100*a* of FIG. 28 as it is. Therefore, the inner side row of the inclined surface direction SD, that is, a row closer to the ink supply opening 101*a* of the circuit board 200 is the lower side row terminal group 250 to 290 and the lower side row terminal contact portion group. A row on the front side of the inclined surface direction SD, that is, a row more distant from the ink supply opening 101*a* of the circuit board 200 is the upper side row terminal group 210 to 240 and the upper side row terminal contact portion group.

Figure 29:
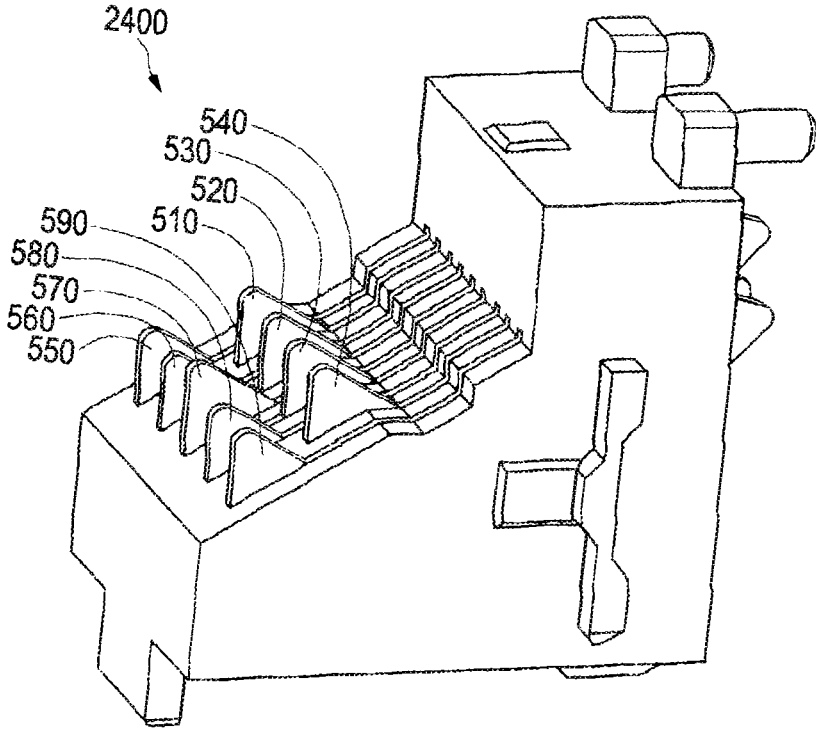
FIG. 29 is a perspective view of a contact point mechanism provided in a cartridge mounting unit.

FIG. 29 is a perspective view of a contact point mechanism 2400 provided in the cartridge mounting unit 2100. The contact point mechanism 2400 is provided with a plurality of electric contact members 510 to 590. The plurality of electric contact members 510 to 590 correspond to the apparatus-side terminals corresponding to the respective terminals 210 to 290 of the board 200. Each of the apparatus-side terminals 510 to 590 is formed of an elastically deformable member (elastic member) and urges the circuit board 200 upward while the cartridge is mounted. In addition, the terminal 570 at the center of the lower side row has a higher upward protruding height than the other terminals. Therefore, when the cartridge 100*a* is mounted in the cartridge mounting unit 2100, the terminal 570 comes in contact with the terminal of the board earlier than the other terminals. In other words, from among the terminals 210 to 290 (in FIGS. 3A to 3C) of the board 200, the ground terminal 270 comes in contact with the apparatus-side terminal earlier than the other terminals.

Figure 30:
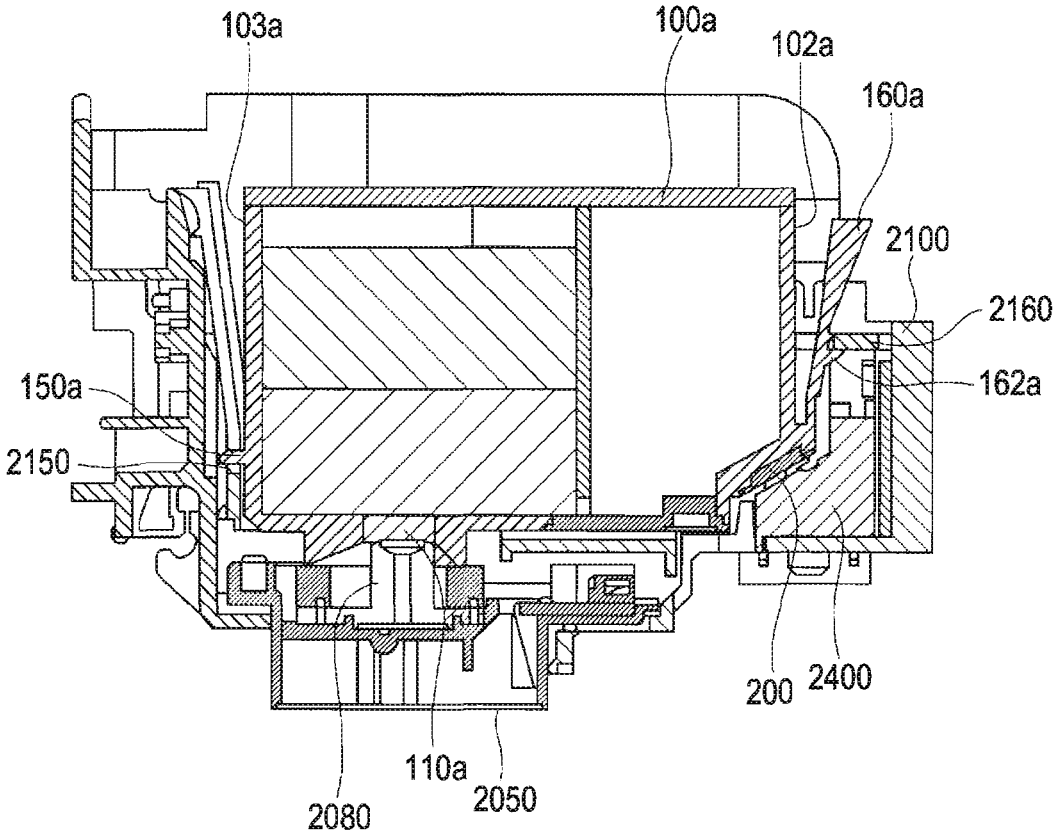
FIG. 30 is a cross-sectional view of main parts showing a state where an ink cartridge is mounted in the cartridge mounting unit.

FIG. 30 shows a state where the cartridge 100*a* is mounted in the cartridge mounting unit 2100. In this state, the apparatus-side terminals 510 to 590 (FIG. 29) of the contact point mechanism 2400 can be pushed down by the board 200 of the cartridge 100*a*, and the entirety of the apparatus-side terminals 510 to 590 urge the cartridge 100*a* upward. In addition, the engagement protrusion 150*a* provided in the second side surface 103*a* of the cartridge 100*a* is inserted into an engagement hole 2150 of the cartridge mounting unit 2100. Moreover, the engagement protrusion 162*a* of the lever 160*a* provided in the first side surface 102*a* of the cartridge 100*a* is engaged with the lower surface of an engagement member 2160 of the cartridge mounting unit 2100. The lever 160*a* is formed of an elastic material and a bending stress occurs therein to return the lever 160*a* to the right of FIG. 30. By the engagement between the engagement protrusion 162*a* and the engagement member 2160, the cartridge 100*a* is prevented from being pushed out upward. During a normal insertion, first, the engagement protrusion 150*a* provided in the first surface 102*a* of the cartridge 100*a* is inserted into the engagement hole 2150 of the cartridge mounting unit 2100. Thereafter, about the engagement protrusion 150*a* as a fulcrum, the front end side (a side of the front end surface 102*a*) of the cartridge 100*a* is pushed downward, and then the engagement protrusion 162*a* of the lever 160*a* provided in the front end surface 102*a* of the cartridge 100*a* is engaged with the lower surface of the engagement member 2160 of the cartridge mounting unit 2100, whereby the insertion is ended.

In the state where the cartridge 100*a* is appropriately mounted, the apparatus-side terminals 510 to 590 (FIG. 29) of the contact point mechanism 2400 and the terminals 210 to 290 of the board 200 of the cartridge 100*a* come in contact in a good contact state. In addition, the ink supply opening 110*a* of the cartridge 100*a* is connected to the ink supply tube 2080 of the printing head 2050. Here, in order to facilitate mounting of the cartridge 100*a*, there is a slight play inside the cartridge mounting unit 2100, so that there may be cases where the cartridge 100*a* is inserted while being slightly inclined. When the cartridge is inclined, there is a possibility of a loose contact occurring in several terminals.

Figure 31C:
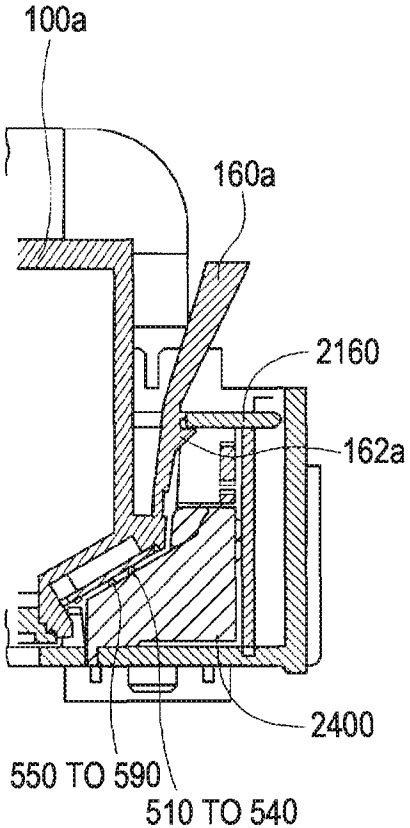
FIGS. 31A to 31C are explanatory views showing progress in which an apparatus-side terminal comes in contact with a terminal of a board during mounting of the cartridge.
Figure 31B:
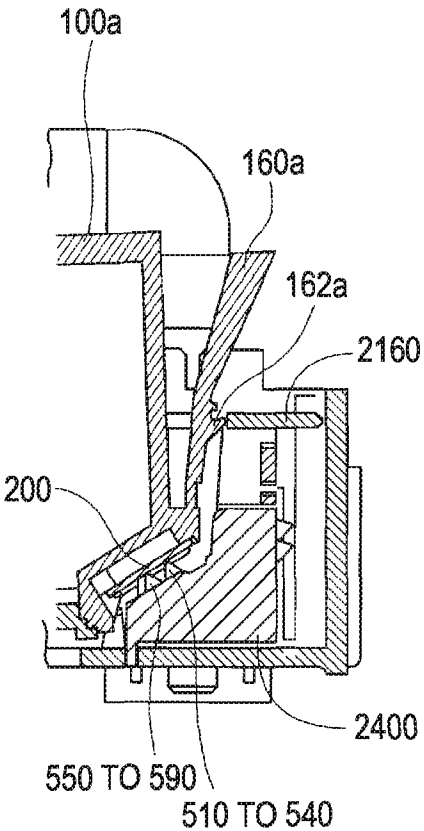
Figure 31A:
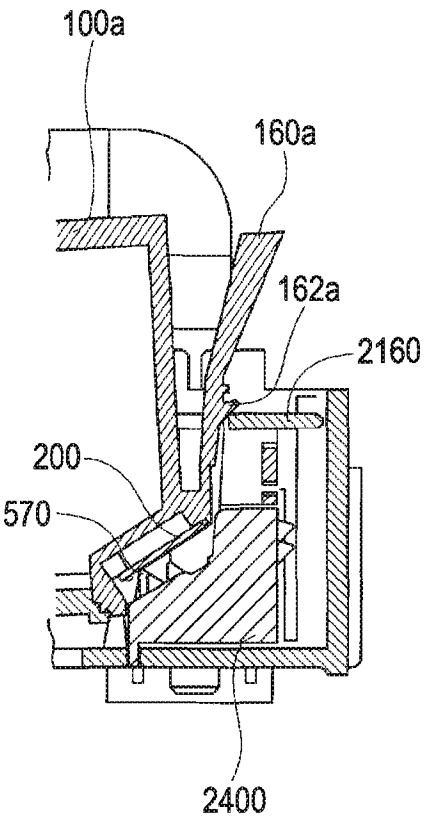

FIGS. 31A to 31C are explanatory views showing progress in which an apparatus-side terminals 510 to 590 come in contact with a terminal of a board 200 during mounting of the cartridge. In addition, at a time point before those of FIGS. 31A to 31C, the engagement protrusion 150*a* (FIG. 30) provided in the rear end surface (the left end in the figure) of the cartridge 100*a* is inserted into the engagement hole 2151 of the cartridge mounting unit 2100; however, illustration thereof is omitted. FIG. 13A shows a state where only the single terminal 570 from among the apparatus-side terminals 510 to 590 comes in contact with the ground terminal of the board 200. As described above, the apparatus-side terminal 570 has a higher protruding height than the other terminals 510 to 560, 580, and 590, so that in the state where only the apparatus-side terminal 570 comes in contact with the terminal of the board 200, the other apparatus-side terminals do not come in contact with the terminals of the board 200. Thereafter, when the user further pushes the cartridge 100*a*, as shown in FIG. 31B, the other apparatus-side terminals 510 to 560, 580, and 590 also come in contact with the terminals of the board 200. In addition, when the user further pushes the cartridge 100*a*, as shown in FIG. 31C, the cartridge 100*a* is in a completely mounted. Here, the engagement protrusion 162*a* of the lever 160*a* is engaged with the lower surface of the engagement member 2160 of the cartridge mounting unit 2100 to prevent an upward movement of the cartridge 100*a*.

However, in the state from FIG. 31A until FIG. 31B, from the nine apparatus-side terminals 510 to 570, only the single terminal 570 exerts upward force on the cartridge 100*a*. The apparatus-side terminal 570 comes in contact with the terminal 270 (FIGS. 3A to 3C) at the center of the board 200 and comes in contact therewith the substantially center position of the width (the dimension of the direction perpendicular to the inclined surface direction SD) of the board 200. However, in order to enhance mounting facilitation of the cartridge, there is a slight play between the holder (cartridge mounting unit) and the cartridge, so that it is extremely rare for the apparatus-side terminal 570 at the center to accurately come in contact with the center of the width of the board 200, and in general, the apparatus-side terminal 570 comes in contact at a position slightly deviating from the center of the width of the board 200. When the apparatus-side terminal 570 slightly deviates from the center of the width of the board 200 to the left or right, in the state from FIG. 31A until FIG. 31B, the upward urging force by the apparatus-side terminal 570 is exerted non-uniformly in the width direction (a direction perpendicular to the inclined surface direction SD of FIG. 28 and parallel to the terminal row) of the board 200 and the cartridge 100*a*. As a result, the cartridge 100*a* or the board 200 is inclined in the width direction. In addition, in a state from FIG. 31B until FIG. 31C, the displacement of the apparatus-side terminal 570 is greater than the displacements of the other apparatus-side terminals. Therefore, when materials having the same spring constant are used for all the apparatus-side terminals 510 to 590, the apparatus-side terminal 570 exerts a higher urging force than those of the other apparatus-side terminal on the cartridge 100*a*. As a result, for the same reason described above, the cartridge 100*a* or the board 200 is inclined in the width direction. As such, even in the printing apparatus 2000 and the cartridge 100*a* shown in FIGS. 27 and 28, there is a tendency of the cartridge 100*a* and the board 200 to be easily inclined. Therefore, it can be understood that it is significantly important to perform the detection process of the loose contact of the terminals described in the various embodiments described above.

Figure 32A:
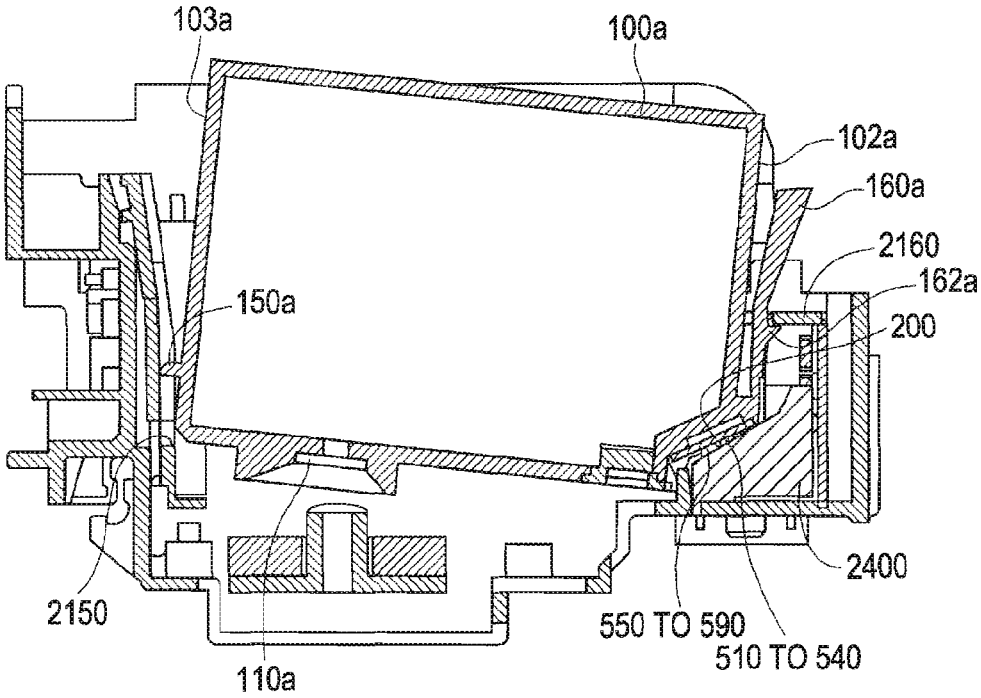
FIGS. 32A and 32B are explanatory views showing progress in which a front end surface of the cartridge is engaged first and then a rear end surface thereof is engaged.
Figure 32B:
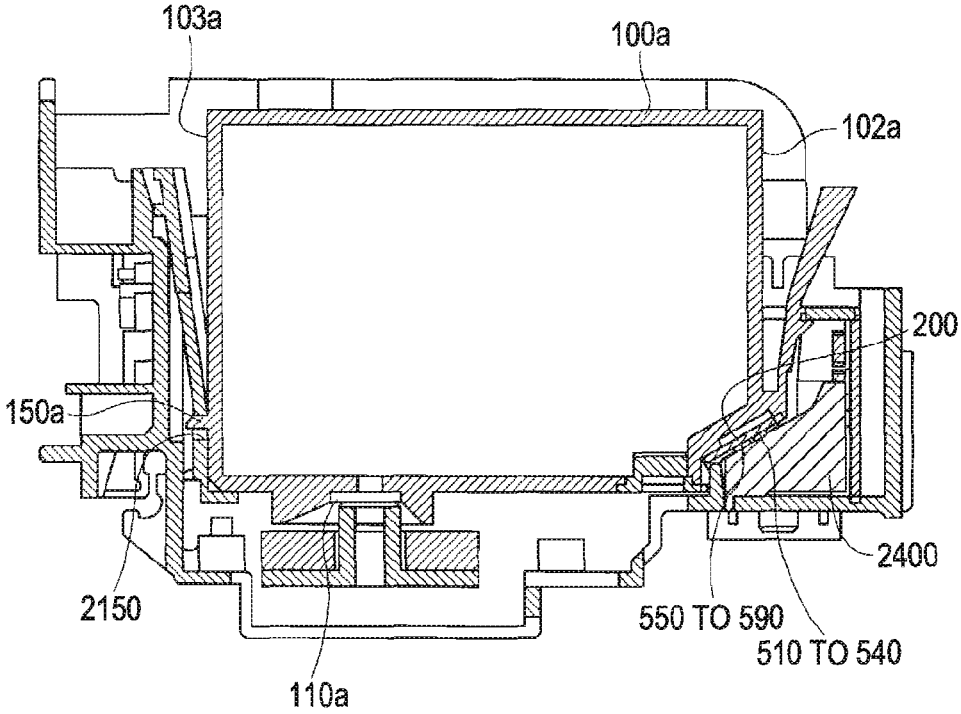

FIGS. 32A and 32B are explanatory views showing progress in which the front end surface of the cartridge is engaged first and then the rear end surface thereof is engaged. In FIG. 32A, first, the front end (the right side in the figure) of the cartridge 100*a* is pushed down, and the engagement protrusion 162*a* of the lever 160*a* provided in the front end surface 102*a* enters a state engaged with the lower surface of the engagement member 2160 of the cartridge mounting unit 2100. Thereafter, the rear end of the cartridge 100*a* is pushed down, and as shown in FIG. 32B, the engagement protrusion 150*a* provided in the rear end surface 103*a* is inserted into the engagement hole 2150 of the cartridge mounting unit 2100. Depending on the configurations of the cartridge 100*a* and the cartridge mounting unit 2100, the front end and the rear end of the cartridge can also be inserted in the reverse order to that of FIGS. 31A to 31C. Even in this case, like the case of the mounting order of FIGS. 31A to 31C, the urging forces exerted on the board of the cartridge 100*a* by the apparatus-side terminals 510 to 590 are not uniform, so that there is a tendency of the cartridge 100*a* and the board 200 to be easily inclined. Therefore, even in this case, it can be understood that it is significantly important to perform the detection process of the loose contact of the terminals described in the various embodiments described above.

Figure 33A:
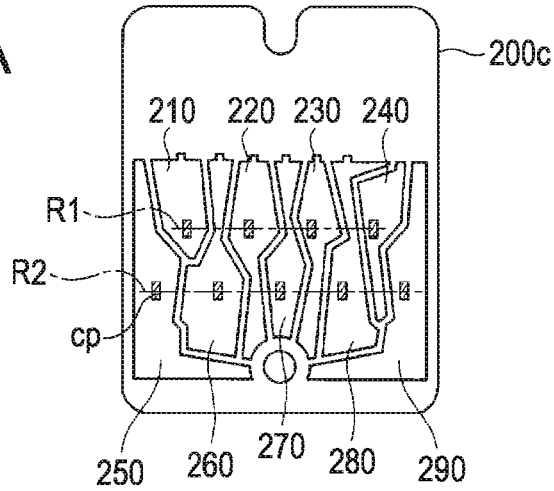
FIGS. 33A to 33C are diagrams showing the configurations of boards according to other embodiments.
Figure 33B:
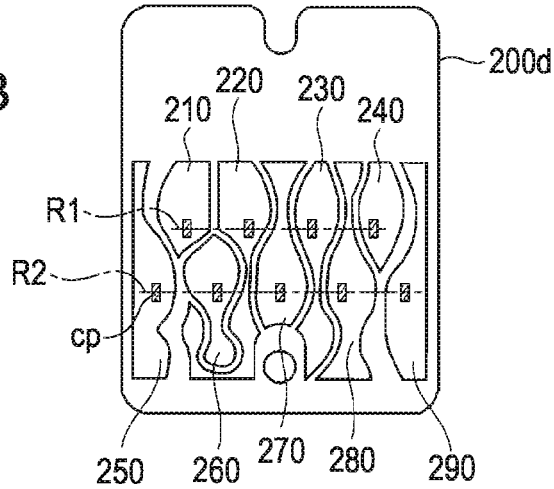
Figure 33C:
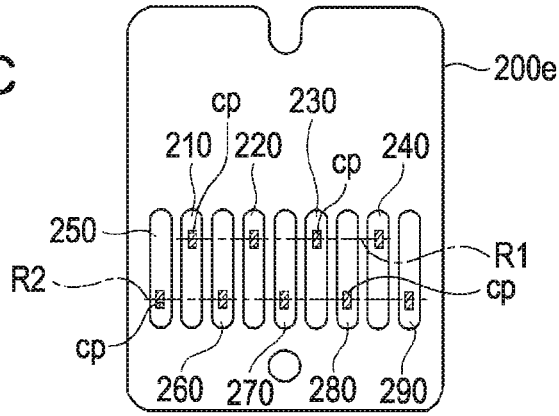

FIGS. 33A to 33C are diagrams showing the configurations of boards according to other embodiments. The boards 200*c* to 200*e* are different from the board 200 shown in FIGS. 3A to 3C only in the surface shapes of the terminals 210 to 290. In the boards 200*c* and 200*d* of FIGS. 33A and 33B, the shapes of the individual terminals are not substantially rectangular but have irregular shapes. In the board 200*e* of FIG. 33C, the nine terminals 210 to 290 are arranged in a line, and the first group of mounting detection terminals 250 and 290 (in the second and third embodiments, terminals to which a high voltage is applied) are disposed at both ends thereof. In addition, the second group of mounting detection terminals 210 and 240 are disposed between the mounting detection terminals 250 and 290 and the memory terminals 260 and 280. Even in the boards 200*c* to 200*e*, the arrangement of the contact potions cp to the apparatus-side terminals corresponding to the respective terminals 210 to 290 is the same as that of the board 200 of FIGS. 3A to 3C. As such, various modifications of the surface shapes of the individual terminals can be made as long as the arrangement of the contact portions cp is the same. In addition, the roles (functions) of the terminals 210 to 290 are not limited to those of FIGS. 3A to 3C (the first embodiment), and those described in FIG. 8 (the second embodiment) or FIG. 20 (the third embodiment) can be applied thereto. In addition, by applying the first to third embodiments, it is possible to achieve substantially the same effects as those of the first to third embodiments. This point is the same in other boards described as follows.

Figure 34A:
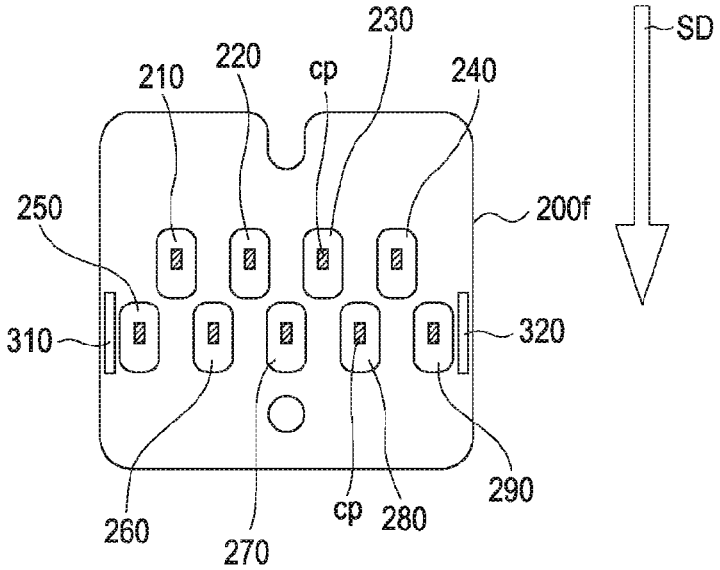
FIGS. 34A to 34C are diagrams showing the configurations of boards according to other embodiments.
Figure 34B:
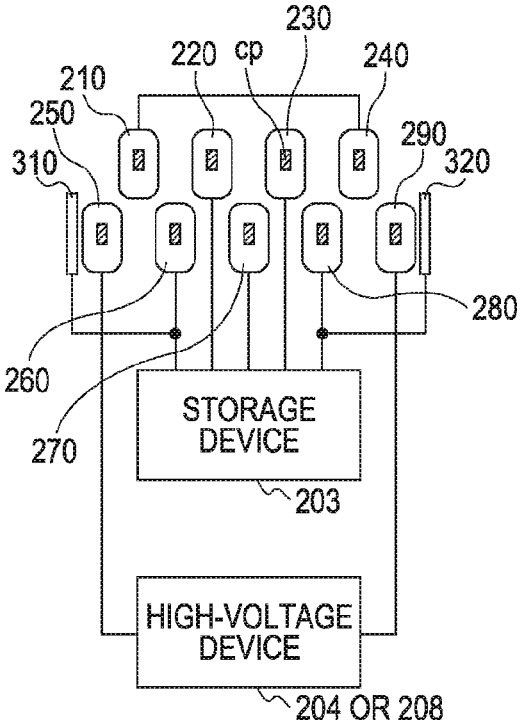
Figure 34C:
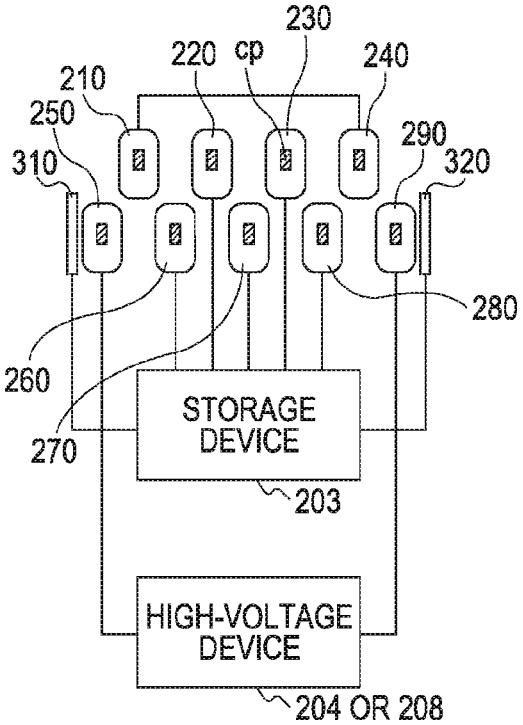

FIG. 34A is a diagram showing the configuration of a board according to still another embodiment. The board 200*f* is the same as the board 200 of FIGS. 3A to 3C in the nine terminals 210 to 290 and the arrangement of the contact portions cp thereof and is different from the board 200 of FIGS. 3A to 3C in that two preliminary terminals 310 and 320 are added in addition to the nine terminals 210 to 290. The two preliminary terminals 310 and 320 are disposed on further outside of the terminals 250 and 290 at both ends of the terminals 250 to 290 of the lower end row having the contact portions cp. FIGS. 34B and 34C show connection examples in cases where the board 200*f* is applied to the second embodiment and the third embodiment. In FIG. 34B, the preliminary terminals 310 and 320 are connected to the memory terminals (for example, the terminals 260 and 280) having the contact portions cp. In FIG. 34C, the preliminary terminals 310 and 320 are directly connected to the storage device 203. Since the preliminary terminals 310 and 320 do not have contact portions to the apparatus-side terminals, they do not have particular functions in a state of being mounted in the printing apparatus. However, the preliminary terminals 310 and 320 can be used for inspecting the board 200*f* in the state where the cartridges are not mounted (or in a single body state of the board 200*f*). In addition, the preliminary terminals 310 and 320 may also be provided as dummy terminals having no functions. Such functions of the preliminary terminals are the same as those of other boards described as follows.

Figure 35A:
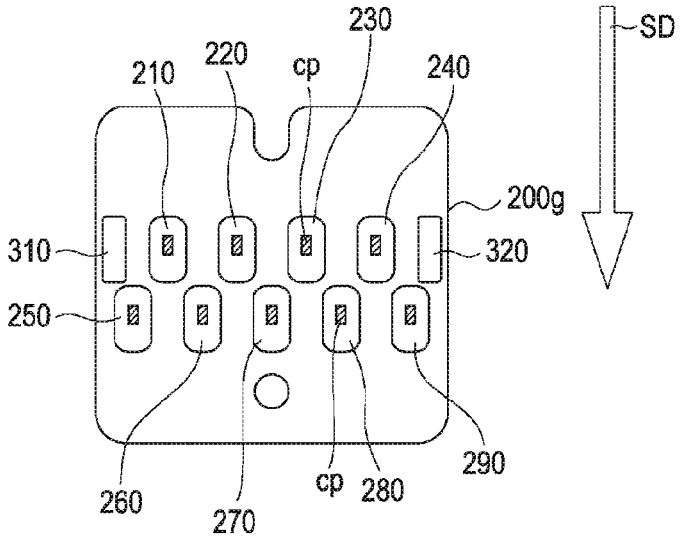
FIGS. 35A to 35C are diagrams showing the configurations of boards according to other embodiments.
Figure 35B:
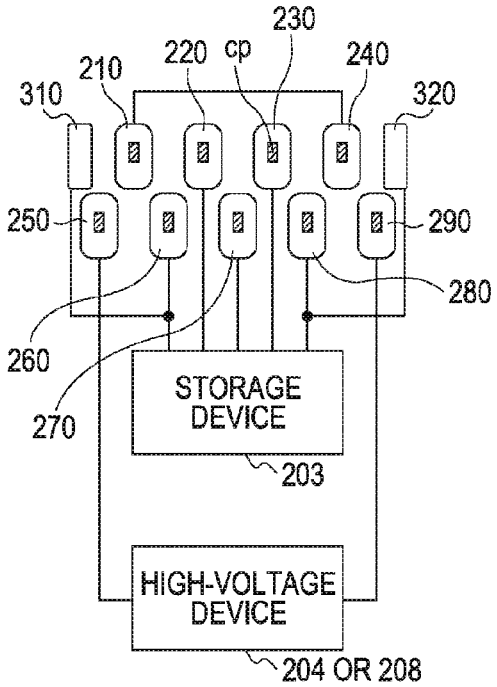
Figure 35C:
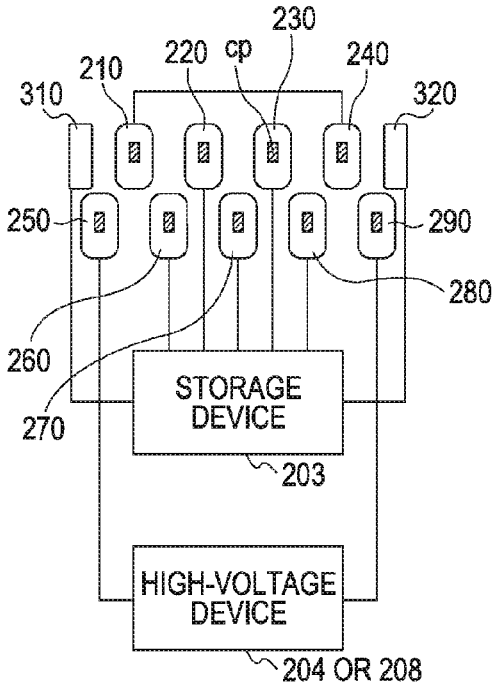

FIG. 35A is a diagram showing the configuration of a board according to still another embodiment. The board 200*g* is also the same as the board 200 of FIGS. 3A to 3C in the nine terminals 210 to 290 and the arrangement of the contact portions cp thereof and is different from the board 200 of FIGS. 3A to 3C in that two preliminary terminals 310 and 320 are added in addition to the nine terminals 210 to 290. The two preliminary terminals 310 and 320 are disposed on further outside of the terminals 210 and 240 at both ends of the terminals 210 to 240 of the upper end row having the contact portions cp. FIGS. 35B and 35C show connection examples in cases where the board 200*g* is applied to the second embodiment and the third embodiment. In FIG. 35B, the preliminary terminals 310 and 320 are connected to the memory terminals (for example, the terminals 260 and 280) having the contact portions cp. In FIG. 35C, the preliminary terminals 310 and 320 are directly connected to the storage device 203.

Figure 36A:
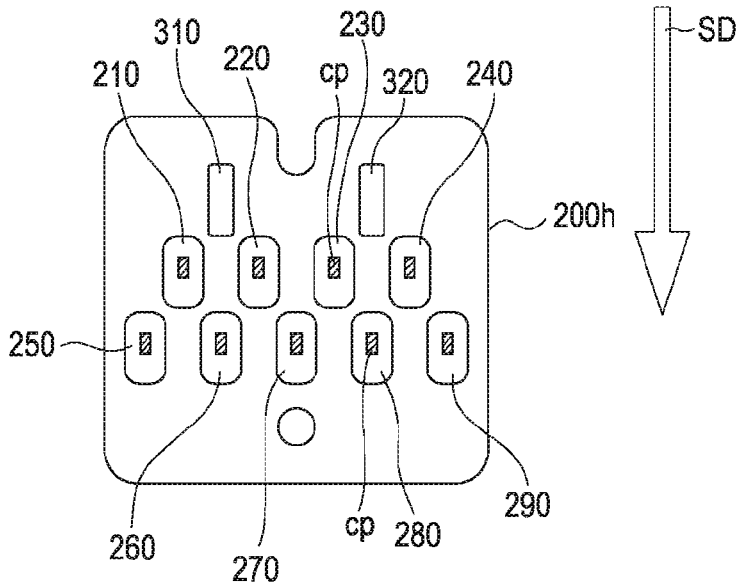
FIGS. 36A to 36C are diagrams showing the configurations of boards according to other embodiments.
Figure 36B:
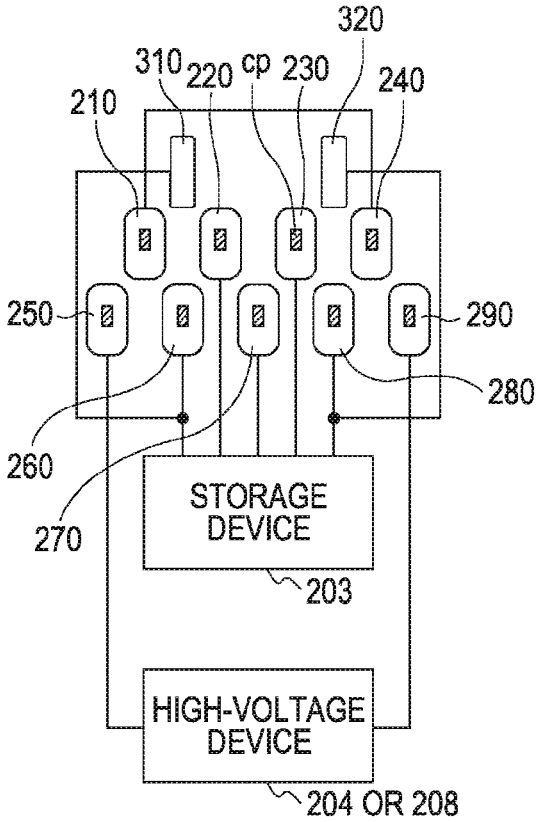
Figure 36C:
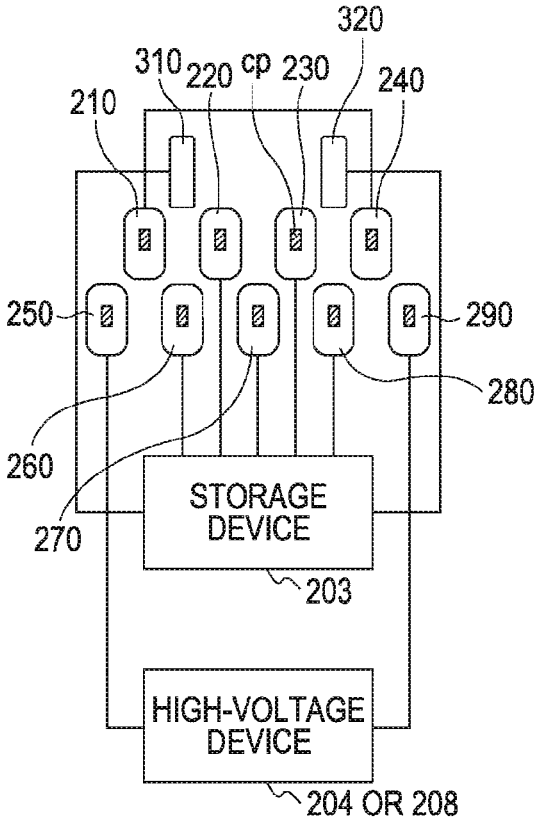

FIG. 36A is a diagram showing the configuration of a board according to still another embodiment. The board 200*h* is also the same as the board 200 of FIGS. 3A to 3C in the nine terminals 210 to 290 and the arrangement of the contact portions cp thereof and is different from the board 200 of FIGS. 3A to 3C in that two preliminary terminals 310 and 320 are added in addition to the nine terminals 210 to 290. The two preliminary terminals 310 and 320 are disposed on further upper side (the front side in the mounting direction SD or in the inclined surface direction SD) than the terminals 210 and 240 of the upper end row having the contact portions cp. FIGS. 36B and 36C show connection examples in cases where the board 200*h* is applied to the second embodiment and the third embodiment. In FIG. 36B, the preliminary terminals 310 and 320 are connected to the memory terminals (for example, the terminals 260 and 280) having the contact portions cp. In FIG. 36C, the preliminary terminals 310 and 320 are directly connected to the storage device 203.

Figure 37:
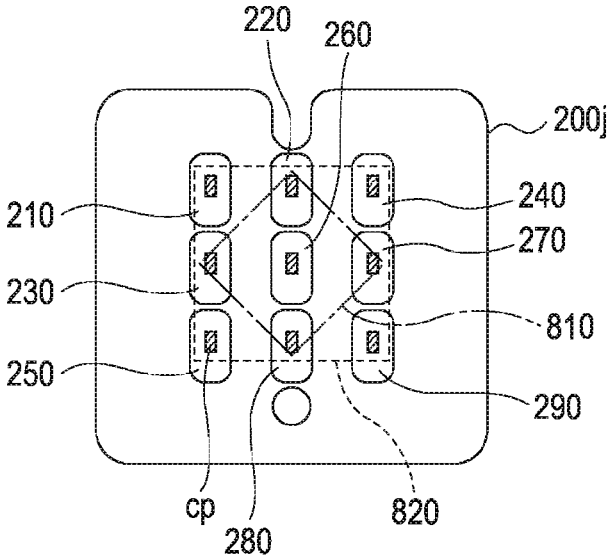
FIG. 37 is a diagram showing the configuration of a board according to another embodiment.

FIG. 37 is a diagram showing the configuration of a board according to still another embodiment. The board 200*j* does not have preliminary terminals but has only the nine terminals 210 to 290 having the contact portions cp. Here, the board 200*h* is different from the board 200 of FIGS. 3A to 3C in that the nine terminals 210 to 290 are arranged in three rows. That is, in the uppermost row (on the front side of the mounting direction SD or the inclined surface direction SD), the three terminals 210, 220, and 240 are disposed, in the intermediate row, the three terminals 230, 260, and 270 are disposed, and in the lowermost row, the three terminals 250, 280, and 290 are disposed. In this example, the nine terminals are arranged in a 3×3 matrix form, but other arrangements may also be employed. Like the board 200 shown in FIGS. 3A to 3C, the plurality of contact portions cp for the storage device are disposed in a first region 810 in a region where the entirety of the nine contact portions cp are disposed. The contact portions of the four mounting detection terminals 210, 240, 250, and 290 are disposed on the outer side than the first region 81.

In addition, the contact portions of the four mounting detection terminals 210, 240, 250, and 290 are disposed at four corners of a quadrangular second region 820 including the first region 810. It is preferable that the shape of the first region 810 be a quadrangle having the smallest area including the four mounting detection terminals 210, 240, 250, and 290. Otherwise, the shape of the first region 810 may be a quadrangle that circumscribes the four mounting detection terminals 210, 240, 250, and 290. It is preferable that the shape of the second region 820 be a quadrangle having the smallest area including all the contact portions.

Even regarding the various boards shown in FIGS. 33A to 37 described above, the contact portions of the two mounting detection terminals 210 and 240 of the upper side row R1 are disposed at both end portions of the upper side row R1, that is, on the outermost sides of the upper side row R1, and the contact portions of the two mounting detection terminals 250 and 290 of the lower side row R2 are disposed at both end portions of the lower side row R2, that is, on the outermost side of the lower side row. Therefore, by applying the detection process of loose contacts, unintended short circuits, leakage, and the like described in the first to third embodiment, substantially the same effects as those described in the embodiments can be obtained.

Figure 38A:
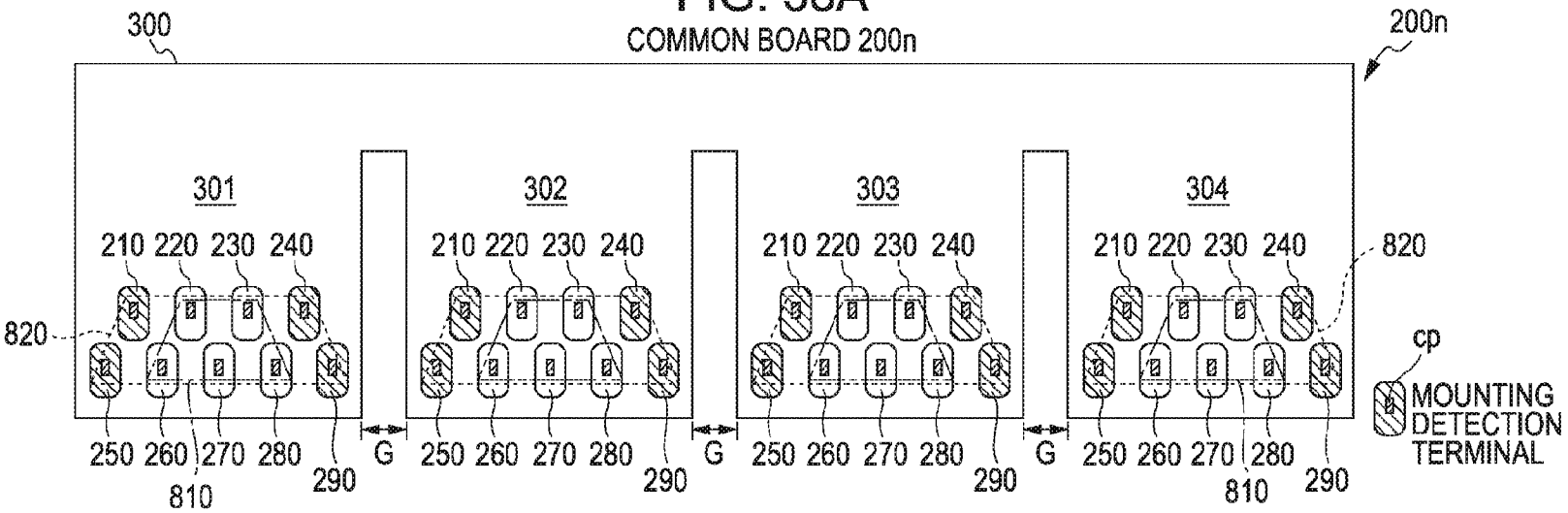
FIGS. 38A and 38B are diagrams showing the configuration of a common board according to another embodiment.

FIG. 38A is a diagram showing a common board according to another embodiment. The common board 200*n* has a configuration in which four small board units 301 to 304 corresponding to four cartridges are connected by a connection board unit 300. Gaps G are present between the plurality of small board units 301 to 304. The size of the gap G is typically equal to or greater than about 3 mm. In addition, in each of the small board portions, a gap between each of the nine terminals 210 to 290 and another terminal closest thereto is smaller than 1 mm. In addition, the contact portions cp of the nine terminals 210 to 290 in each of the small board portions are disposed at substantially equal intervals. In other words, the nine terminals 210 to 290 in each of the small board portions are substantially uniformly disposed. By mounting the common board 200*n* to the cartridge mounting unit 2100 shown in FIG. 27, it is possible to simultaneously connect the four groups of terminal groups of the common board 200*n* to the apparatus-side terminals for the four cartridges in the cartridge mounting unit 2100. In this case, the ink storage body (ink storage container) may be mounted on the cartridge mounting unit 2100 separately from the common board 200*n*. Otherwise, a plurality of ink storage bodies may be installed at a position other than the cartridge mounting unit 2100 to supply ink to the printing head 2050 of the carriage 2030 via tubes from the ink storage bodies. In addition, in a colors-in-one cartridge in which the inside of a single ink storage body is divided into a plurality of ink storage chambers that storage a plurality of colors of ink, the common board 200*n* may be used.

Each of the plurality of small board units 301 to 304 of the common board 200*n* has the plurality of terminals 210 to 290 which are the same as those of the board 200 of FIGS. 3A to 3C. The terminals 210 to 290 and the arrangement of the contact portions thereof are the same as the board 200 of FIGS. 3A to 3C, 8, or 20. In addition, various connection relationships between the plurality of groups of the terminals 210 to 290 of the common board 200*n*, the storage device, and the high-voltage device can be employed. For example, N groups of memory terminals 220, 230, 260, 270, and 280 from among N groups (N is an integer equal to or greater than 2) of terminals 210 to 290 may be commonly connected to a single storage device, or may be individually connected to N storage devices. In addition, when the common board 200*n* is applied to the second or third embodiment, the N groups of terminals 250 and 290 may be commonly connected to a single high-voltage device (204 or 208) or may be individually connected to N high-voltage devices. In addition, as the high-voltage device, various devices (elements or circuits) besides the resistive element or the sensor can be used. For example, various devices such electrostatic capacitors, coils, or circuits having an assembly thereof can be used as the high-voltage devices. This is the same in other embodiments.

In each of the plurality of small board units 301 to 304, the contact portions of the mounting detection terminals 210, 240, 250, and 290 are disposed at four corners of the assembly region 820 of the contact portions of the plurality of terminals 210 to 290. Therefore, for each of the plurality of small board units 301 to 304, it is possible to detect whether or not the plurality of memory terminals enclosed by the mounting detection terminals 210, 240, 250, and 290 are reliably in contact and are in correctly mounted states.

Figure 38B:
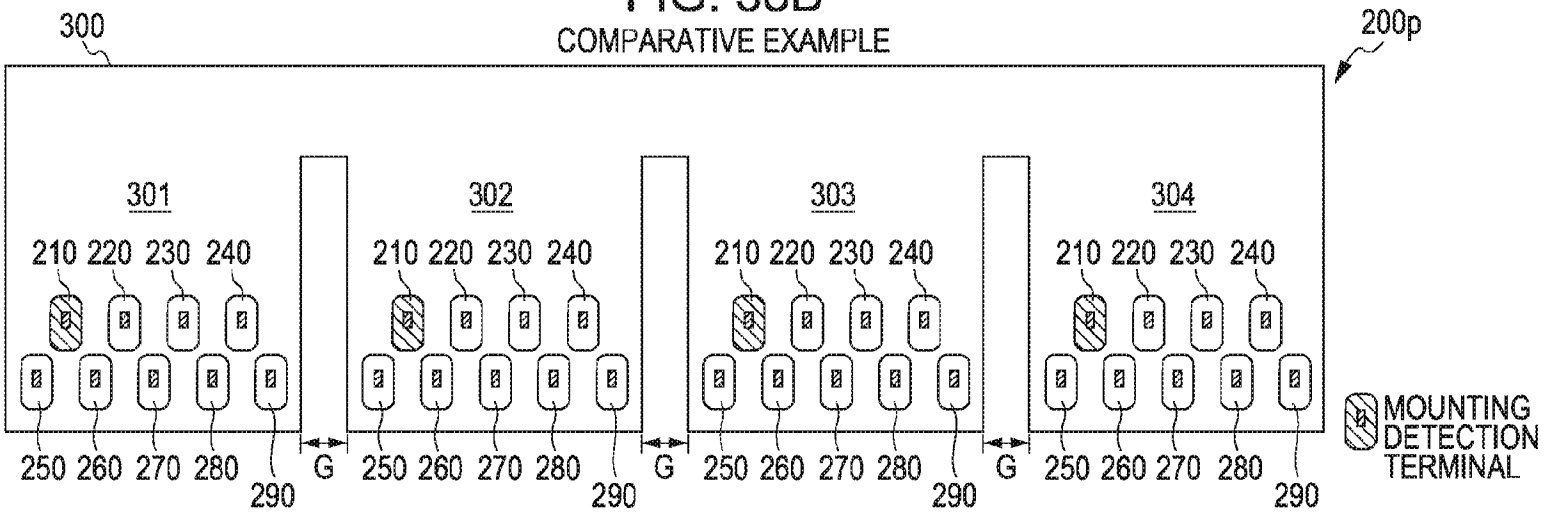

FIG. 38B shows a common board 200*p* as a comparative example. In the common board 200*p* of the comparative example, as a mounting detection terminal, only the single mounting detection terminal 210 is provided in each of the plurality of the small board units 301 to 304. In the common board 200*p* of the comparative example, since the single mounting detection terminal is provided in the single small board unit, it is impossible to detect whether or not the plurality of memory terminals in the individual small board units are reliably in contact and are in correctly mounted states. In particular, since gaps G are present between the plurality of small board units 301 to 304, there is a high possibility that the contact states of the terminals of the plurality of small board units 301 to 304 vary in the small board units. Therefore, in the case where only the single mounting detection terminal is provided in the single small board unit, it is impossible to detect whether or not the plurality of memory terminals in the individual small board units are reliably in contact and in correctly mounted states. This is the same when two mounting detection terminals are provided in the single small board unit.

As such, even when the common board 200*n* is used, by providing the mounting detection terminals at four corners of the quadrangular assembly region of the contact portions of the terminal group provided in each of the small board units, it is possible to detect whether or not the plurality of memory terminals in the individual small board units are reliably in contact and in correctly mounted states. In the specification, the case of simply calling a "board" means a board member corresponding to a single cartridge mounting position (a single storage slot) in the cartridge mounting unit. That is, in the cases of FIGS. 38A and 38B, each of the plurality of small board units 301 to 304 corresponds to the "board".

Figure 39A:
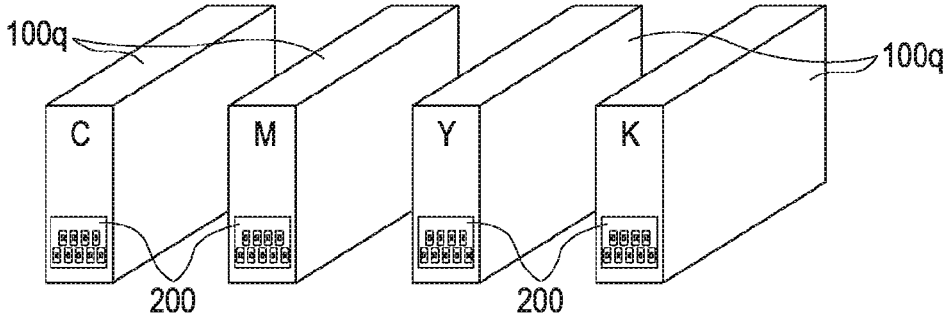
FIGS. 39A to 39C are diagrams showing stand-alone color cartridges, a colors-in-one cartridge which is compatible therewith, and a common board.
Figure 39B:
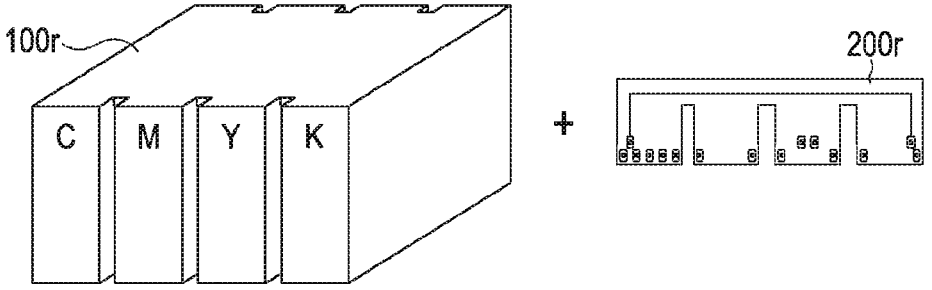
Figure 39C:
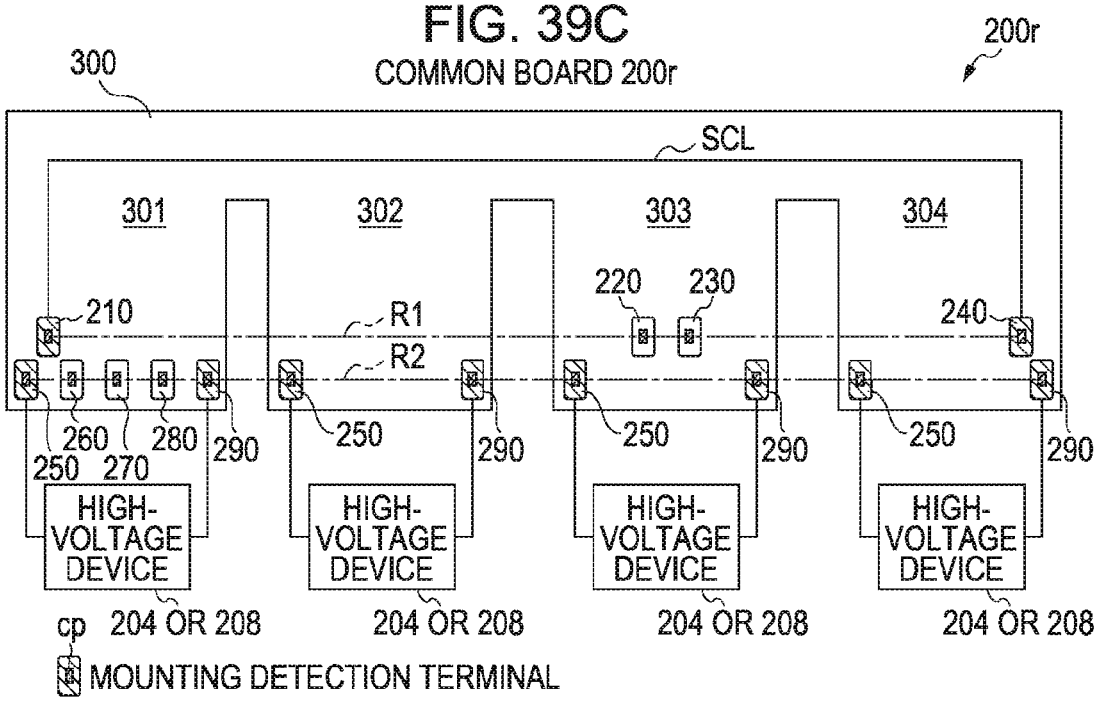

FIGS. 39A to 39C are diagrams showing the configurations of stand-alone color cartridges, a colors-in-one cartridge which is compatible therewith, and a common board. In addition, in FIGS. 39A to 39C, for convenience of illustration, the structure of the cartridge or the circuit board is simplified in the illustration. Cartridges 100*q* of FIG. 39A are independent cartridges for each color, and a circuit board 200 is installed on the front surface of each of the cartridges 100*q*. The cartridges 100*q* can be mounted independently from the cartridge mounting unit.

FIG. 39B shows a colors-in-one cartridge 100*r* in which the inside of a single ink storage body is divided into a plurality of ink storage chambers storing a plurality of ink colors, and a common board 200*r* for the colors-in-one cartridge 100*r*. The colors-in-one cartridge 100*r* is compatible with the four independent cartridges 100*q*, and has a shape that can be mounted in the cartridge mounting unit (holder) in which the four independent cartridges 100*q* are mounted. The common board 200*r* can be mounted in the cartridge mounting unit along with the colors-in-one cartridge 100*r* in the state where the colors-in-one cartridge 100*r* is installed. Otherwise, the common board 200*r* and the colors-in-one cartridge 100*r* can be separately mounted in the cartridge mounting unit. In the case of the latter, for example, the common board 200*r* is first mounted in the cartridge mounting unit, and thereafter the colors-in-one cartridge 100*r* is mounted in the cartridge mounting unit.

FIG. 39C shows the configuration of the common board 200*r*. Like the common board 200*n* of FIG. 38A, the common board 200*r* has a configuration in which four small board units 301 to 304 corresponding to the four stand-alone color cartridges 100*q* are connected by a connection board unit 300. In each of the small boards 301 to 304, a group of the mounting detection terminals 250 and 290 connected to the high-voltage device of the cartridge is disposed. This point is the same as the common board 200*n* of FIG. 38A. The differences between the common board 200*n* of FIG. 38A and the common board 200*r* of FIG. 39C are as follows.

Difference 1: In the common board 200*n* of FIG. 38A, other group of the mounting detection terminals 210 and 240 are provided in each of the small boards 301 to 304; however, in the common board 200*r* of FIG. 39C, the single mounting detection terminal 210 is disposed in the small board 301 on one end side, and the other single mounting detection terminal 240 is disposed in the small board 304 on the other end side, the two mounting detection terminals 210 and 240 being short-circuited by a wiring line SCL.

Difference 2: In the common board 200*n* of FIG. 38A, the plurality of memory terminals 220, 230, 260, 270, and 280 are provided in each of the small boards 301 to 304; however, in the common board 200*r* of FIG. 39C, only a single group of the memory terminals 220, 230, 260, 270, 280 is provided in the entire common board 200*r*.

In addition, in the example of FIG. 39C, the memory terminals 220 and 230 of the upper side row R1 are provided in the third small board 303, and the memory terminals 260, 270, and 280 of the lower side row R2 are provided in the first small board 301. In addition, the functions of the memory terminals 220, 230, 260, 270, and 280 are as described with reference to FIGS. 3A to 3C. Each of the memory terminals 220, 230, 260, 270, and 280 may be provided in any of the small boards 301 to 304. This configuration can be employed in the case where, as described later, the storage device of the circuit board 200 of the plurality of stand-alone color cartridges 100*q* are connected to the control circuit of the printing apparatus via buses.

Figure 40:
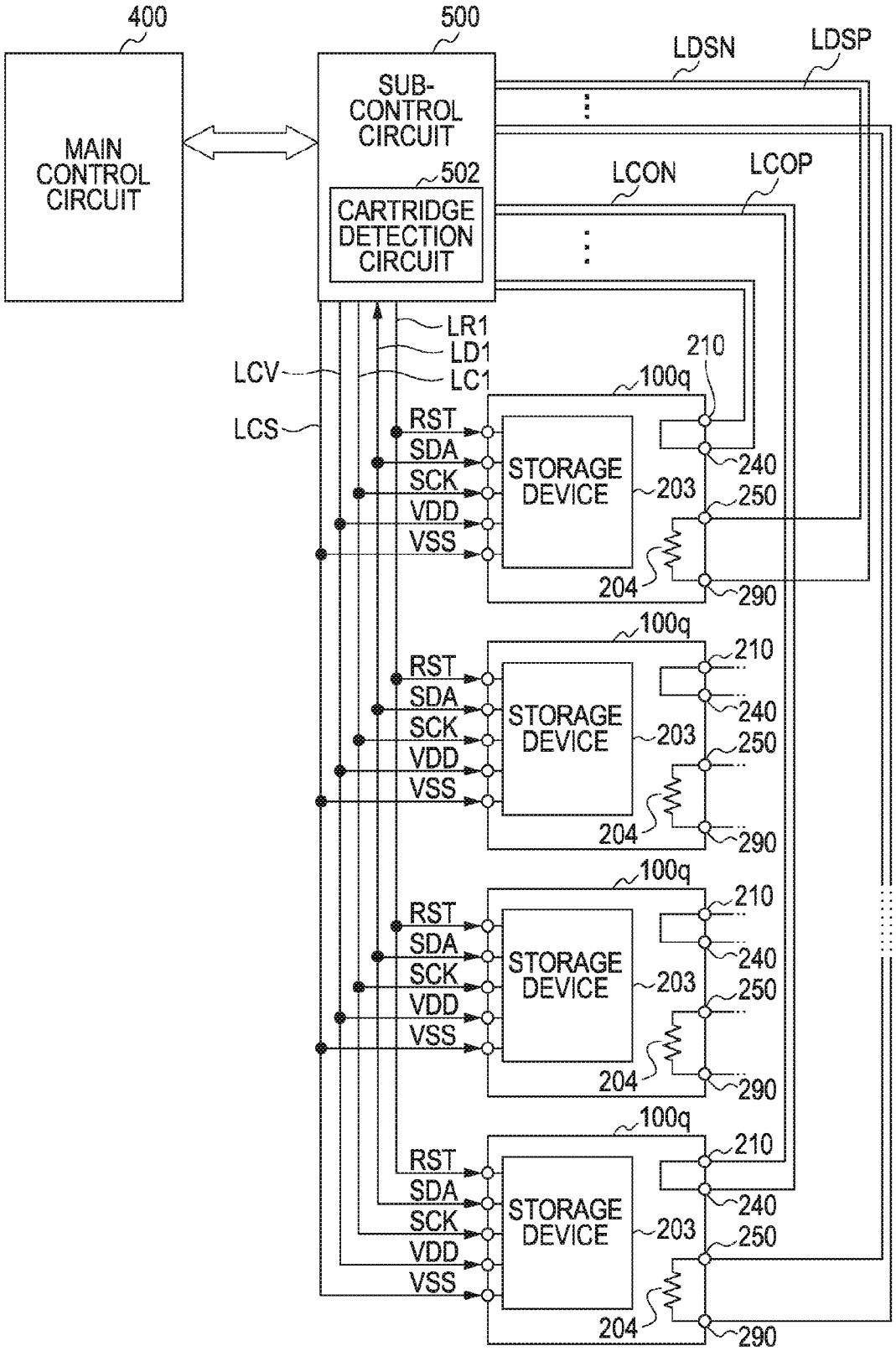
FIG. 40 is a diagram showing the circuit configuration of a printing apparatus suitable for the cartridges of FIG. 39.

FIG. 40 is an explanatory view showing the electrical configuration of a printing apparatus suitable for the cartridges of FIGS. 39A to 39C. Here, a state where the stand-alone color cartridges 100*q* shown in FIG. 39A are mounted is shown. The storage device 203 of each of the cartridges 100*q* is connected to the sub-control circuit 500 via a plurality of wiring lines LR1, LD1, LC1, LCV, and LCS. On the other hand, the resistive element 204 of each of the cartridges 100*q* is individually connected to the cartridge detection circuit 502 via signal lines LDSN and LDSP. In addition, the mounting detection terminals 210 and 240 of each of the cartridges 100*q* are also individually connected to the cartridge detection circuit 502 via signal lines LCON and LCOP. In addition, the connection relationship between the four terminals 210, 240, 250, and 290 for mounting detection and the cartridge detection circuit 502 can employ, for example, the configuration as shown in FIG. 22. In the circuit configuration, the storage devices 203 of the plurality of stand-alone color cartridges 100*q* are connected via buses. Therefore, in the case where the colors-in-one cartridge 100*r* and the common board 200*r* shown in FIG. 39B are used instead of the plurality of stand-alone color cartridges 100*q*, at least one storage device may be provided in the common board 200*r*. There, in the common board 200*r* shown in FIG. 39C, only a single group of the memory terminals 220, 230, 260, 270, and 280 is provided in the entire common board 200*r*.

Figure 41:
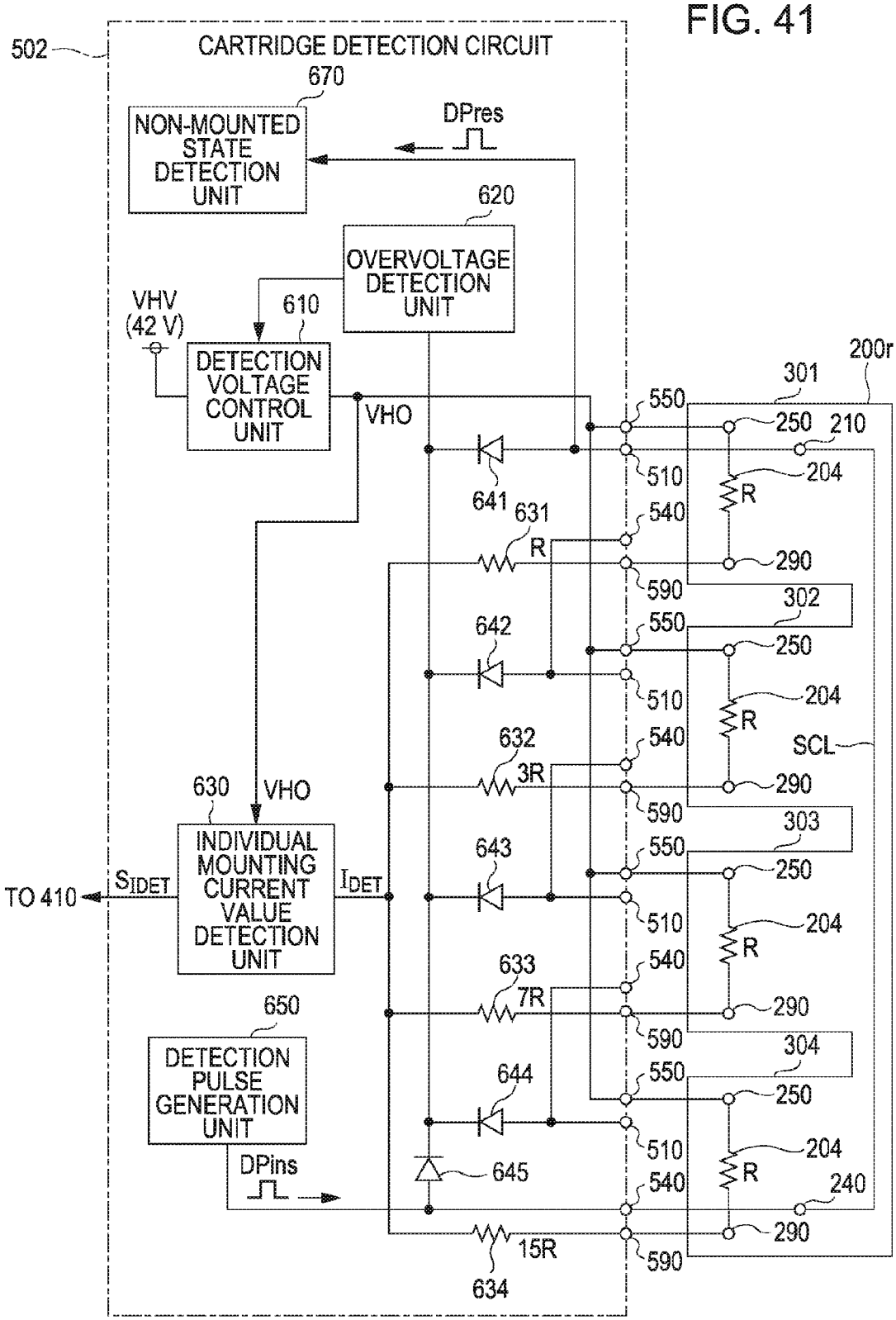
FIG. 41 is a diagram showing a connection state of a cartridge detection circuit and the common board.

FIG. 41 is a diagram showing a connection state of the cartridge detection circuit 502 and the common board 200*r* of FIG. 39C. The circuit configuration of the cartridge detection circuit 502 is the same as that of FIG. 22, and this diagram corresponds to a diagram in a case where the common board 200*r* is applied instead of the four cartridges IC1 to IC4 in FIG. 22. The group of the mounting detection terminals 250 and 290 connected to the resistive element 204 provided in each of the small boards 301 to 304 are respectively connected the corresponding apparatus-side terminals 550 and 590 of the cartridge detection circuit 502. Therefore, in the case where the individual mounting detection process is performed by the individual mounting current value detection unit 630 while the common board 200*r* is mounted, it is determined that all the cartridges are mounted. In addition, as described above, in the common board 200*r*, the single mounting detection terminal 210 is disposed in the small board 301 on the one end side, and the other single mounting detection terminal 240 is disposed in the small board 304 on the other end side, the two mounting detection terminals 210 and 240 being short-circuited by the wiring line SCL. Therefore, even when the non-mounted state detection process is performed by the detection pulse generation unit 650 and the non-mounted state detection unit 670, a correctly mounted state is determined. In addition, as can be understood by comparing FIGS. 22 and 41 to each other, in the circuit of FIG. 41, only the terminals 240 and 210 at both ends of the plurality of groups of terminals 240 and 210 which are sequentially connected are provided in the common board 200*r* in the circuit of FIG. 22 and they are short-circuited by the wiring line SCL. Even when the common board 200*r* is used, the cartridge detection circuit 502 side determines the correctly mounted state, so that various processes such as a printing process can be performed thereafter. In addition, as the high-voltage device used in the common board 200*r*, a high-voltage device (for example, a sensor) or the like other than the resistive element 204 can be used.

In addition, in the common board 200*r* of FIG. 39C, one or more storage devices 203 may be provided, and a single storage device 203 may be provided for each ink color. In addition, the plurality of memory terminals 220, 230, 260, 270, and 280 may be provided to form one or more groups depending on the number of storage devices 203.

Even in the common board 200*r* of FIG. 39C, like the circuit board of FIGS. 3A to 3C, the contact portions cp of the plurality of terminals are divided into the upper side row R1 (first row) and the second side row R2 (second row). That is, in the upper side row R1, the contact portions cp of the mounting detection terminals 210 and 240 and the contact portions cp of the two memory terminals 220 and 230 are disposed. In addition, in the lower side row R2, the plurality of groups of mounting detection terminals 250 and 290 and three memory terminals 260, 270, and 280 are disposed. At both ends of the upper side row R1 and both ends of the lower side row R2, the contact portions cp of the mounting detection terminals are disposed, so that it is possible to correctly confirm the contact states of the memory terminals therebetween. In addition, the distance between the contact portions cp of the mounting detection terminals 210 and 240 disposed at both ends from among the contact portions cp of the plurality of terminals existing in the upper side row R1 is longer than the distance between the two contact terminals disposed at both ends from among the contact portions cp of the memory terminals 260 and 280 existing in the lower side row R2. Even in this configuration, as described above, the contact portions cp of the four mounting detection terminals (the two contact portions cp of the mounting detection terminals 210 and 240 disposed at both ends of the upper side row R1 and the two contact portions cp of the mounting detection terminals 210 and 290 of the small boards 301 and 304 disposed at both ends of the lower side row R2, respectively) are disposed on the outside of the region where the contact portions of the memory terminals are disposed to correspond to the four corners of the quadrangular region including the region, so that whether or not the cartridges are correctively mounted can be correctly determined by the printing apparatus side.

Figure 42A:
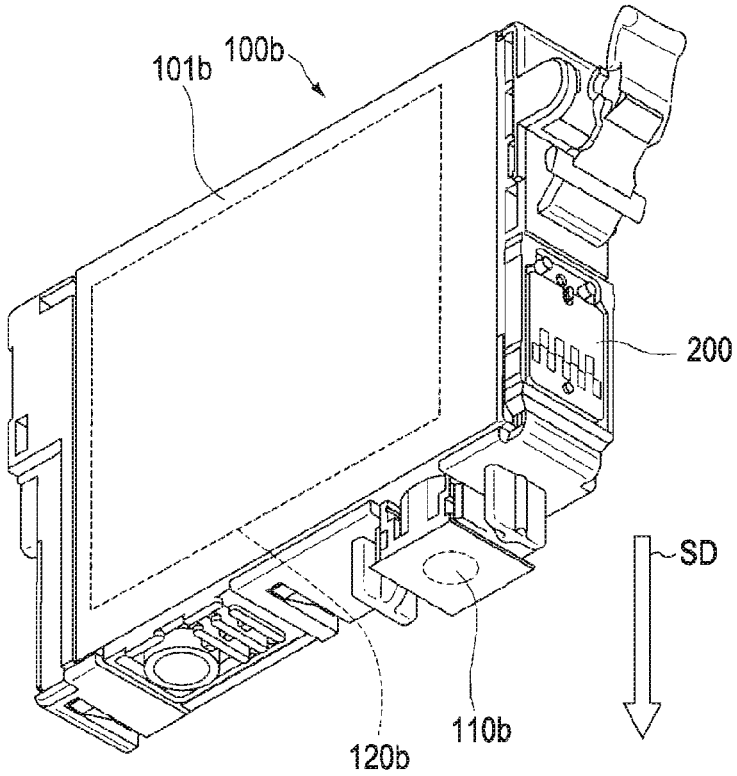
FIGS. 42A and 42B are perspective views showing the configuration of an ink cartridge according to another embodiment.
Figure 42B:
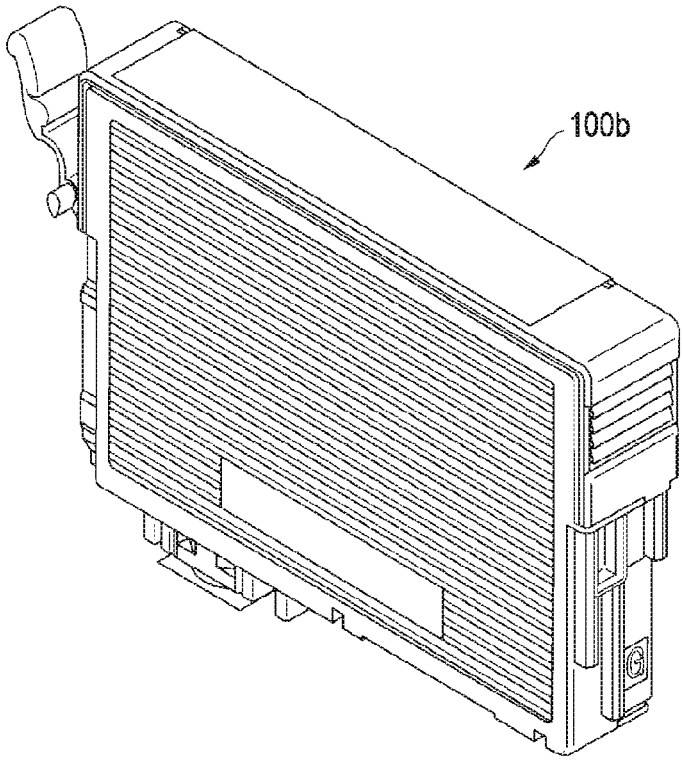

FIGS. 42A and 42B are perspective views showing the configuration of a cartridge according to another embodiment. The cartridge 100*b* is also used for an on-carriage type small-format ink jet printer and includes a housing 101*b* formed as a substantially rectangular parallelepiped storing ink and the board 200. The mounting direction SD (a direction for mounting in the cartridge mounting unit) of the cartridge 100*b* and the board 200 is a vertically downward direction. An ink chamber 120*b* that stores ink is formed inside the housing 101*b*. An ink supply opening 110*b* is formed at the bottom surface of the housing 101*b*. In a state before use, the opening of the ink supply opening 110*b* is sealed by a film. The cartridge 100*b* is different from the cartridge 100*a* of FIG. 28 in the shape. In particular, the housing 200 is fixed to the side surface of the housing 101*b* which is vertical, and in this point, the cartridge 100*b* is significantly different from the cartridge 100*a* of FIG. 28. To the cartridge 100*b* and the board 200 thereof, the embodiments or the modified examples described above can also be applied.

Figure 43:
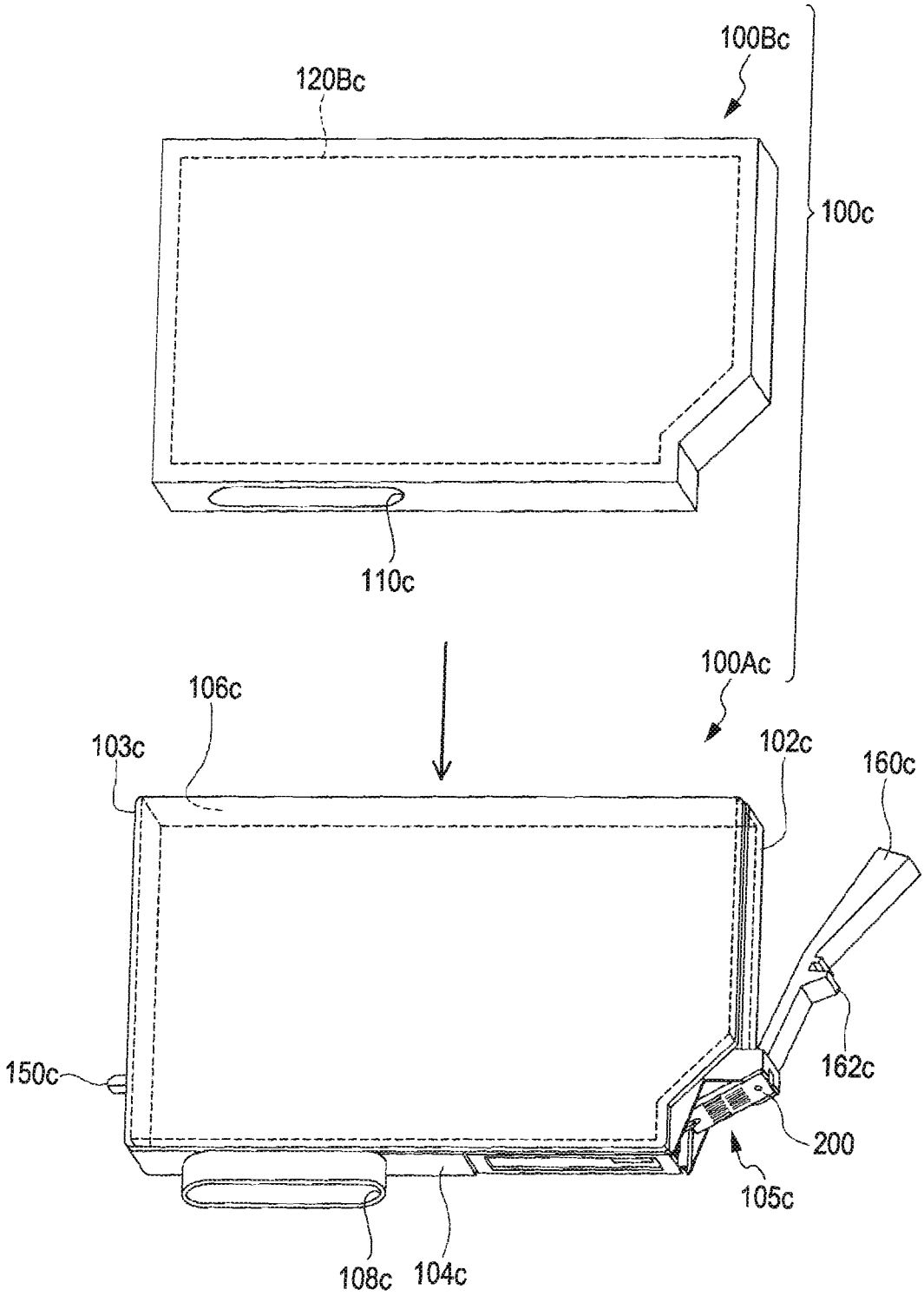
FIG. 43 is a perspective view showing the configuration of an ink cartridge according to another embodiment.

FIG. 43 is a perspective view showing the configuration of a cartridge according to still another embodiment. The cartridge 100*c* is divided into an ink storage portion 100Bc and an adapter 100Ac. The cartridge 100*c* is compatible with the cartridge 100*a* of FIG. 28. The ink storage portion 100Bc includes an ink chamber 120Bc that stores ink and an ink supply opening 110*c*. The ink supply opening 110*c* is formed at the bottom surface of the housing 101Bc and communicates with the ink chamber 120Bc.

The adapter 100Ac is provided with an opening 106*c* at the upper portion, and a space that receives the ink storage portion 100Bc is formed therein, so that only the outer shape is different from that of the cartridge 100*a* of FIG. 28. As a different point, the cartridge 100*c* has substantially the same outer shape as that of the cartridge 100*a* of FIG. 28. That is, the adapter 100Ac has an overall shape of a substantially rectangular parallelepiped, and the outer surfaces includes five surfaces excluding the top surface (upper end surface) from among orthogonal six surfaces and a board installation portion 105*c* provided at a corner portion of the lower end thereof in a shape of an inclined surface. A first side surface (front end surface) 102*c* of the adapter 100Ac is provided with a lever 160*c*, and the lever 160*c* is provided with an engagement protrusion 162*c*. At a bottom surface 104*c* of the adapter 100Ac, an opening 108*c* is formed which causes the ink supply tube 2080 of the cartridge mounting unit 2100 to pass through when the cartridge mounting unit 2100 is mounted. In the state where the ink storage portion 100Bc is stored in the adapter 100Ac, the ink supply opening 110*c* of the ink storage portion 100Bc is connected to the ink supply tube 2080 of the cartridge mounting unit 2100. In the vicinity of the power end of the first side surface 102*c* of the adapter 100Ac, the board installation portion 105*c* having the inclined surface shape is formed, and the board 200 is installed on the board installation portion 105*c*. A second side surface (rear end surface) 103*c* opposing the first side surface 102*c* is provided with an engagement protrusion 150*c*.

When the cartridge 100*c* is used, the ink storage portion 100Bc and the adapter 100Ac are simultaneously mounted in the cartridge mounting unit 2100 while being combined. Otherwise, the adapter 100Ac is first mounted in the cartridge mounting unit 2100 and thereafter the ink storage portion 100Bc may be mounted in the adapter 100Ac. In the case of the latter, only the ink storage portion 100Bc can be attached or detached while the adapter 100Ac is mounted in the cartridge mounting unit 2100.

Figure 44:
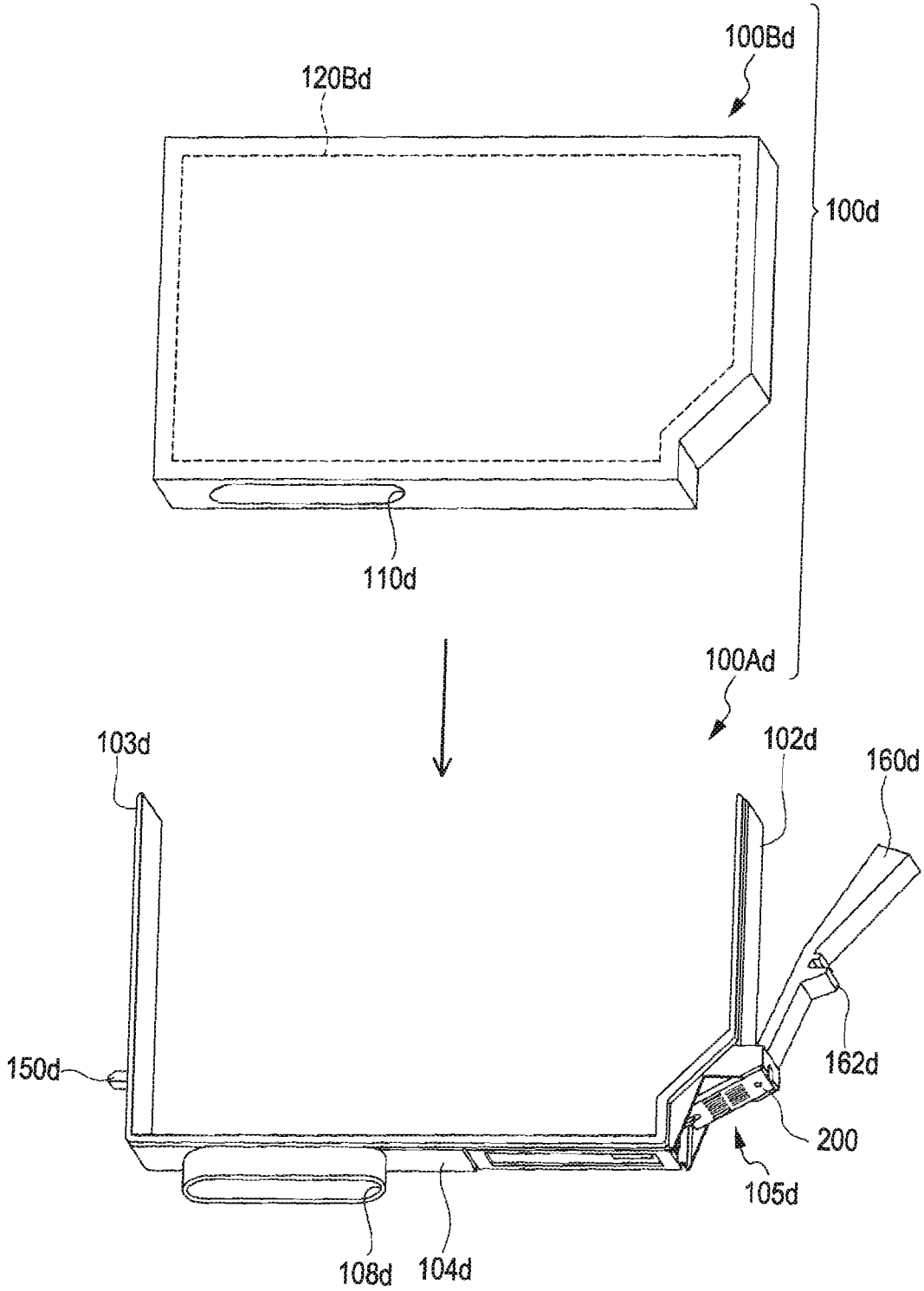
FIG. 44 is a perspective view showing the configuration of an ink cartridge according to another embodiment.

FIG. 44 is a perspective view showing the configuration of a cartridge according to still another embodiment. The cartridge 100*d* is also divided into an ink storage portion 100Bd and an adapter 100Ad. The adapter 100Ad includes a first side surface 102*d*, a bottom surface 104*d*, a second side surface 103*d* opposing the first side surface 102*d*, and a board installation portion 105*d* having a shape of an inclined surface provided in the vicinity of the lower end of the first side surface 102*d*. The main difference from the cartridge shown in FIG. 43 is that in the adaptor 100Ad of FIG. 44, members that constitute the two side surfaces (the largest side surfaces) intersecting the first and second side surfaces 102*d* and 103*d* and the bottom surface 104*d* do not exist. The first side surface 102*d* is provided with a lever 160*d*, and the lever 160*d* is provided with an engagement protrusion 162*d*. The second side surface 103*d* is also provided with an engagement protrusion 150*d*. The ink storage portion 100Bd includes an ink chamber 120Bd that stores ink and an ink supply opening 110*d*. The cartridge 100*d* can be used in substantially the same method as that of the cartridge 100*c* of FIG. 43.

Figure 45:
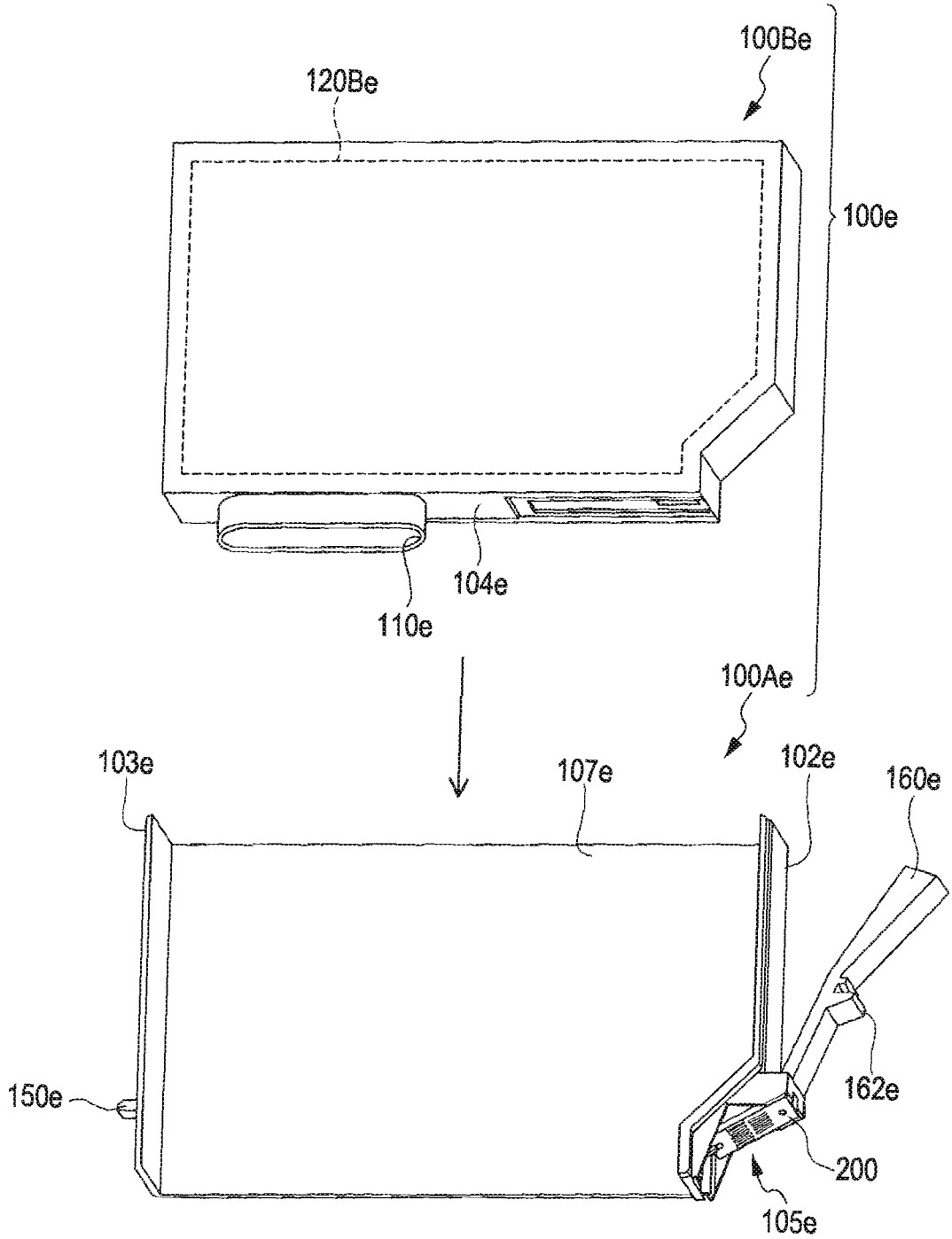
FIG. 45 is a perspective view showing the configuration of an ink cartridge according to another embodiment.

FIG. 45 is a perspective view showing the configuration of a cartridge according to still another embodiment. The cartridge 100*e* is also divided into an ink storage portion 100Be and an adapter 100Ae. The adapter 100Ae includes a first side surface 102*e*, a second side surface 103*e* opposing the first side surface 102*e*, a third side surface 107*e* provided between the first and second side surfaces 102*e* and 103*e*, and a board installation portion 105*d* having a shape of an inclined surface provided in the vicinity of the lower end of the first side surface 102*d*. The ink storage portion 100Be includes an ink chamber 120Be that stores ink and an ink supply opening 110*e*. A bottom surface 104*e* of the ink storage portion 100Be has substantially the same shape as the bottom surface 104*a* of the cartridge 100*a* shown in FIG. 28. The cartridge 100*e* can be used in substantially the same method as that of the cartridges 100*c* and 100*d* of FIGS. 43 and 44.

As understood by the examples of FIGS. 43 to 45 described above, the cartridge can be divided into the ink storage portion (also called a "printing material storage body") and the adapter. In this case, it is preferable that the circuit board be provided on the adapter side. In addition, the configuration of the cartridge divided into the ink storage portion and the adapter can be applied to the cartridge 100 shown in FIGS. 2A and 2B. It is preferable that an adapter which is compatible with the cartridge 100*a* of FIG. 28 include the first side surface 102*c* (102*d* or 102*e*) provided with the lever having an engagement structure, the second side surface 103*c* (103*d* or 103*e*) opposing the first side surface, the other surface (the bottom surface 104*c* or 104*d* or the third side surface 107*e*) provided between the first and second side surfaces, and the board installation portion 105*c* (105*d* or 105*e*) provided in the vicinity of the lower end of the first side surface.

F. MODIFIED EXAMPLES

In addition, the invention is not limited to the embodiments described above, various modifications can be made without departing from the spirit and scope of the invention. For example, the following modifications can be made.

Modified Example 1

The arrangement of the terminals of the board or the contact portions thereof in the embodiments described above can be modified in various forms. For example, in the boards of the embodiments, the plurality of terminals or the contact portions thereof are disposed in the two rows which are parallel to each other along the direction perpendicular to the mounting direction of the cartridge, but instead of this, may also be arranged in two rows along the direction parallel to the mounting direction of the cartridge. In addition, the arrangement may be formed in three or more rows instead of the two rows.

In addition, the number of terminals for mounting detection is arbitrary and five or more terminals may also be disposed. Moreover, the kinds or the arrangement of the plurality of terminals for the storage device can also be modified in various forms other than those described above. For example, the reset terminal can be omitted. Here, it is preferable that the plurality of contact portions for the storage device be disposed in an assembled state so as not to cause the contact portions of the other terminals (the terminals for mounting detection) to be interposed between the contact portions of the terminals for the storage device.

Modified Example 2

In each of the embodiments, as the electric device mounted in the cartridge, in addition to the storage device 203, the sensor 208 (FIG. 9) or the resistive element 204 (FIG. 21) is used. However, a plurality of electric devices mounted in the cartridge is not limited to the devices and one or more arbitrary kinds of electric devices may also be mounted in the cartridge. For example, as the sensor for detecting an ink amount, instead of a sensor using a piezoelectric element, an optical sensor may also be provided in the cartridge. As the electric device to which a voltage higher than 3.3V is applied, devices other than the sensor 208 (FIG. 9) or the resistive element 204 (FIG. 21) may also be used. Moreover, in the third embodiment, both the storage device 203 and the resistive element 204 are provided in the board 200; however, the electric device of the cartridge can be disposed on other arbitrary members. For example, the storage device 203 may be disposed on different structural members which are separated from the housing of the cartridge, the adapter, or the cartridge. This point is the same as in the second embodiment.

Modified Example 3

In the third embodiment, the four resistors 701 to 704 for mounting detection are formed of the resistive elements 204 in the n-th cartridges and the corresponding resistive elements 63*n* (n=1 to 4) in the cartridge detection circuit 502; however, the resistance value of the resistors for mounting detection may also be realized as a single resistive element or three or more resistive elements. For example, the resistor 701 for mounting detection which is configured of the two resistive elements 204 and 631 may be substituted with a single resistive element. The other resistors for mounting detection may also be substituted. In the case where a single resistor for mounting detection are configured of a plurality of resistive elements, the distribution of the resistance values of the resistive elements can be arbitrarily changed. In addition, the single resistive element or the plurality of resistive elements may also be provided in only one of the cartridge and the main body of the printing apparatus. For example, when all the resistors for mounting detection are provided on the cartridge, the resistive elements constituting the resistors for mounting detection become unnecessary for the main body of the printing apparatus.

Figure 46:
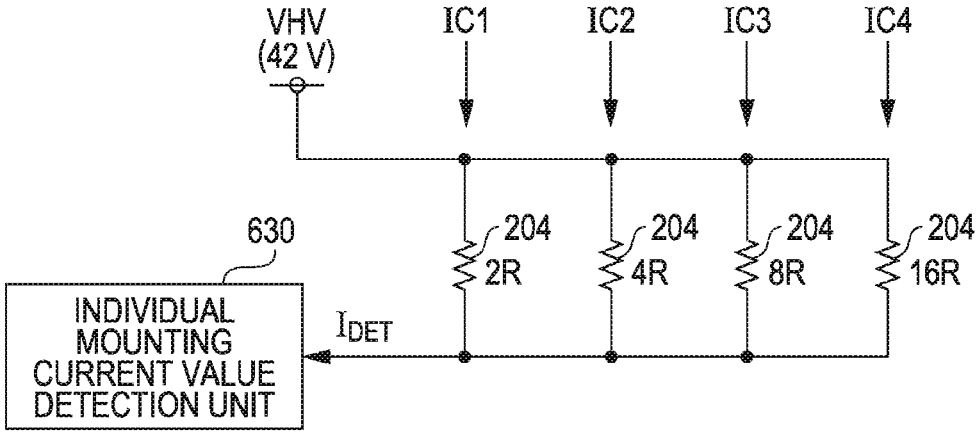
FIG. 46 is a diagram showing a modified example of a circuit for individual mounting current value detection.

FIG. 46 is a circuit diagram showing a modified example of a circuit configuration for individual mounting detection. This circuit is formed by omitting the resistive elements 631 to 634 of the cartridge detection circuit 502 from the circuit of FIG. 23A and changing the resistance values of the resistive elements 204 to other values corresponding to the kinds of the cartridges. That is, the resistance value of the resistive element 204 of the n-th (n=1 to 4) cartridge ICn is set to $2^{n}R$ (R is a constant value). Even in the circuit of FIG. 46, like FIG. 23A, characteristics in which the detection currents $I_{DET}$ are uniquely determined depending on $2^{N}$ kinds of mounted states of the N cartridges are obtained.

Modified Example 4

Components which have no relation to particular purposes, operations, and effects from among various components described in each of the embodiments may be omitted. For example, the storage device 203 in the cartridge is not used for individual mounting detection of the cartridge and thus may be omitted when the individual mounting detection of the cartridge is the main purpose. In addition, an arbitrary part of processes from among the above-described various processes and components related to the processes may be omitted.

Modified Example 5

In each of the embodiments, the invention is applied to the ink cartridge; however, the invention can also be applied to a different printing material, for example, a printing material storage body (printing material storage container) which contains toner.

In addition, the invention is not limited to the ink jet printer and the ink cartridges thereof, and can also be applied to arbitrary liquid ejecting apparatuses that eject liquids different from ink and liquid storage containers thereof. For example, various liquid ejecting apparatuses and liquid storage containers thereof as follows can be applied.

(1) Image recording apparatuses such as fax devices
(2) Color material ejecting apparatuses used for manufacturing color filters for image display devices such as liquid crystal displays
(3) Electrode material ejecting apparatuses used for forming electrodes of organic EL (electro luminescence) displays, field emission displays (FED), and the like
(4) Liquid ejecting apparatuses that eject liquid containing biological organic materials used for manufacturing biochips
(5) Specimen ejecting apparatuses as precision pipettes
(6) Ejecting apparatuses of lubricating oil
(7) Ejecting apparatuses of resin liquids
(8) Liquid ejecting apparatuses that eject lubricating oil to precision machinery such as watches or cameras with pinpoint precision (9) Liquid ejecting apparatuses that eject transparent resin liquids such as ultraviolet curable resin on substrates to form micro-hemispherical lenses (optical lenses) or the like used for optical communication elements or the like

(10) Liquid ejecting apparatuses that eject acidic or alkaline etchants for etching substrates or the like

(11) Liquid ejecting apparatuses including liquid ejecting heads that discharge a minute amount of other arbitrary liquid droplets In addition, the "liquid droplets" represent liquid states discharged from the liquid ejecting apparatus, the liquid states including granular, tear-like, and thread-like shapes with trails. The "liquid" mentioned herein may be any material that can be ejected by the liquid ejecting apparatus. For example, the "liquid" may be a material in a state where the material has a liquid phase, liquid-state materials with high or low viscosities, sol, gel water, liquid-state materials such as inorganic solvents, organic solvents, solutions, liquid resin, and liquid metal (metallic melt), and the like belong to the "liquid". In addition to liquids as a state of the material, a material in which particles of functional materials made of solids such as pigments or metallic particles are dissolved, dispersed, or mixed with the solvent also belong to the "liquid". As a representative example of the liquid, there is the ink described above in the embodiment or a liquid crystal. Here, the ink may include various kinds of liquid-like compositions such as general water-based ink, oil-based ink, gel ink, and hot-melt ink.

The entire disclosure of Japanese Patent Application No. 2010-197319, filed Sep. 3, 2010 is expressly incorporated by reference herein.

What is claimed is:

1. A printing apparatus comprising:

a cartridge mounting unit in which one or more printing material cartridges are mounted; and a control circuit which includes a mounting detection circuit that detects a mounted state of the printing material cartridge in the cartridge mounting unit, wherein the printing material cartridge has an electric device and a plurality of terminals used for detecting the mounted state of the corresponding printing material cartridge in the cartridge mounting unit, the electric device is connected between two first terminals from among the plurality of terminals of the printing material cartridge, and two second terminals disposed adjacent to the two first terminals are connected via a wiring line to each other, and the mounting detection circuit outputs a first mounting inspection signal to one of the two first terminals, outputs a second mounting inspection signal having a different signal waveform from that of the first mounting inspection signal to one of the two second terminals, performs mounting inspection to determine whether or not the printing material cartridge is mounted depending on whether or not a second mounting response signal can be received as a response signal of the second mounting inspection signal via the other of the two second terminals, and performs leakage inspection of determining whether or not there is a leakage between the first and second terminals by examining at least one of whether or not the second mounting response signal is influenced by the first mounting inspection signal and whether or not a first mounting response signal is influenced by the second mounting inspection signal.

2. The printing apparatus according to claim 1, wherein, when the results of the mounting inspection and the leakage inspection are successful, the control circuit performs a high-voltage process for supplying a high-voltage signal having a higher voltage level than that of the first mounting inspection signal to the electric device via one of the two first terminals, and the mounting detection circuit monitors whether or not an overvoltage is generated in at least one of the two second terminals in the middle of the high-voltage process, and when the overvoltage is detected, stops supplying the high-voltage signal to the electric device from the control circuit.

3. The printing apparatus according to claim 1, wherein the mounting detection circuit changes an output terminal of the second mounting inspection signal from a low level to a high impedance state when the first mounting inspection signal is caused to rise from a low level to a high level.

4. The printing apparatus according to claim 1, wherein, in the cartridge mounting unit, N (N is integer equal to or larger than 2) printing material cartridges can be mounted, in each of the N printing material cartridges, the two second terminals form wiring line paths sequentially connected in series in an arrangement order of the N printing material cartridges via a plurality of apparatus-side terminals provided in the cartridge mounting unit, and the both ends of the wiring line paths are connected to the mounting detection circuit, and the mounting detection circuit determines whether or not the N printing material cartridges are all mounted to the cartridge mounting circuit, depending on whether or not the second mounting response signal can be received.

5. The printing apparatus according to claim 1, wherein the electric device is a sensor used for detecting an amount of a printing material remaining in the printing material cartridge.

6. The printing apparatus according to claim 1, wherein the electric device is a resistive element.

* * * * *